US011788271B2

(12) United States Patent
Espinosa

(10) Patent No.: US 11,788,271 B2
(45) Date of Patent: Oct. 17, 2023

(54) REINFORCED STUD-FRAMED WALL

(71) Applicant: CETRES HOLDINGS, LLC, Jackson, WY (US)

(72) Inventor: Thomas M. Espinosa, Snohomish, WA (US)

(73) Assignee: CETRES HOLDINGS, LLC, Jackson, WY (US)

( * ) Notice: Subject to any disclaimer, the term of this patent is extended or adjusted under 35 U.S.C. 154(b) by 54 days.

(21) Appl. No.: 17/104,207

(22) Filed: Nov. 25, 2020

(65) Prior Publication Data

US 2021/0148107 A1 May 20, 2021

Related U.S. Application Data

(63) Continuation of application No. 16/296,865, filed on Mar. 8, 2019, now Pat. No. 10,870,978.

(60) Provisional application No. 62/641,142, filed on Mar. 9, 2018.

(51) Int. Cl.
*E04B 1/26* (2006.01)

(52) U.S. Cl.
CPC .... *E04B 1/2604* (2013.01); *E04B 2001/2644* (2013.01); *E04B 2001/2684* (2013.01); *E04B 2001/2696* (2013.01)

(58) Field of Classification Search
CPC ..... E04B 1/2604; E04B 2001/2644; E04B 2001/2684; E04B 2001/2696
See application file for complete search history.

(56) References Cited

U.S. PATENT DOCUMENTS

| | | | |
|---|---|---|---|
| 1,360,774 | A | 11/1920 | Dermot et al. |
| 1,552,474 | A | 9/1925 | Domler |
| 1,656,810 | A | 1/1928 | Amstein |
| 2,263,272 | A | 11/1941 | Moss |
| 2,727,712 | A | 12/1955 | Holmboe |
| 2,891,759 | A | 6/1959 | Holmboe, Sr. |
| 4,557,091 | A | 12/1985 | Auer |
| 4,616,960 | A | 10/1986 | Gladish |
| 4,713,924 | A | 12/1987 | Toti |
| 4,812,096 | A | 3/1989 | Peterson |
| 4,863,307 | A | 9/1989 | Jones |

(Continued)

FOREIGN PATENT DOCUMENTS

| | | | |
|---|---|---|---|
| JP | 05009941 | A | 1/1993 |
| JP | 06185072 | A | 7/1994 |

OTHER PUBLICATIONS

International Search Report and the Written Opinion of the International Searching Authority, PCT/US19/21352, dated May 15, 2019.

*Primary Examiner* — Paola Agudelo
(74) *Attorney, Agent, or Firm* — Fresh IP PLC

(57) ABSTRACT

A reinforced stud-framed wall, including a bottom plate; first and second vertical studs; a member supported on the bottom plate, the member having a compression strength greater than a compression strength of the bottom plate; the first vertical stud having a bottom end supported on the member with a first contact area, whereby a load on the first contact area is spread over a first area on the bottom plate larger than the first contact area; and the second vertical stud having a bottom end supported on the member with a second contact area, whereby a load on the second contact area is spread over a second area on the bottom plate larger than the second contact area.

43 Claims, 58 Drawing Sheets

(56) References Cited

U.S. PATENT DOCUMENTS

| | | | | |
|---|---|---|---|---|
| 4,875,314 | A | 10/1989 | Bollen | |
| 4,945,695 | A | 8/1990 | Majurinen | |
| 5,002,318 | A | 3/1991 | Witter | |
| 5,073,061 | A | 12/1991 | Jones | |
| 5,377,447 | A | 1/1995 | Fritch | |
| 5,531,054 | A | 7/1996 | Ramirez | |
| 5,535,561 | A | 7/1996 | Schuyler | |
| 5,540,530 | A | 7/1996 | Fazekas | |
| 5,570,549 | A | 11/1996 | Lung et al. | |
| 5,625,996 | A | 5/1997 | Bechtel | |
| 5,729,944 | A | 3/1998 | De Zen | |
| 5,769,562 | A | 6/1998 | Jones | |
| 6,099,201 | A | 8/2000 | Abbrancati | |
| 6,195,949 | B1 | 3/2001 | Schuyler | |
| 6,230,451 | B1 | 5/2001 | Stoller | |
| 6,322,045 | B1 | 11/2001 | Andros | |
| 6,327,831 | B1 | 12/2001 | Leek | |
| 6,442,908 | B1 | 9/2002 | Naccarato et al. | |
| 6,494,654 | B2 | 12/2002 | Espinosa | |
| 6,688,058 | B2 | 2/2004 | Espinosa | |
| 6,715,258 | B1 | 4/2004 | Mueller | |
| 6,834,471 | B2 | 12/2004 | Takagi et al. | |
| 6,843,027 | B2 | 1/2005 | Gaddle et al. | |
| 6,951,078 | B2 | 10/2005 | Espinosa | |
| 7,051,988 | B2 | 5/2006 | Shaw et al. | |
| 7,059,573 | B2 | 6/2006 | Calleja | |
| 7,150,132 | B2 | 12/2006 | Commins | |
| 7,159,366 | B2 | 1/2007 | Espinosa | |
| 7,287,355 | B2 * | 10/2007 | Commins | E04B 1/2604 52/573.1 |
| 7,444,789 | B1 | 11/2008 | Moore | |
| 7,513,083 | B2 | 4/2009 | Pryor et al. | |
| 7,621,085 | B2 | 11/2009 | Commins | |
| 7,665,257 | B2 | 2/2010 | Posey | |
| 7,665,258 | B2 | 2/2010 | Espinosa | |
| 7,762,030 | B2 | 7/2010 | Espinosa | |
| 7,828,263 | B2 | 11/2010 | Bennett et al. | |
| 7,967,524 | B2 | 6/2011 | Jones | |
| 8,127,506 | B2 | 3/2012 | Schneider | |
| 8,925,256 | B2 | 1/2015 | Donoho | |
| 2001/0002524 | A1 | 6/2001 | Espinosa | |
| 2002/0073634 | A1 | 6/2002 | Bollinger et al. | |
| 2003/0136075 | A1 | 7/2003 | Brackett | |
| 2003/0159397 | A1 | 8/2003 | Birnbaum | |
| 2006/0070340 | A1 | 4/2006 | Fanucci | |
| 2006/0156657 | A1 | 7/2006 | Commins | |
| 2008/0060296 | A1 | 3/2008 | Espinosa | |
| 2009/0107082 | A1 | 4/2009 | Commins | |
| 2010/0115866 | A1 * | 5/2010 | Espinosa | E04B 1/08 52/712 |
| 2012/0304589 | A1 * | 12/2012 | Commins | E04B 1/2604 52/745.21 |
| 2012/0317905 | A1 * | 12/2012 | MacDuff | E04C 3/122 52/847 |
| 2014/0109503 | A1 | 4/2014 | Fielder | |
| 2019/0034571 | A1 | 11/2019 | Espinosa | |

* cited by examiner

FIG. 31A
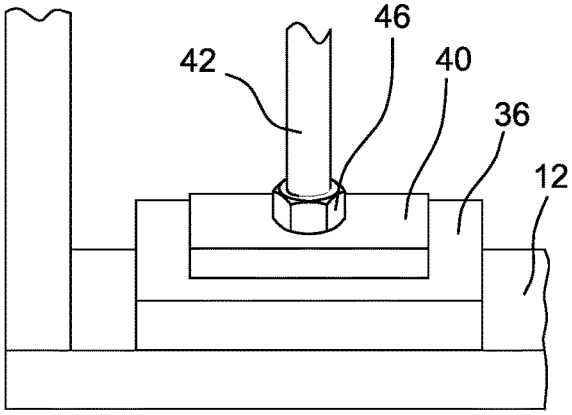
FIG. 31B
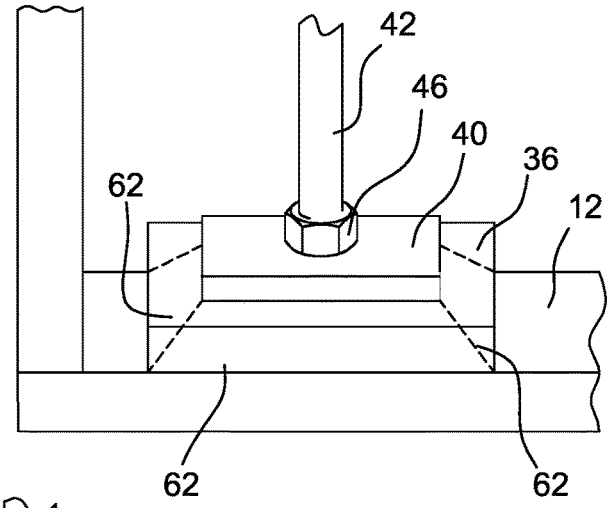
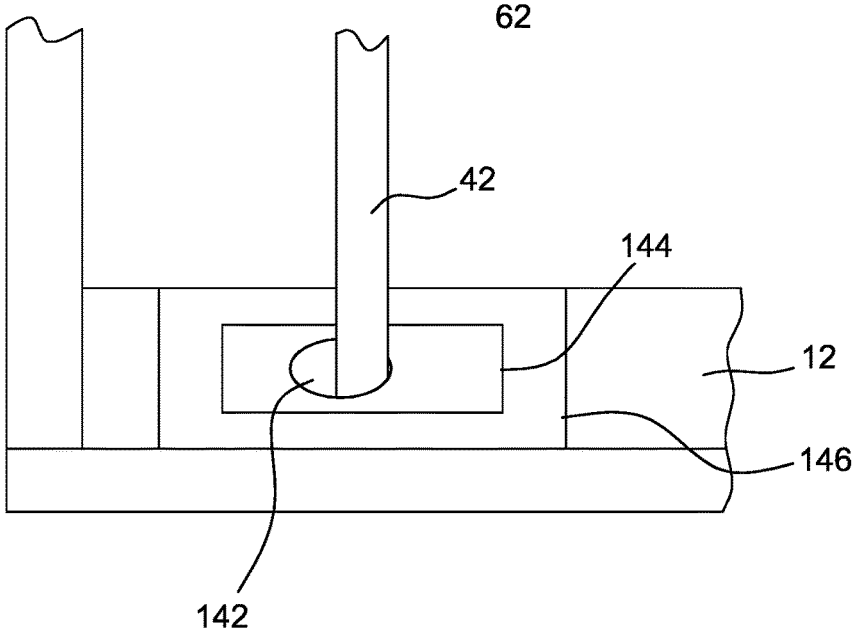
FIG. 31C

FIG. 32B
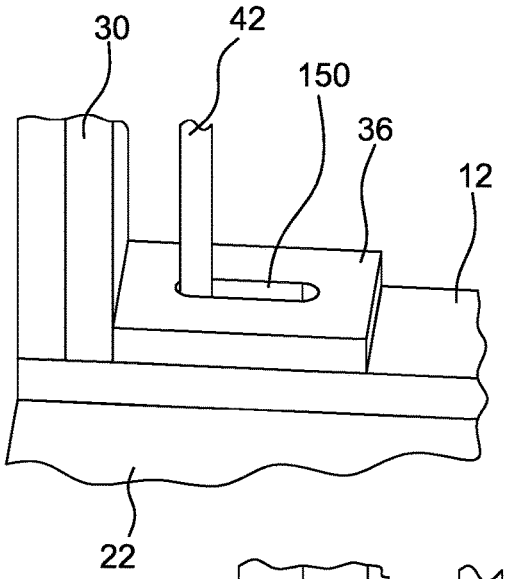
FIG. 32C
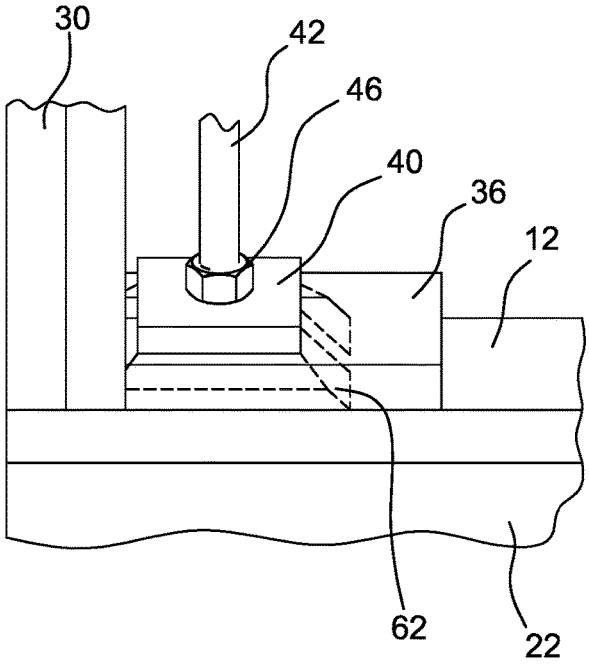
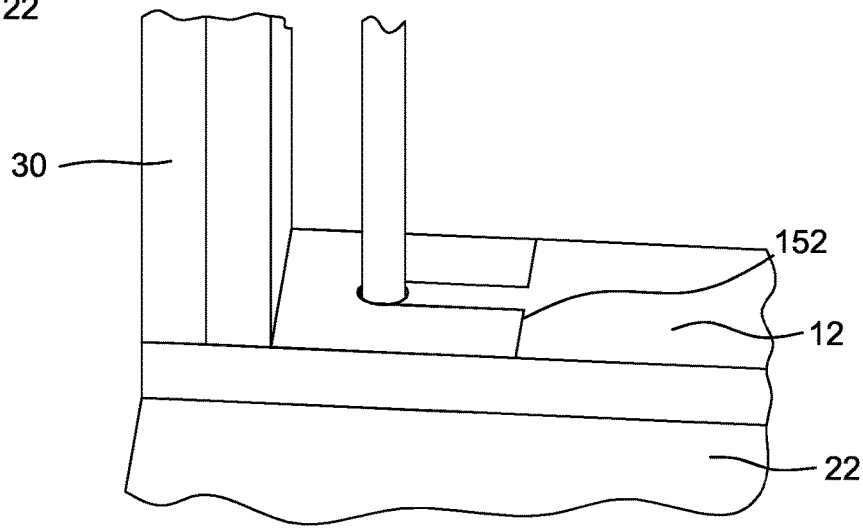
FIG. 32D

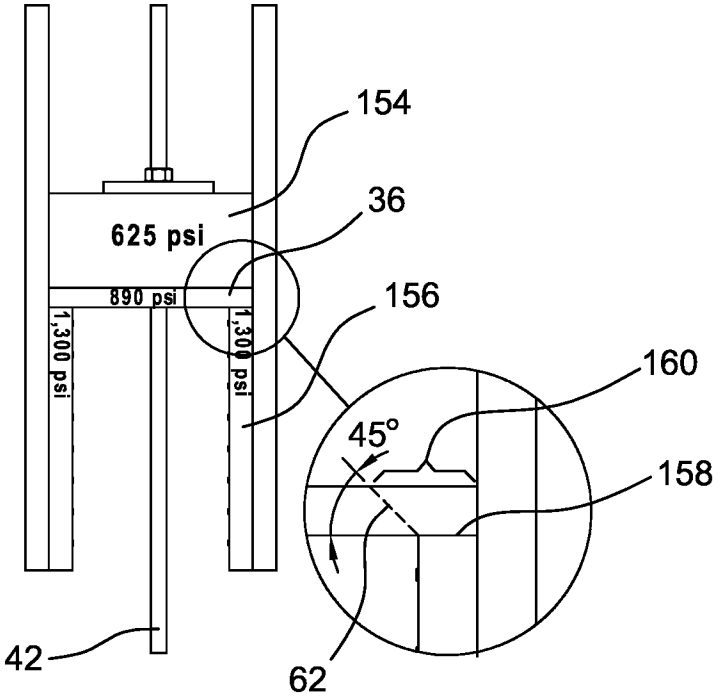
FIG. 34B
FIG. 34A
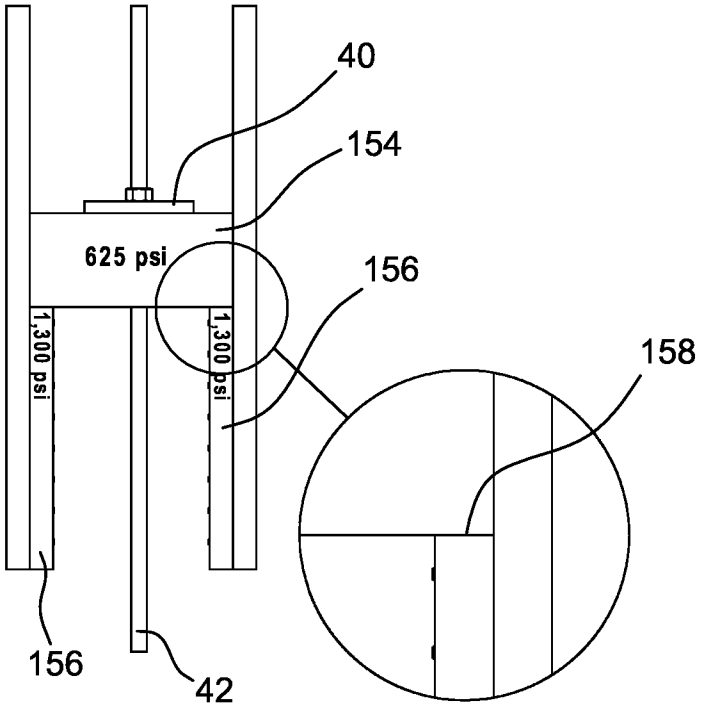
FIG. 33B
FIG. 33A

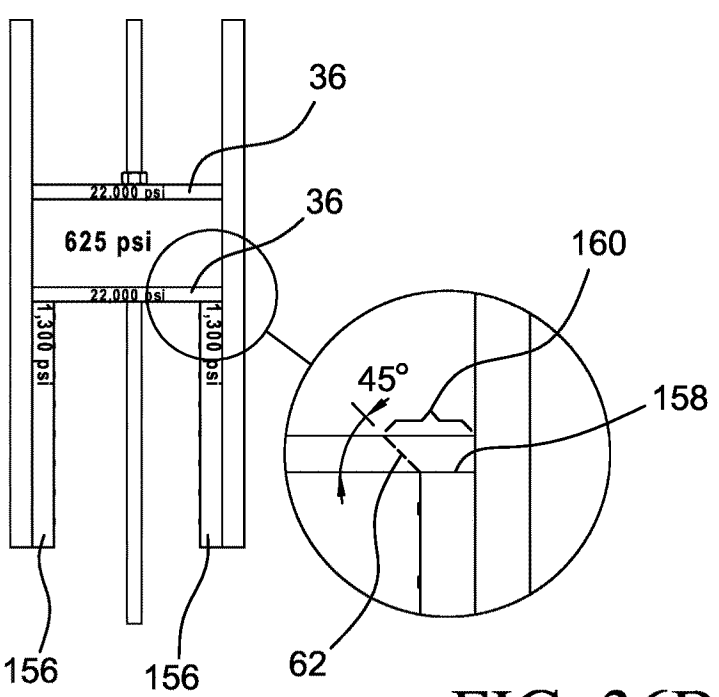
FIG. 36B
FIG. 36A
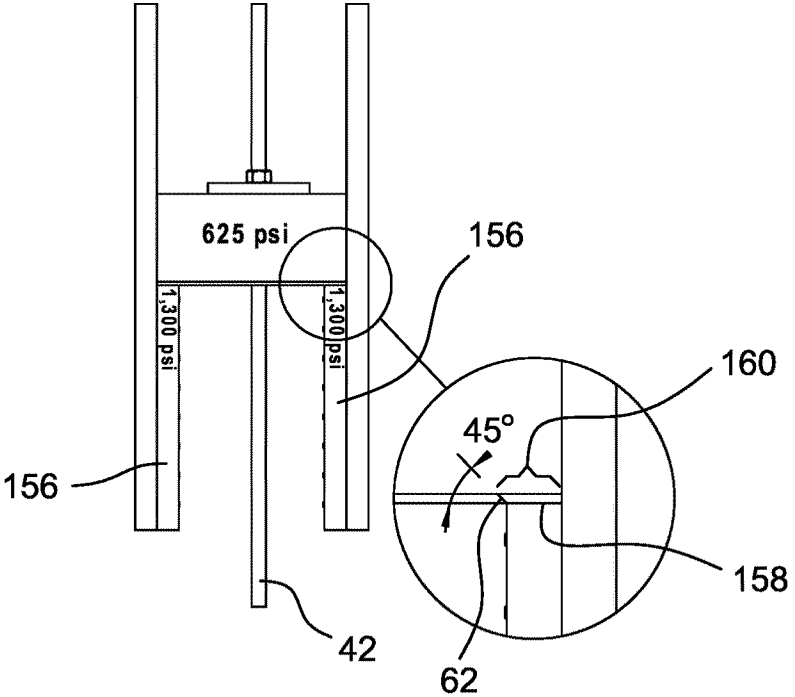
FIG. 35B
FIG. 35A

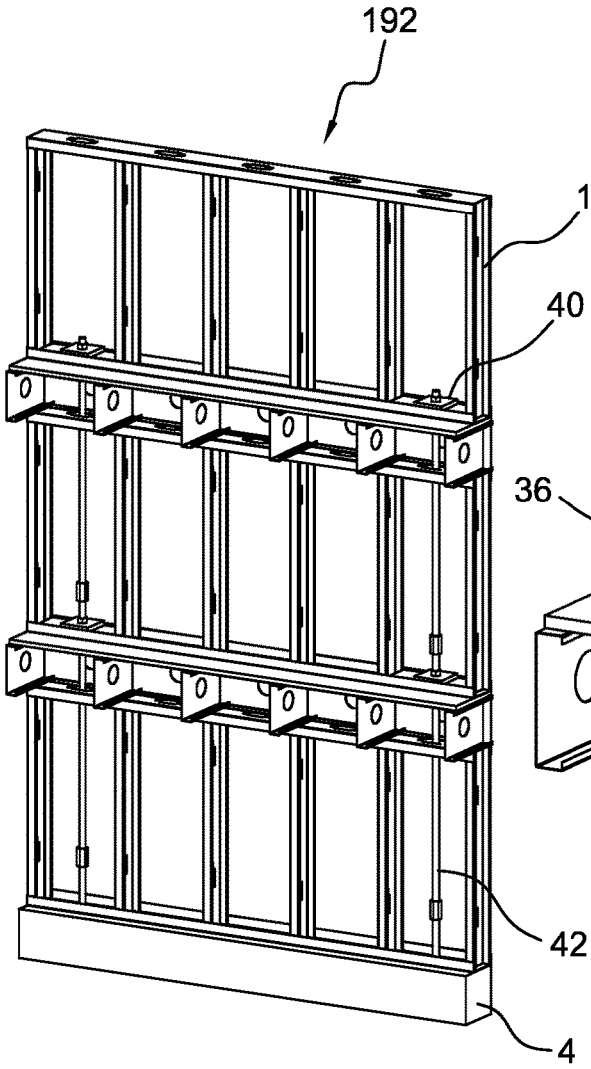
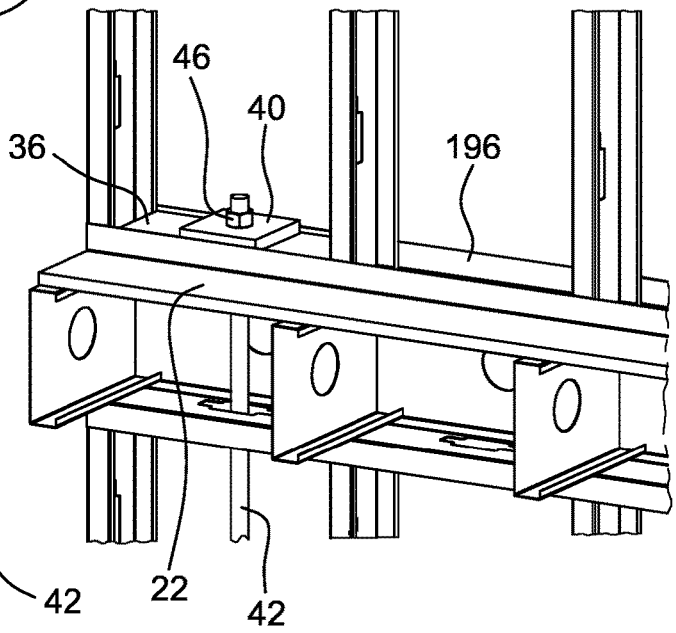
FIG. 46B
FIG. 46A

REINFORCED STUD-FRAMED WALL

RELATED APPLICATION

This is a continuation application of application Ser. No. 16/296,865, filed Mar. 8, 2019, which is a nonprovisional application of Provisional Application Ser. No. 62/641,142, filed Mar. 9, 2018, hereby incorporated herein by reference.

FIELD OF THE INVENTION

The present invention is generally directed to reinforced building walls and particularly to reinforced stud-framed walls.

SUMMARY OF THE INVENTION

The present invention provides a method of imposing a perpendicular-to-grain load on a lumber that would otherwise exceed its compression strength by interposing a member with a higher compression strength than the lumber's compression strength between the load and the lumber. The interposition of the member between the load and the lumber advantageously provides for spreading the load over a larger area on the lumber than the contact area of the load on the member, thereby reducing the load per unit area on the lumber.

BRIEF DESCRIPTION OF THE DRAWINGS

FIGS. 31A-31C are perspective views of an assembly for compensating for an oversized opening in the bottom plate.

FIGS. 32A-32D are perspective view of an assembly for allowing the use of a smaller bearing plate than originally specified for the load.

FIGS. 33A-33B illustrate the loading at a bride member.

FIGS. 34A-36B illustrate the loading at a bridge member when using an intermediary member according to the present invention.

FIGS. 46A-46B is a perspective view of a reinforced shear wall using U-shaped metal studs.

DETAILED DESCRIPTION OF THE INVENTION

Figure 1:
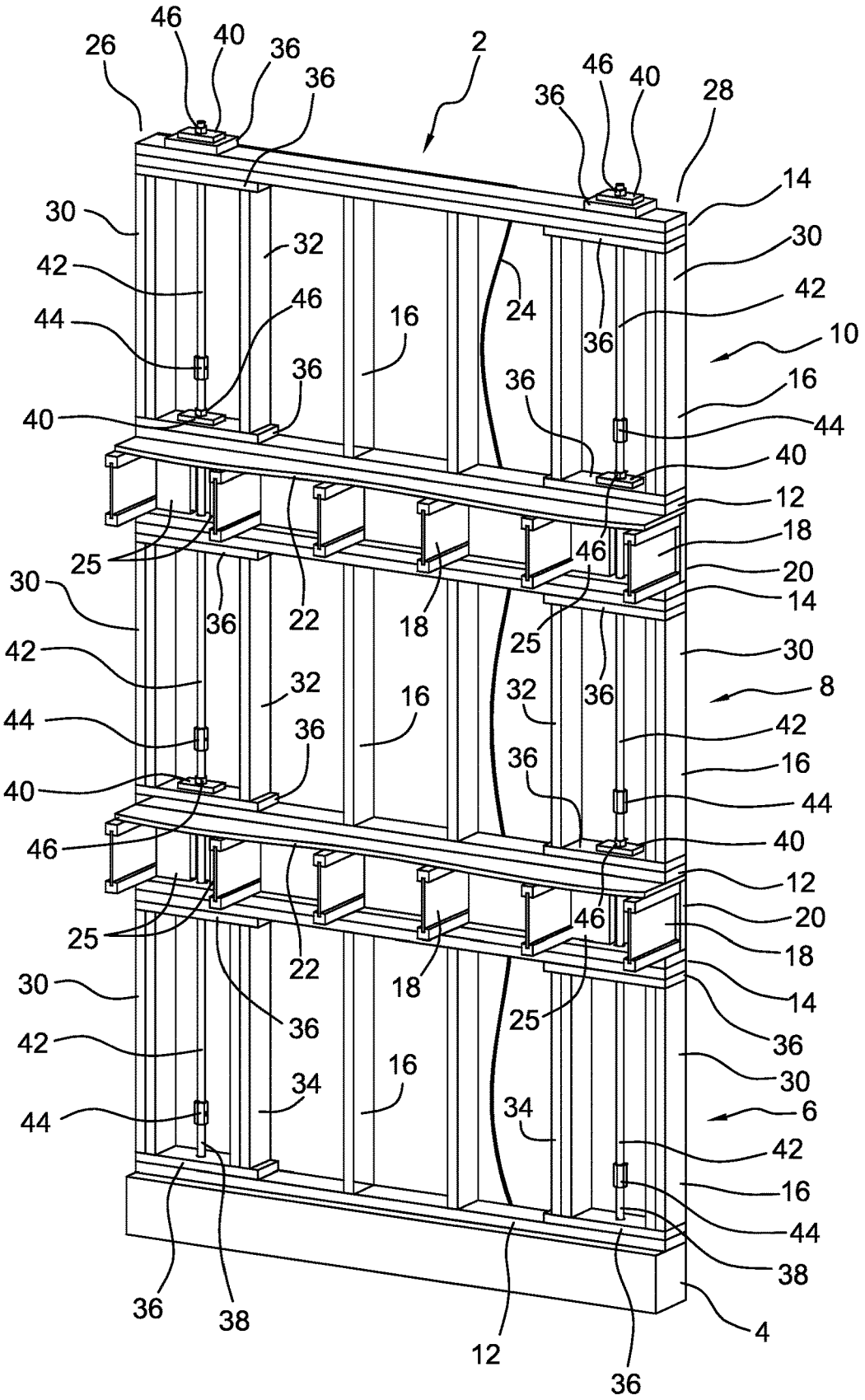
FIG. 1 is perspective view of a reinforced shear wall.

Referring to FIG. 1, a reinforced shear stud-framed wall 2 using an embodiment of the present invention is disclosed. The wall 2 is supported by a foundation 4 made of poured concrete. The foundation 4 may also be a concrete slab, wood beam, structural metal beam, or another part of the wall, depending on the structure of the building utilizing the wall 2. The wall 2 is shown with three stories, including a bottom floor wall 6, an upper or intermediate floor wall 8 and a top floor wall 10. The wall 2 may also include more than 3 floors, for example 5, with a bottom floor wall, several upper or intermediate floor walls and a top floor wall. The present invention will be described using a 3 floor wall but a person of ordinary skill in the art will understand that the invention can be equally applied to a wall of one floor, two floor or more than 3 floor structures.

Each of the walls 6, 8 and 10 includes a bottom plate 12, a double top plate 14 and a plurality of vertical studs 16 disposed between the respective bottom plates 12 and the top plate 14. The top plate 14, although shown with two pieces or members, may also be a single piece top plate. The bottom plates 12, the top plates 14 and the vertical studs 16 are typically nominally 2"×4" or 2"×6" dimensional lumber made from softwood, such as Douglas fir, white pine, etc. Floor joists 18 are supported by the respective top plates 12. Ledger boards 20 are attached to the ends of the floor joist 18 and to the respective top plates 14 and the bottom plates 12. Subfloors 22, typically made of 4'×8' plywood sheets 22, are attached to the respective floor joists 18 and the ledger boards 20. The bottom plates 12 are attached to the subfloors 22. Sheathing 24, typically made of 4'×8' plywood sheets are attached to the bottom plates, the top plates, the ledger boards and the vertical studs, making the wall 2. Blockings 25 may be provided between the subfloor 22 and the top plate 14 on each side of the tie-rod 42 to bridge the space for better load transfer.

The wall 2 has end portions 26 and 28 with respective outer studs 30 and inner studs 32 for the intermediate floor wall 8 and the top floor wall 10. The outer studs 30 are made of two studs attached to each other with nails, screws, bolts or other standard fasteners. For the bottom floor wall 6, inner studs 34 are doubled (two studs joined together by nails, screws, bolts or other standard fasteners) for additional load capacity. Depending on the number of floors, the outer studs 30 and the inner studs 32 and 34 in the lower and upper floor walls may be made of single piece solid wood or metal posts.

Members 36 are disposed at the bottom and top ends of the respective outer studs 30 and the inner studs 32 and 34. The members 36 have each a compression strength (relative to a force perpendicular to grain or fiber direction) greater than the compression strength of the bottom plates 12. The members 36 may be made of engineered wood, hollow metal, recycled plastic building material, glass filled plastic, fiberglass or solid metal. Engineered wood "includes a range of derivative wood products which are manufactured by binding or fixing the strands, particles, fibers, or veneers or boards of wood, together with adhesives, or other methods of fixation to form composite materials." See https://en.wikipedia.org/wiki/Engineered_wood, hereby incorporated by reference. Structural composite lumber (SCL), which includes laminated veneer lumber (LVL), parallel strand lumber (PSL), laminated strand lumber (LSL) and oriented strand lumber (OSL), is a family of engineered wood products created by layering dried and graded wood veneers, strands or flakes with moisture resistant adhesive into blocks of material known as billets, which are subsequently resawn into specified sizes. See https://www.apawood.org/structural-composite-lumber, hereby incorporated by reference.

Anchor rods 38 are anchored in the foundation 4 and extend through the bottom plate 12 and the members 36 in the bottom floor wall 6. Bearing plates 40 made of metal are disposed on the respective members 36. Bearing plates 40 are planar or flat to make maximum contact with the surfaces on which they are used. Tie-rods 42 connect to the respective anchor rods 38 with couplings 44 and extend through the respective bottom plates 12, the bearing plates 40 and the members 36. Nuts 46 at the intermediate floor wall 8 and the top floor wall 10 tighten the tie-rods 42 against the bearing plates 40.

On the top plate 14 at the top floor wall 10, members 36 are disposed on top of the top plate 14. Bearing plates 40 are disposed on the members 36. Nuts 46 tighten the tie-rods 42 against the bearing plates 40.

The wall 2 can take compression and tension loads. A shear wall is subject to lateral forces along the plane of the wall, subjecting the wall to both compression and tension loads. Assuming the left end portion 26 is being pushed to the right, the end portion 26 will be subject to tension loads while the right end portion 28 will be experiencing compression loads. Compression loads are directed toward the ground, tending to push the wall downwardly. Tension loads are directed upwardly, tending to lift the wall 2. The wall 2 is advantageously reinforced for both compression and tension loads.

Figure 2:
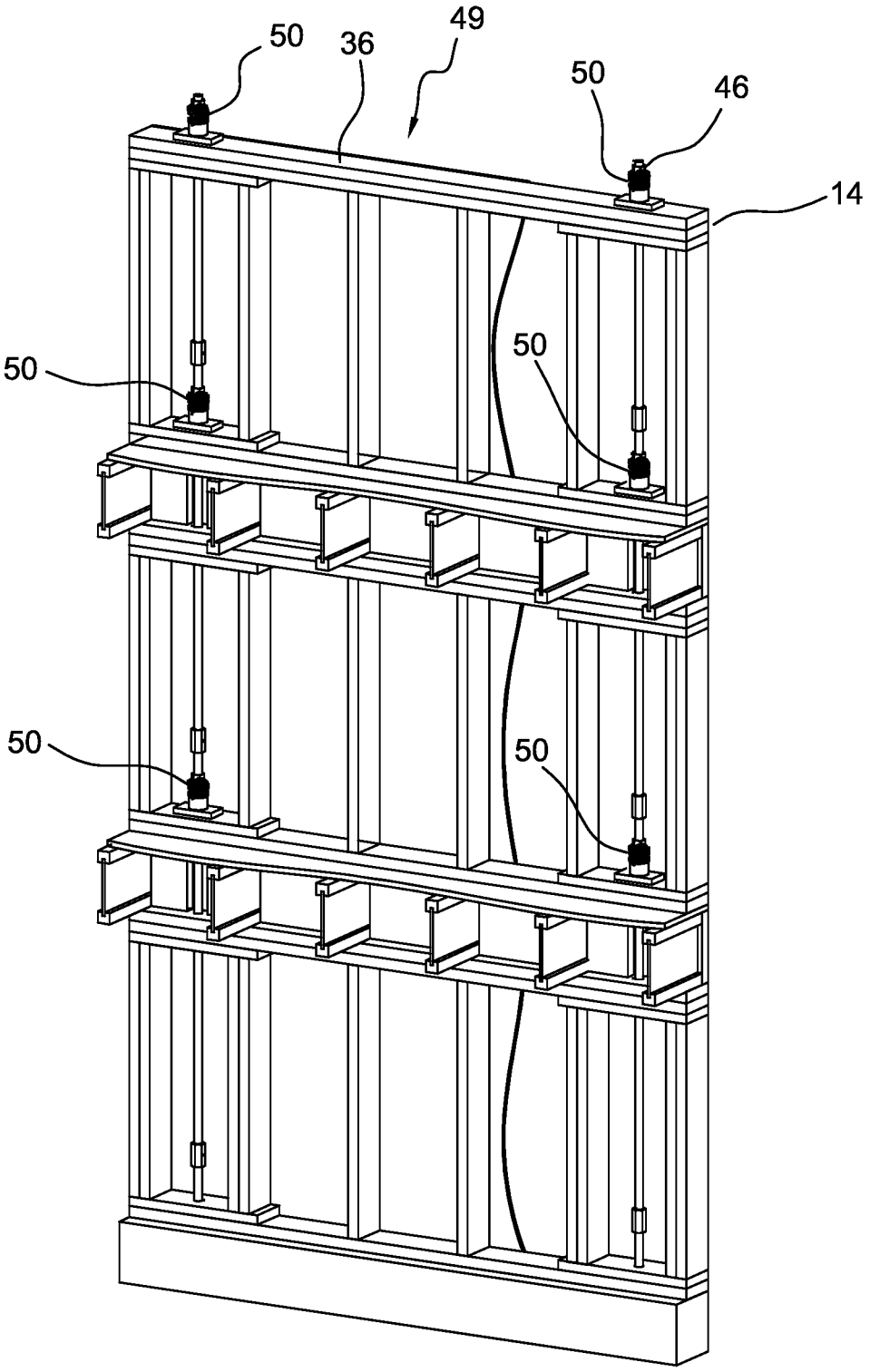
FIG. 2 is a perspective view of another embodiment of a reinforced shear wall.

Referring to FIG. 2, the wall 2 is modified as wall 49, which is the same as the wall 2 except that one member of the double top plate 14 is replaced with the member 36. Further, expandable fasteners 50, as disclosed in U.S. Pat. Nos. 7,762,030 and 6,951,078, hereby incorporated by reference, are interposed between the respective nuts 46 and the bearing plates 40. Other expandable fasteners may also be used. The expandable fasteners 50 advantageously keep the tie-rods tight against the bearing plates 40 as the wall shrinks due to drying, settlement, etc.

The various ways of reinforcing the walls disclosed above may be used with lesser components or with a combination of arrangements taken from each wall. For example, the walls may use a combination of bearing plate and nut arrangement and bearing plate and expandable fastener arrangement. The arrangements for anchoring the top plate 14 may be used for single story wall where the tie-rod 42 may be tied to the top plate without any intervening connections to the wall below.

Sawn lumber, such Douglas-fir, used for framing walls generally has its fibers or "grain" oriented along the lumber's length or longitudinal axis. Perpendicular to grain means a direction perpendicular to the lumber's length. Parallel to grain means a direction parallel to the length of the lumber. Sawn lumber has different load capacities, depending on whether the load is perpendicular to grain or parallel to grain.

Figure 3A:
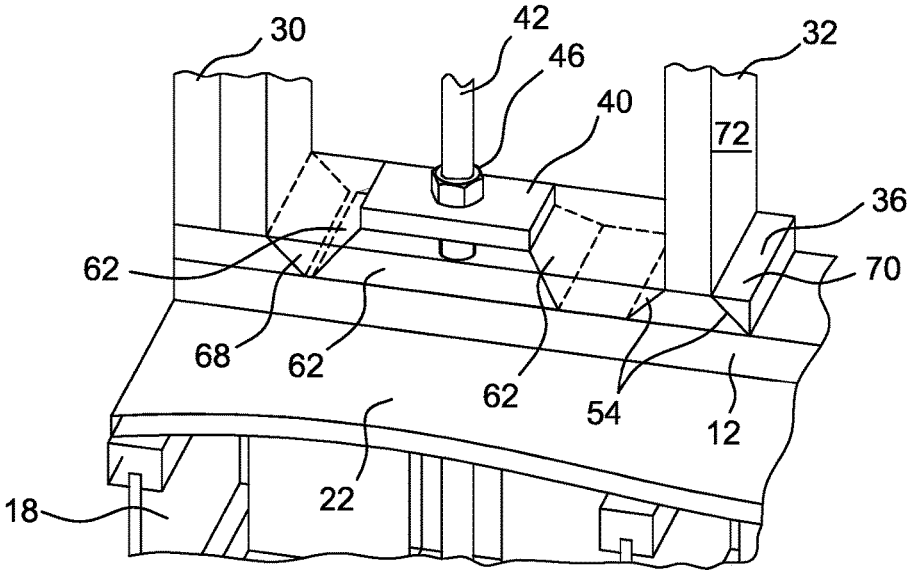
FIG. 3A in an enlarged perspective view of a portion of the shear wall of FIG. 1.
Figure 3B:
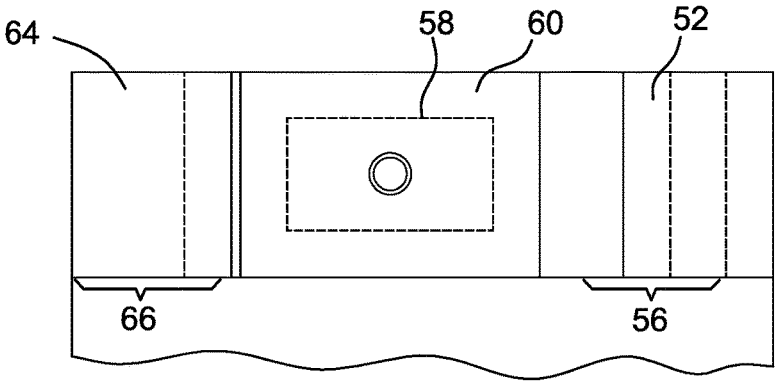
FIG. 3B is a plan view of FIG. 3A showing load contact areas and load projected areas.

The advantageous use of the members 36 will now be described. Referring to FIGS. 3A and 3B, the stud 32 can generally carry a load (parallel to grain) of 1300 psi. vertically. The bottom plates can carry a load (perpendicular to grain) of about 625 psi. The bottom end of the stud 32 has a contact area 52 of 8.25 sq. in. (1.5"×5.5" for a nominal 2×6 stud). The member 36 with a load capacity of 890 psi can support a total force of about 7342 lb. exerted by bottom of the stud 32. If the stud 32 is disposed on the bottom plate 12 without the member 36, the bottom plate 12 can only support a load of about 5156 lb. With the use of the member 36, the load is spread 45° outwardly, as generally shown by planes 54, onto a larger area 56 on the underlying bottom plate 12 from the perimeter of the bottom end of the stud 32. The larger area 56 is calculated to be 24.75 sq. for the member 36 with a thickness and depth of 1.5" and 5.5", respectively. Accordingly, the 7342 lb. force is distributed over the larger area 56 at 297 psi, which is within the 625 psi limit of the bottom plate 12. Clearly, with the use of the member 36, the load from the stud 32 is transferred through the member 32 onto a larger area on the underlying bottom plate 12 so that the load capacity of the bottom plate 12 is not exceeded. By increasing the thickness and depth of the member 36, the load can even be projected onto a larger area on bottom plate 12, allowing for higher loads from the stud 32.

By choosing the member 36 with a higher compression capacity, the 10000 lb. total load capacity of the stud 32 may be utilized. For example, plywood is rated at 950 psi, fiberglass at 50 k-60 k psi, aluminum at 22 k psi, etc.

The load on the bearing plate 40 is also transferred through the member 36 onto the bottom plate 12 in the same way. The contact area 58 of the bearing plate 40 is projected onto a larger area 60 corresponding to the base of a truncated pyramid with sides extending from the respective edges of the bearing plate 40 along 45° planes 62. The bearing plate 40 is advantageously reduced in size while still being able to project the larger area 60 onto the bottom plate 12. For example, the bearing plate 40 with dimensions of 2.5"×5", the contact area 58 will be 12.5 sq. in., which is projected onto the area 60 to 44 sq. in. on the bottom plate 12. If the bearing plate 40 loads the member 36 to its maximum of 890 psi, the load transferred to the bottom plate 12 is 11125 lb., which translates to about 253 psi, which is well within the 625 psi load limit of the bottom plate 122.

The load on the outer studs 30 is transferred to the bottom plate 12 in the same way as disclosed above. The contact area 64 of the bottom ends of the 2×6 studs 30 is 16.5 sq. in. If the member 36 is load to its maximum capacity of 890 psi, the load generated by the studs 30 is about 14685 lb. The area 64 is projected onto the area 64 via the 45° plane 68. The area 66 calculates to 24.75 sq. in. The load transferred to the area 66 becomes about 593 psi, still within the 625 psi load capacity of the bottom plate 12.

Figure 3C:
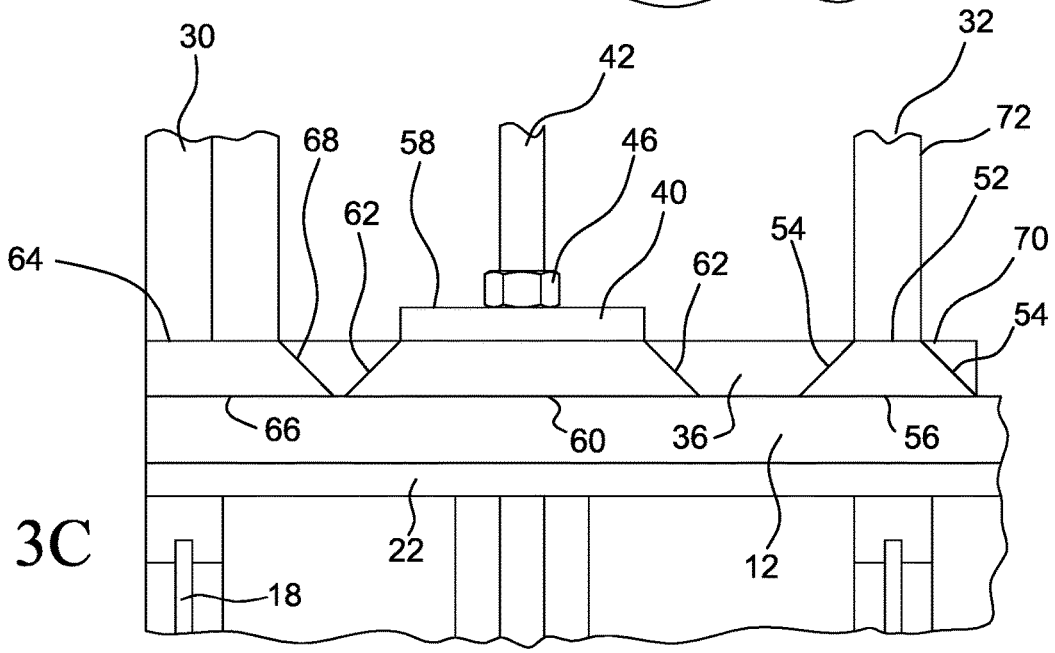
FIG. 3C is a side elevational view of FIG. 3A showing the transfer and spread of the load from the load contact area to the load projected area.

Referring to FIG. 3C, the member 36 has ha a higher compression strength than the sawn lumber bottom plate 12. The member 36 can handle a higher load on the same area from the studs 32 and 30 and the bearing plate 40 without crushing than the bottom plate 12. As the forces from the studs 32 and 30 and the bearing plate 40 travel through the member 36, the forces spread out, as depicted by the 45° planes 54, 62 and 68, increasing the original contact areas 52, 58 and 64 to areas 56, 60 and 66 on the bottom plate 12 to support the loads. No bending of the member 36 is assumed as the force is dispensed at 45°. By using an intermediate material, such as the member 36, of a higher compression strength, loads can be transferred to materials of lower compression strength, such as the sawn lumber bottom plate 12, without substantially exceeding the load capacity of the lower compression strength materials.

Referring to FIGS. 3A and 3C, the member 36 has a portion 70 that extends beyond the right side 72 of the stud 32 to provide the full projected area 56. The full projected area 56 may be needed, depending on the load. Without the portion 70, the area 56 would have terminated flush with right side 72 of the stud 32.

Figure 4A:
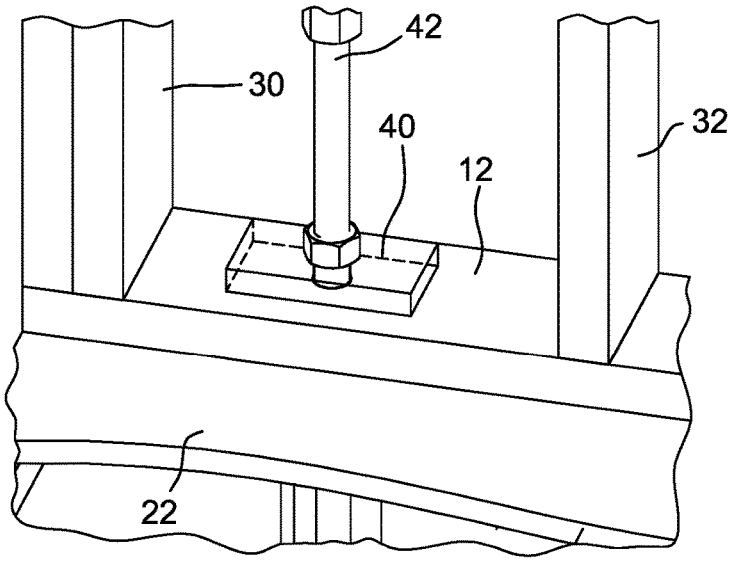
FIG. 4A is a perspective view of a tie-rod and bearing plate on a bottom plate.
Figure 4B:
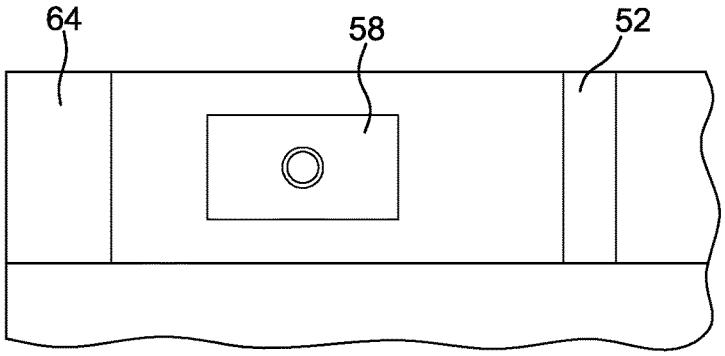
FIG. 4B is a top plan view of FIG. 4A showing the load contact areas.
Figure 4C:
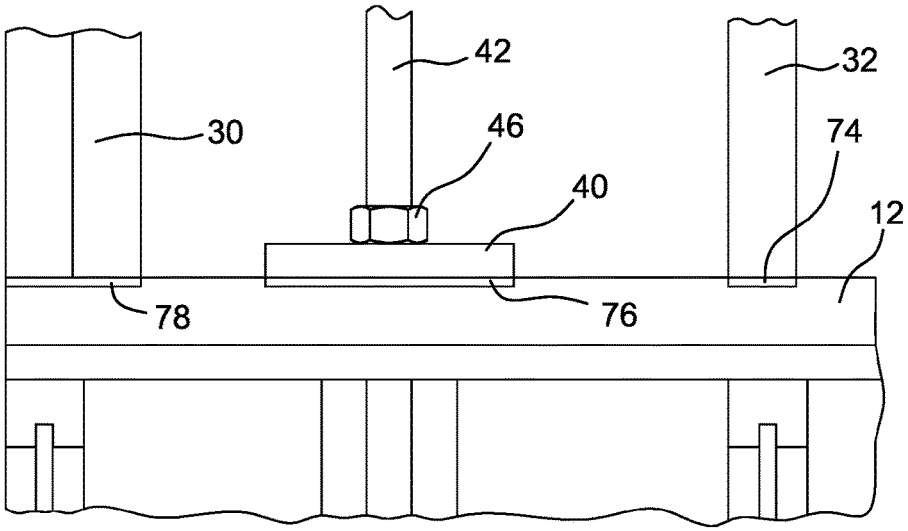
FIG. 4C is side elevational view of FIG. 4A showing the load contact areas being limited to the actual contact areas.

Referring to FIGS. 4A, 4B and 4C, the studs 32 and 30 are supported by the bottom plate 12 without the use of the member 36. The bearing plate 40 also bears on the bottom plate 12 directly, without the member 36. The loads on the studs 32 and 30 and the bearing plate are supported directly by the bottom plate 12 over the contact areas 52, 58 and 64. Due to the loads exceeding the load capacity of the bottom plate 12, the contact areas 52, 58 and 64 sink down into the bottom plate 12, creating depressions 72, 76 and 78. With the use of the member 36, the crushing of the bottom plate 12 is advantageously avoided by spreading the loads over larger areas.

It should be understood that the principle described above regarding the use of the member 36 to spread the load over a larger area than the contact area of the bearing plate 40 is equally applicable when the member 36 is below rather than above the area on which the load is to be spread over a larger area. Accordingly, the members 36 disposed above the studs 30 and 32 and below the top plates 14 spread the load from the contact areas of the top ends of the studs 30 and 32 onto the larger areas 66 and 56 encompassed by the intersection of the 45° planes 68 and 54 on the top plate 14.

As described above, the present invention provides a method of imposing a perpendicular-to-grain load on a lumber that would otherwise exceed its compression strength by interposing a member with a higher compression strength than the lumber's compression strength between the load and the lumber. The interposition of the member between the load and the lumber advantageously provides for spreading the load over a larger area on the lumber than the contact area of the load on the member, thereby reducing the load per unit area on the lumber.

Figure 5:
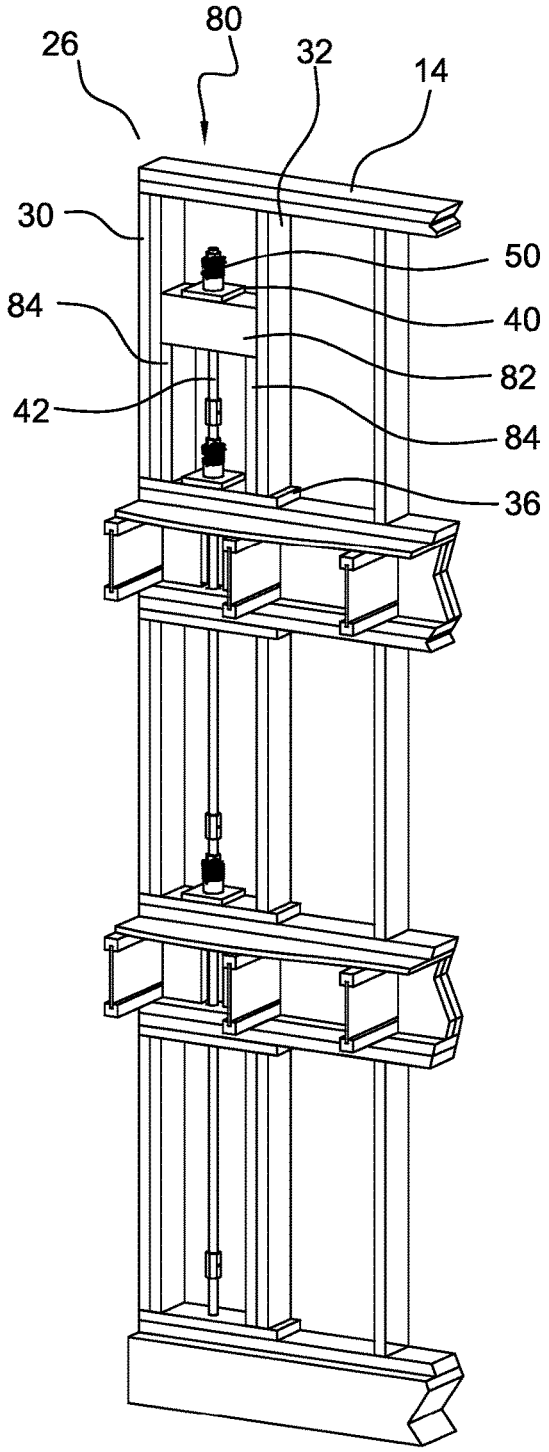
FIG. 5 is a perspective partial view of another embodiment of a reinforced shear wall.

Referring to FIG. 5, the wall 49 is modified as shear stud-framed wall 80 wherein the tie-rod 42 is terminated in a bridge member 82. Only the left end portion 26 of the wall 80 is shown. Jack studs 84 are attached to the respective outer studs 30 and the inner stud 32. The bottom ends of the jack studs 84 are supported on the member 36. The top ends of the jack studs 84 support the bridge member 82. The wall 80 can take compression and tension loads.

Figure 6:
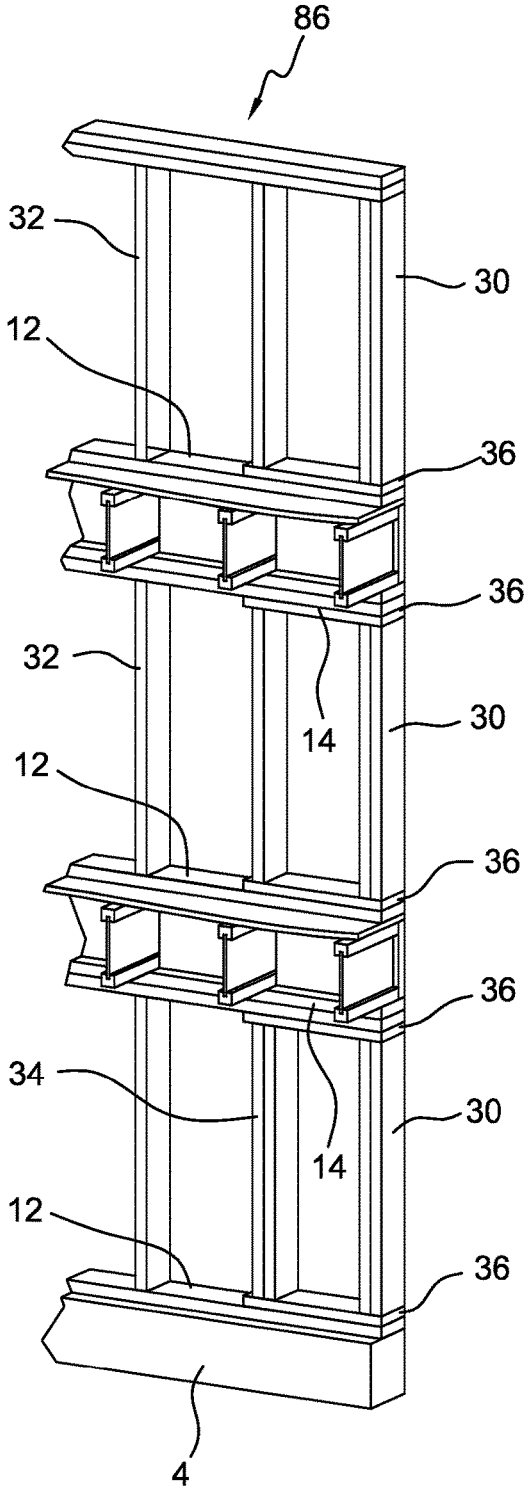
FIG. 6 is a perspective partial view of another embodiment of a reinforced shear wall.

Referring to FIG. 6, a shear stud-framed wall 86 for compression loads is disclosed. The wall 86 is the same as the wall 2 but without the tie rods 42, the associated bearing plates 40 and the nuts 46 or the expandable fasteners 50. The members 36 advantageously transfer the compression loads from the studs 30, 32 and 34 to the underlying bottom plates 12 or overlying top plates 14 to the foundation 4. The members 36 advantageously spread out the loads so that the bottom plates 12 and the top plates 14 are not loaded beyond their compression strengths.

Figure 7A:
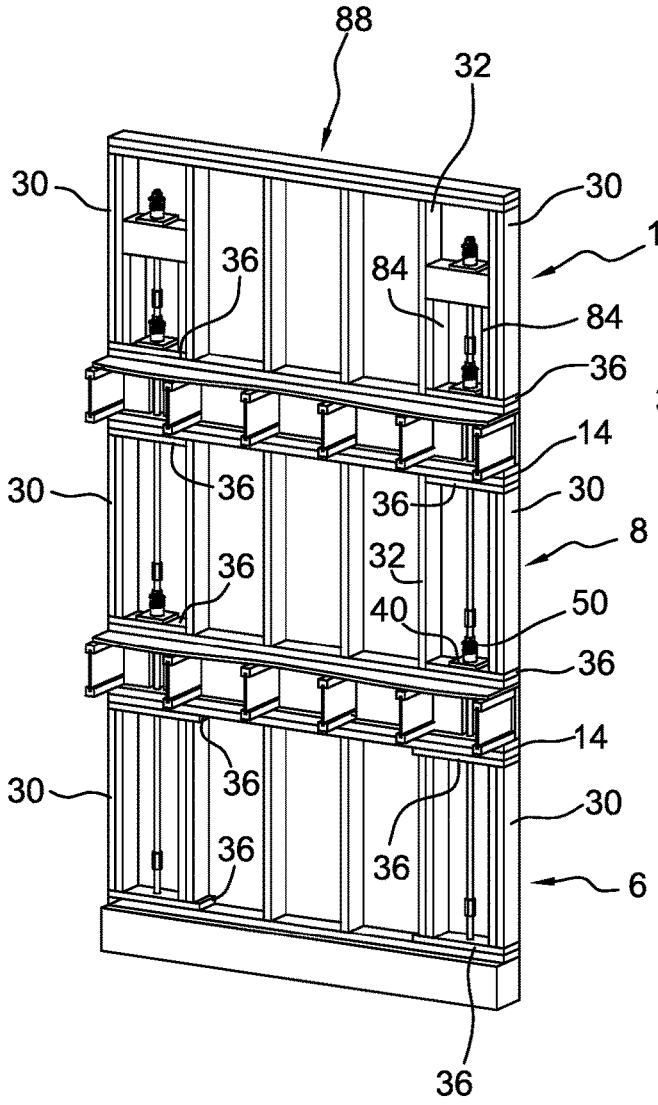
FIG. 7A is a perspective view of another embodiment of a reinforced shear wall.
Figure 7B:
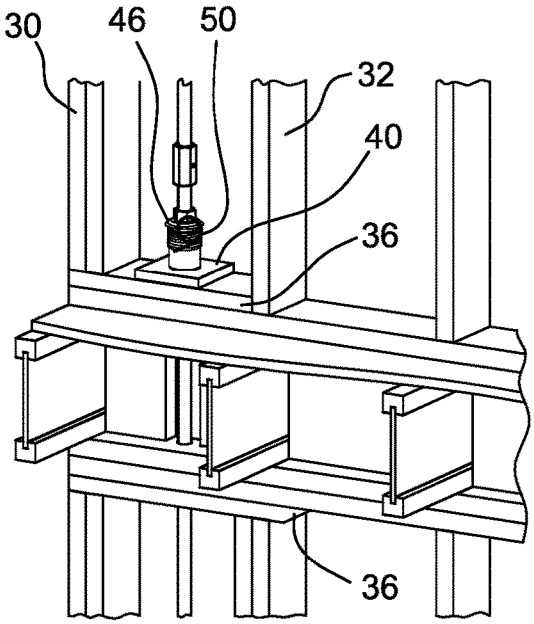
FIG. 7B is an enlarged perspective view of a portion of the shear wall of FIG. 7A.

Referring to FIGS. 7A and 7B, a shear stud-framed wall 88 similar to the wall 80 is disclosed. The wall 88 differs from the wall 80 in the extent of the member 36 in the intermediate floor wall 8 and the top floor wall 10 where the members 36 do not extend beyond the respective inner studs 32. In the intermediate floor wall 8, the members 36 are underneath the respective bottom ends of the outer studs 30 but not the bottom ends of the inner studs 32. The members 36 immediately below the top plate 14 also do not extend beyond the inner studs 32 but are on top of the top ends of the outer studs 30. In the top floor wall 10, the members 36 are underneath the respective bottom ends of the jack studs 84, in addition to being underneath the bottom ends of the outer studs 30.

Figure 8A:
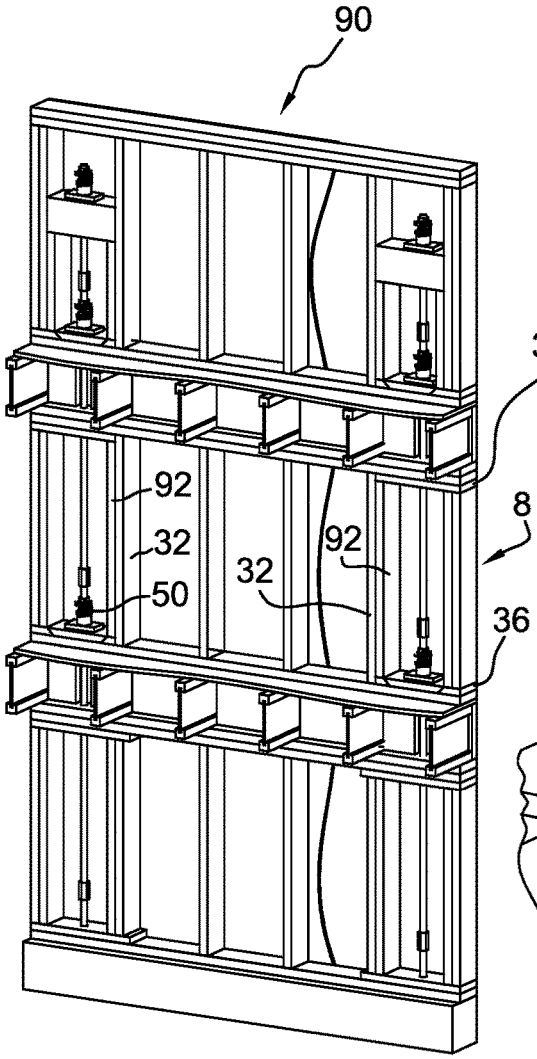
FIG. 8A is a perspective view of another embodiment of a reinforced shear wall.
Figure 8B:
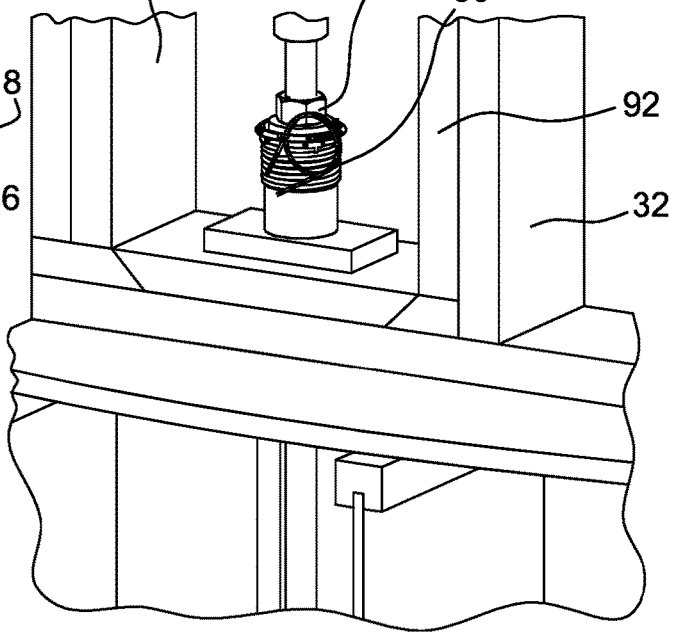
FIG. 8B is an enlarged perspective view of a portion of the shear wall of FIG. 8A.

Referring to FIGS. 8A and 8B, a shear stud-framed wall 90 is the same as the wall 88, except that in the intermediate floor wall 8, jack studs 92 are attached to the inner studs 32. The members 36 are underneath the bottom ends of the respective jack studs 92. The members 36 immediately below the top plate 14 are on top of the top ends of the jack studs 92.

Figure 9A:
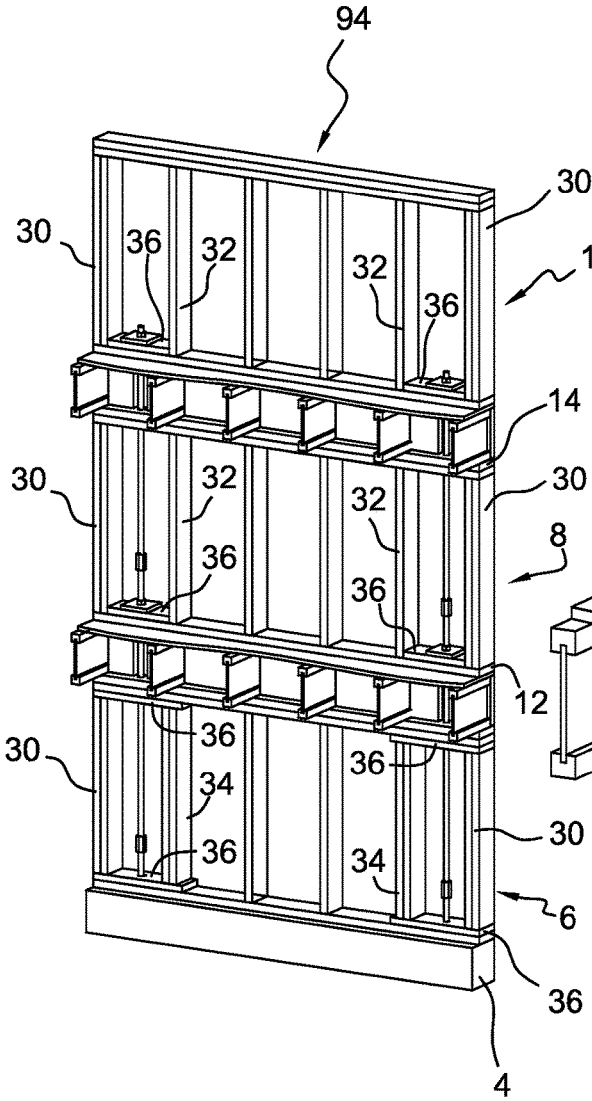
FIG. 9A is a perspective view of another embodiment of a reinforced shear wall.
Figure 9B:
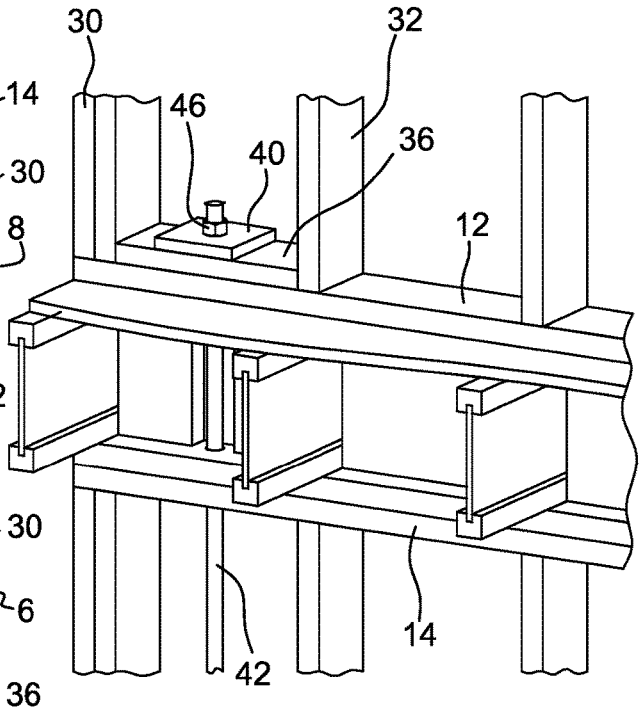
FIG. 9B is an enlarged perspective view of a portion of the shear wall of FIG. 9A.

Referring to FIGS. 9A and 9B, a shear stud-framed wall 94 is reinforced for tension forces. The members 36 in the intermediate floor wall 8 and the top floor wall 10 are completely within the stud bay, not supporting the outer studs 30 and the inner stud 32. However, the bottom floor wall 6 has the members 36 supporting the outer studs 30 and the inner studs 34 for compression loads. The loads exerted by the bearing plates 40 in resisting tension forces from uplift is advantageously spread out onto a greater area on the bottom plates 12, thereby providing the bottom plates with greater strength than if the members 36 were not used. Nuts 46 are used to initially tension the tie-rods 42 against the bearing plates 40.

Figure 10A:
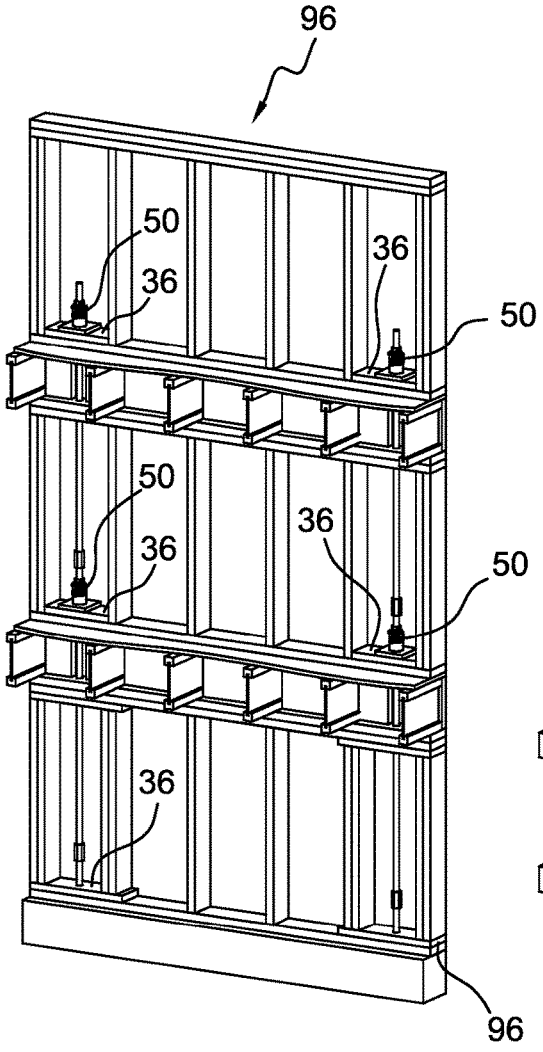
FIG. 10A is a perspective view of another embodiment of a reinforced shear wall.
Figure 10B:
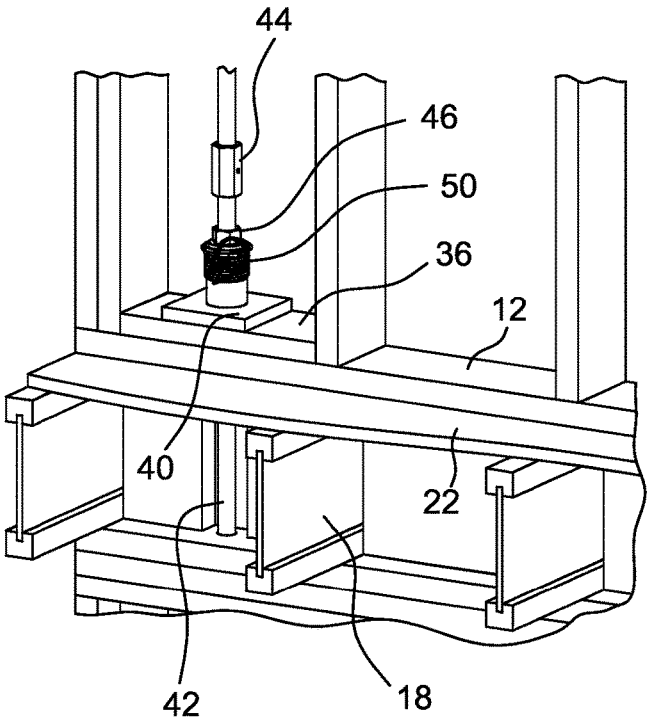
FIG. 10B is an enlarged perspective view of a portion of the shear wall of FIG. 10A.

Referring to FIGS. 10A and 10B, the shear wall 94 is modified as a shear wall 96 wherein the nuts 46 are replaced with the expandable fasteners 50.

Figure 11A:
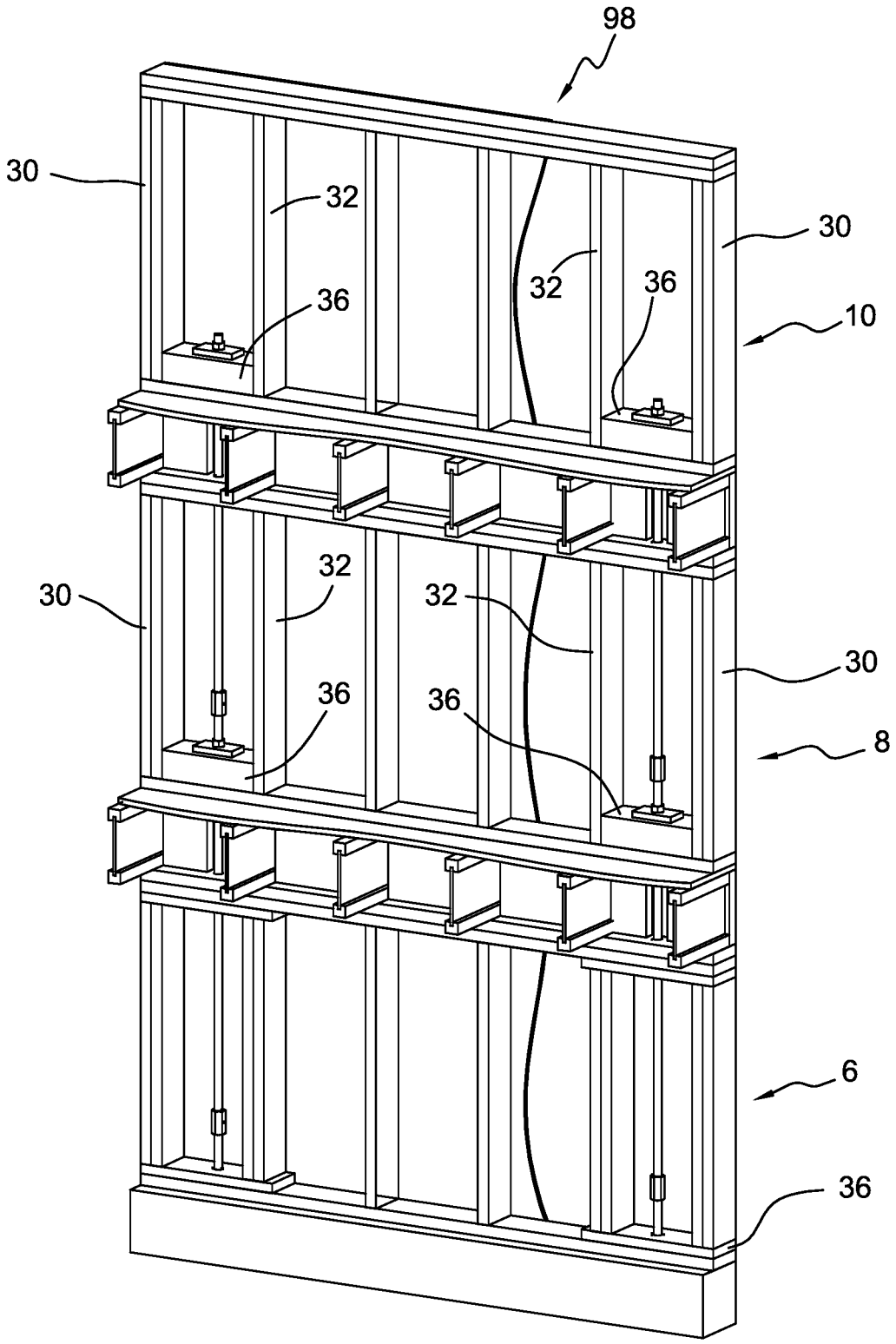
FIG. 11A is a perspective view of another embodiment of a reinforced shear wall.
Figure 11B:
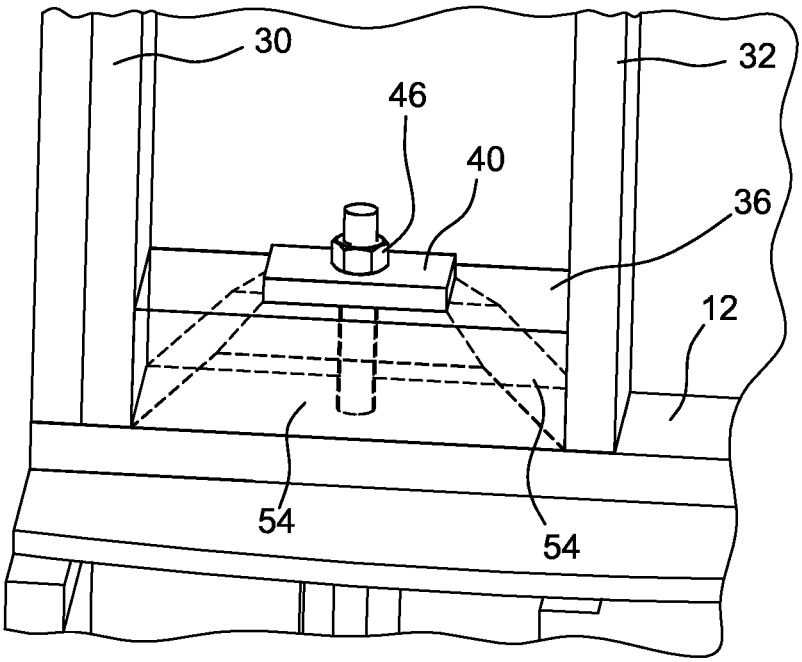
FIG. 11B is an enlarged perspective view of a portion of the shear wall of FIG. 11A.
Figure 11C:
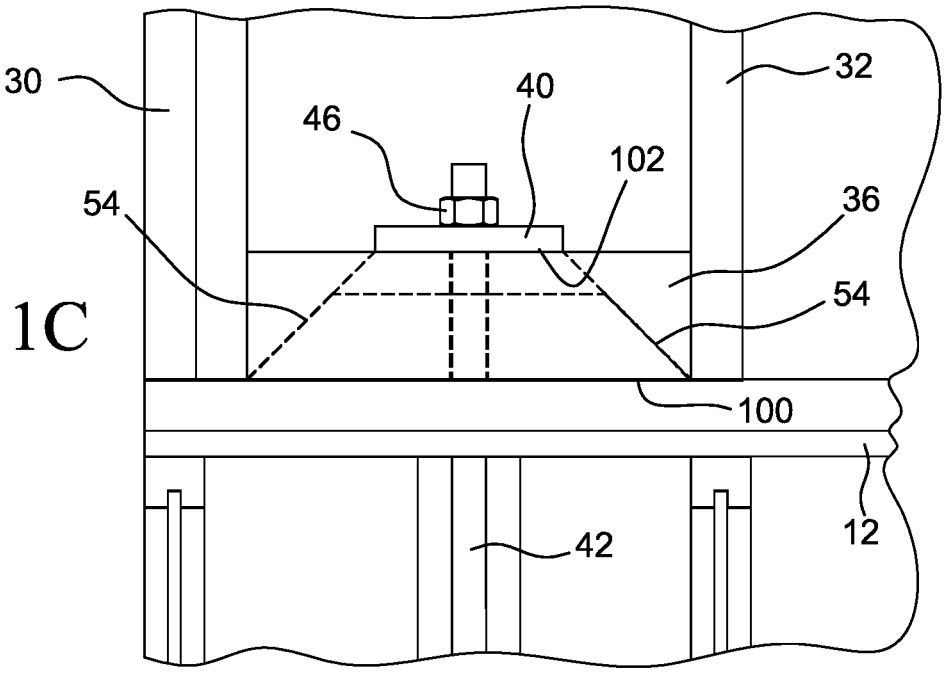
FIG. 11C is a side elevational view of FIG. 11B.

Referring to FIGS. 11A, 11B and 11C, the shear wall 96 is modified as a shear wall 98 wherein the members 36 in the intermediate floor wall 8 and the top floor wall 10 have larger thickness than those in the wall 96. The increased thickness of the members 36 allows the projected area 100 of the load onto the bottom plate 12 from the contact area 102 of the bearing plate 40 via the 45° planes 54 to be larger so as to occupy the entire surface of the bottom plate 12 between the studs 30 and 32. Increasing the thickness of the member 36 to project the load onto the larger area 100 advantageously allows a larger tension load at the bearing plate 40 to be distributed over the larger 100 so as not to overload the bottom plate 12.

Figure 12A:
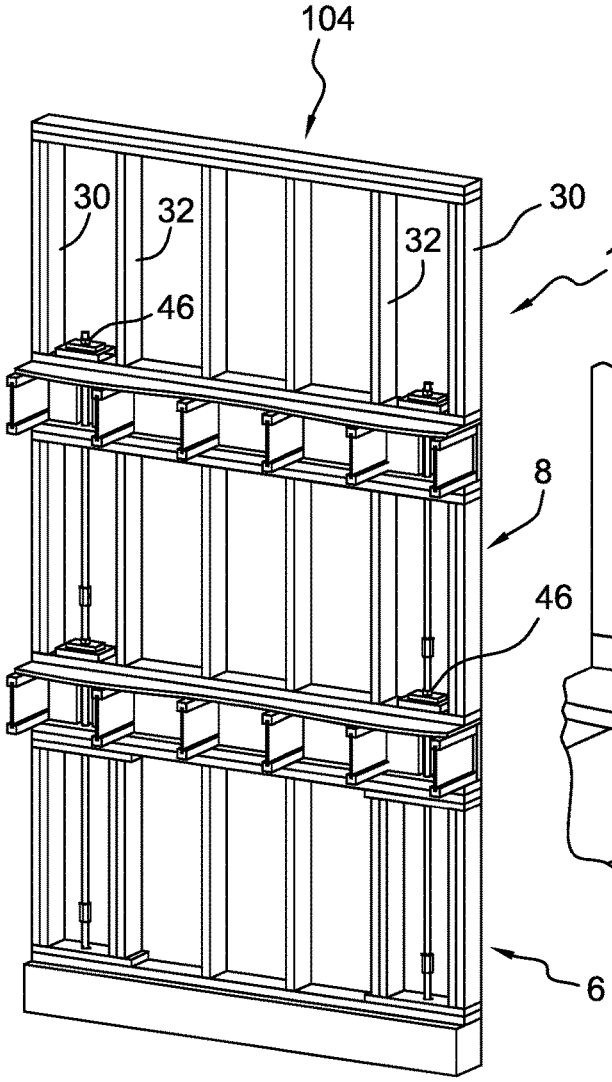
FIG. 12A is a perspective view of another embodiment of a reinforced shear wall.
Figure 12B:
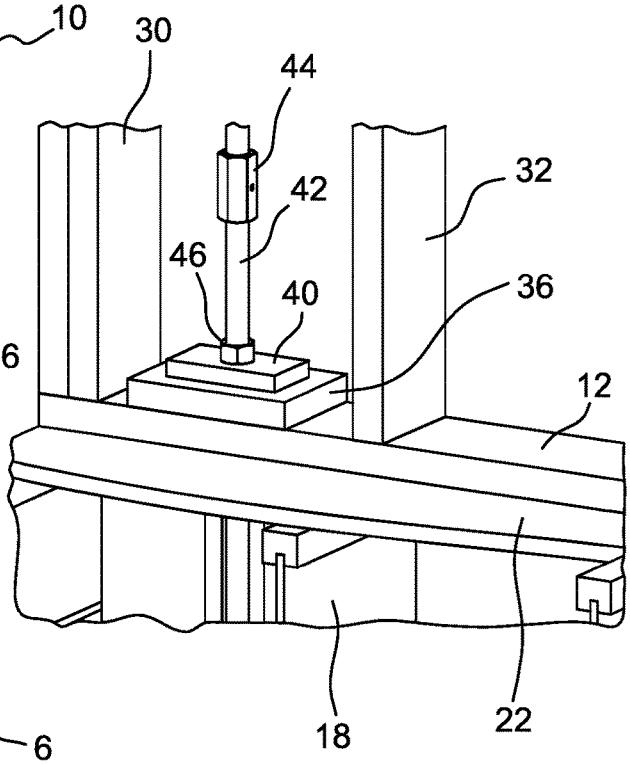
FIG. 12B is an enlarged perspective view of a portion of the shear wall of FIG. 12A.

Referring to FIGS. 12A and 12B, the shear wall 98 is modified as a shear wall 104 wherein the members 36 in the intermediate floor wall 8 and the top floor wall 10 are shortened. The tension forces expected for the wall 104 are lower so that a larger projected area on the bottom plate 12 is not needed to transfer the load from the bearing plate 40 to the bottom plate 12.

Figure 13A:
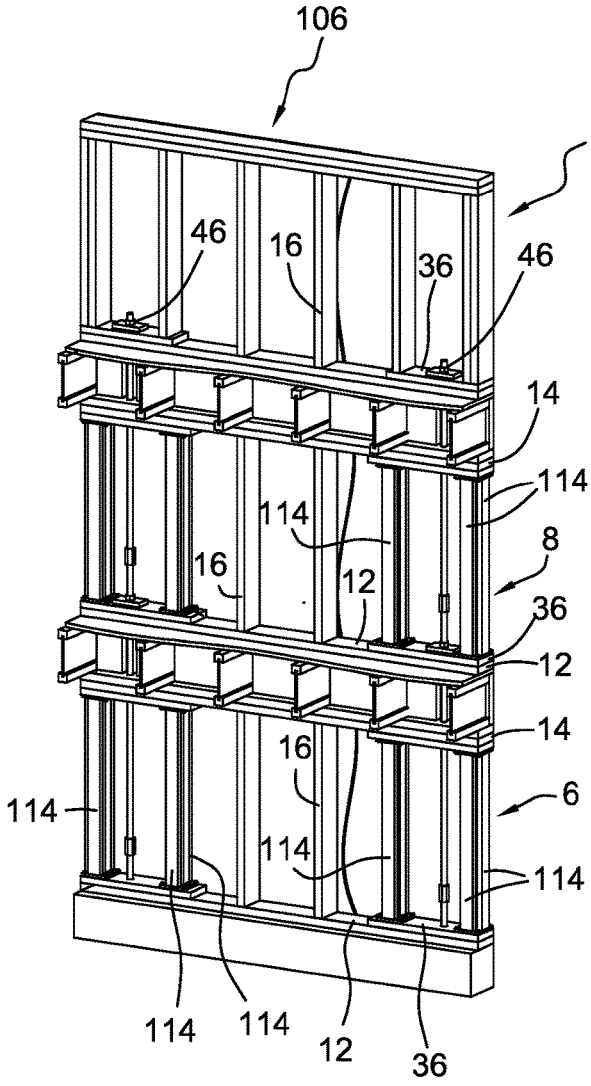
FIG. 13A is a perspective view of another embodiment of a reinforced shear wall.
Figure 13B:
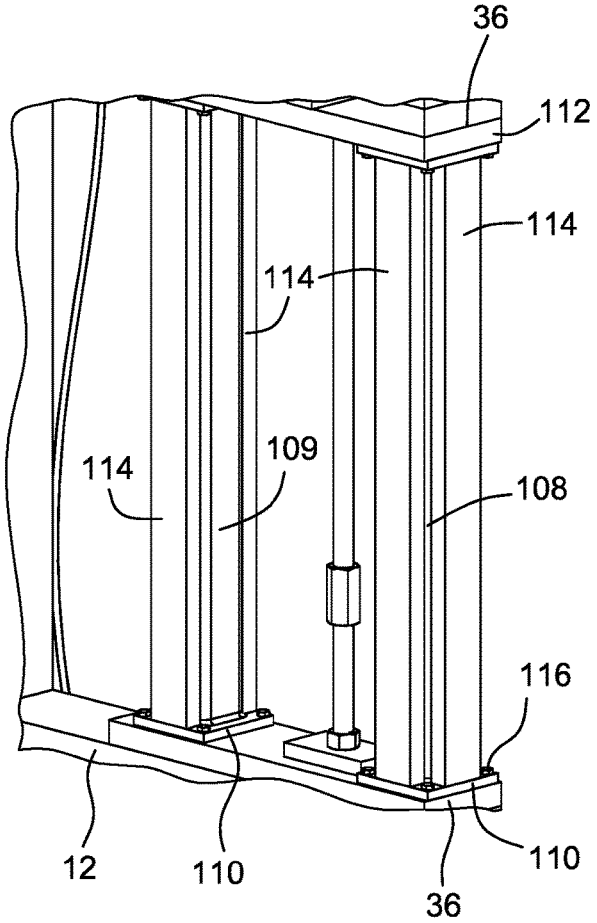
FIG. 13B is an enlarged perspective view of a portion of the shear wall of FIG. 13A.

Referring to FIGS. 13A and 13B, a shear wall 106 is disclosed using metal posts 108 and 109 with bottom and top flanges 110 and 112 at the bottom and top ends, respectively of the posts 108 and 109. The posts 108 and 109 are disposed in the bottom floor wall 6 and the intermediate floor wall 8 at the first stud bay in the end portions 26 and 28. The posts 108 and 109 preferably have flat sides. The bottom flanges 110 bear on the members 36 supported by the bottom plates 12. The top flanges 112 support the members 36 against the top plates 14. The loads on the flanges 110 and 112 are advantageously supported by the members 36 and spread out 45° onto a larger area on the bottom plates 12 and the top plates 14, as discussed above. Wood members 114 are disposed along the length of the posts 108 and 109 between the flanges 110 and 112. The ends of the wood members 114 directly engage the respective flanges 110 and 112 to advantageously transfer loads to the flanges 110 and 112 and to the members 36. The wood members 114 are smaller in thickness and width than the studs 16 to provide room at the corners of the flanges for attachment hardware 116, such as bolts, screws, nails, etc.

Figure 14:
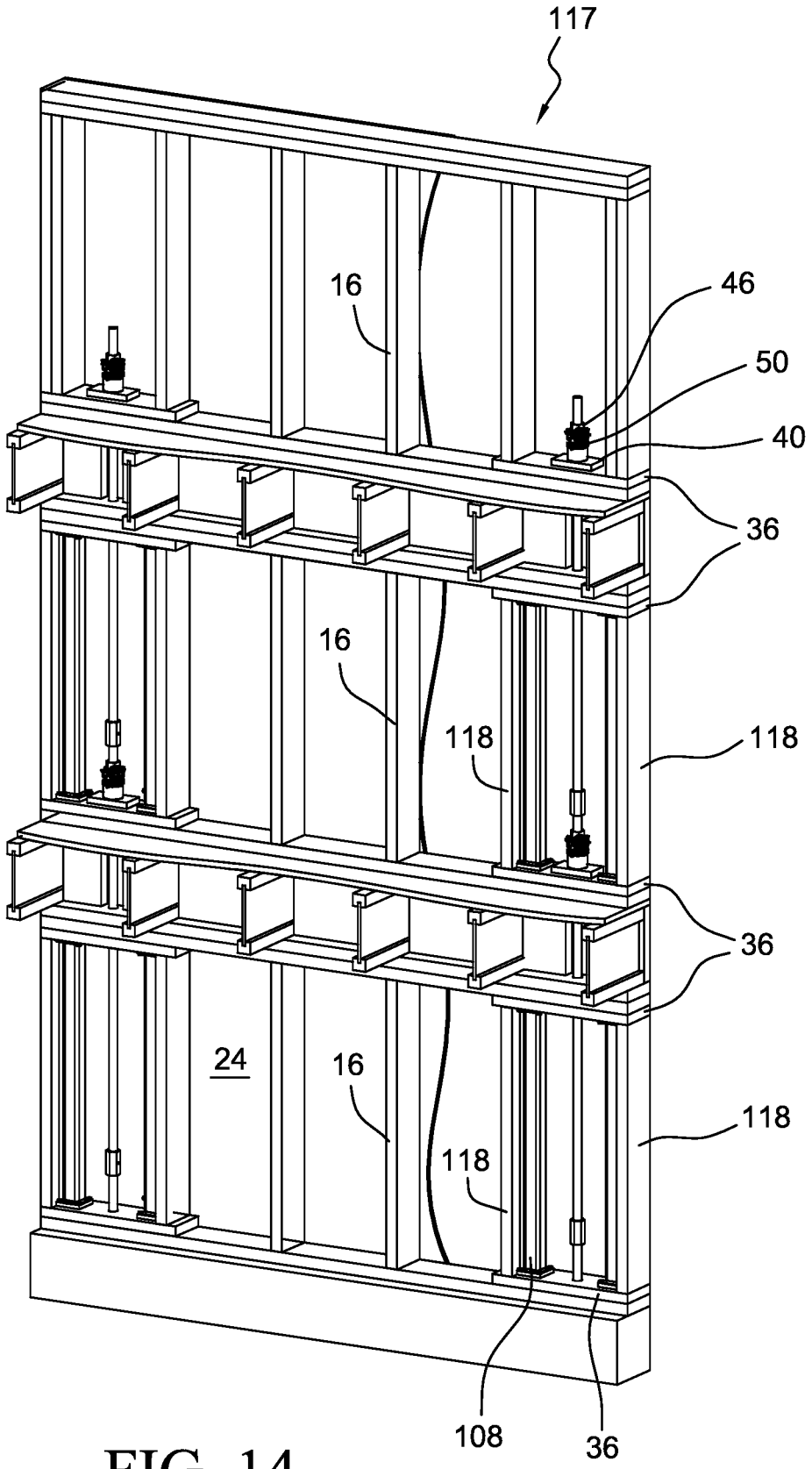
FIG. 14 is a perspective view of another embodiment of a reinforced shear wall.

Referring to FIG. 14, a wall 117 is a modification of the wall 106. The wood members 118 have the same cross-sectional dimensions as the studs 16. The bottom and top ends of the wood members 118 directly engage the members 36 for effective load transfer. Expandable fasteners 50 are added between the nuts 46 and the bearing plates 40.

Figure 15:
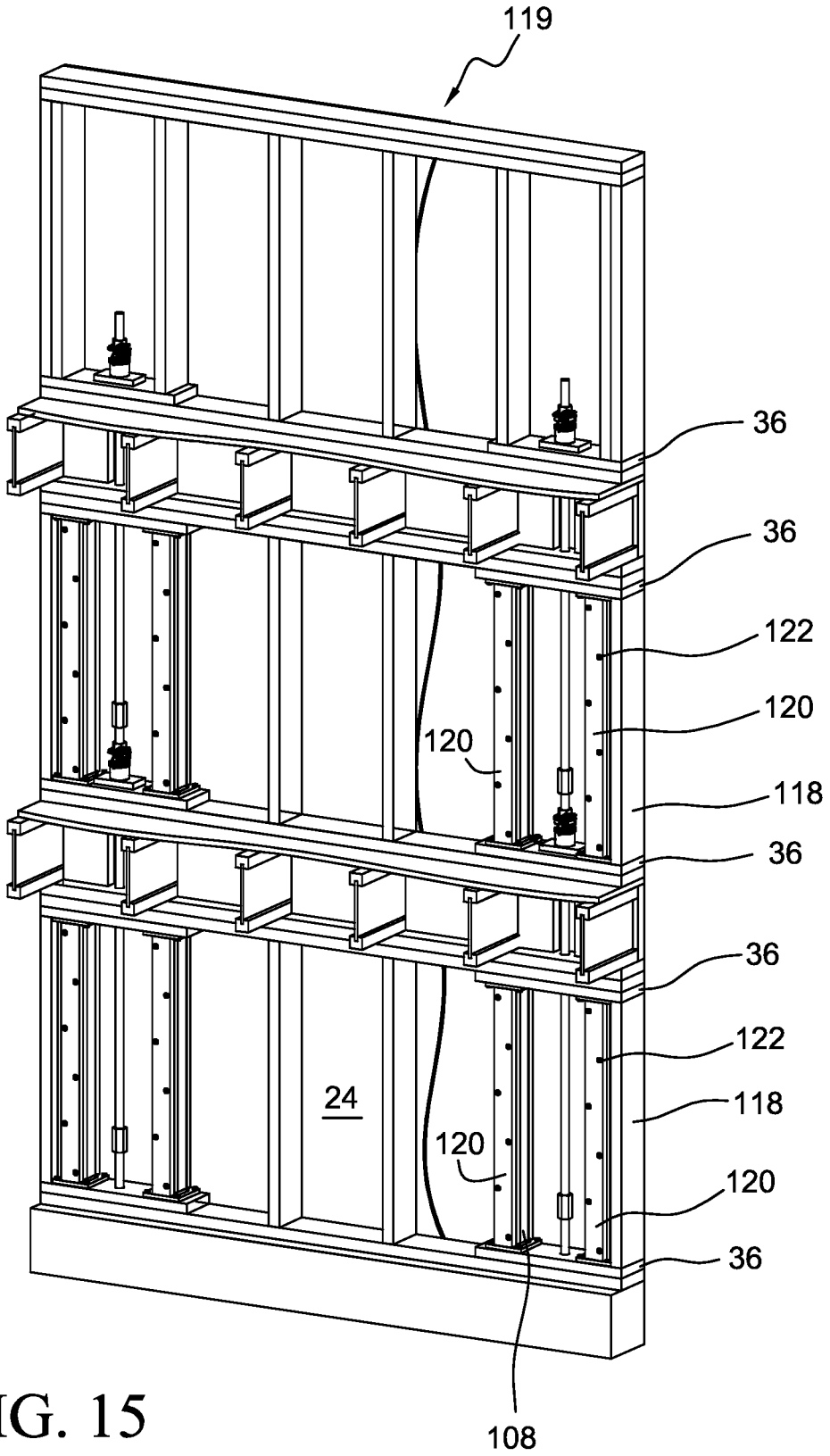
FIG. 15 is a perspective view of another embodiment of a reinforced shear wall.

Referring to FIG. 15, a wall 119 is similar to the wall 117 with modifications. The wood members 120 are bolted to the posts 108 and 109 with bolts 122. The sheathing 24 is attached to the wood members 120. Forces are transferred from the sheathing 24 to the wood members 120 and to the posts 108 and 109 via the bolts 122.

Figure 16:
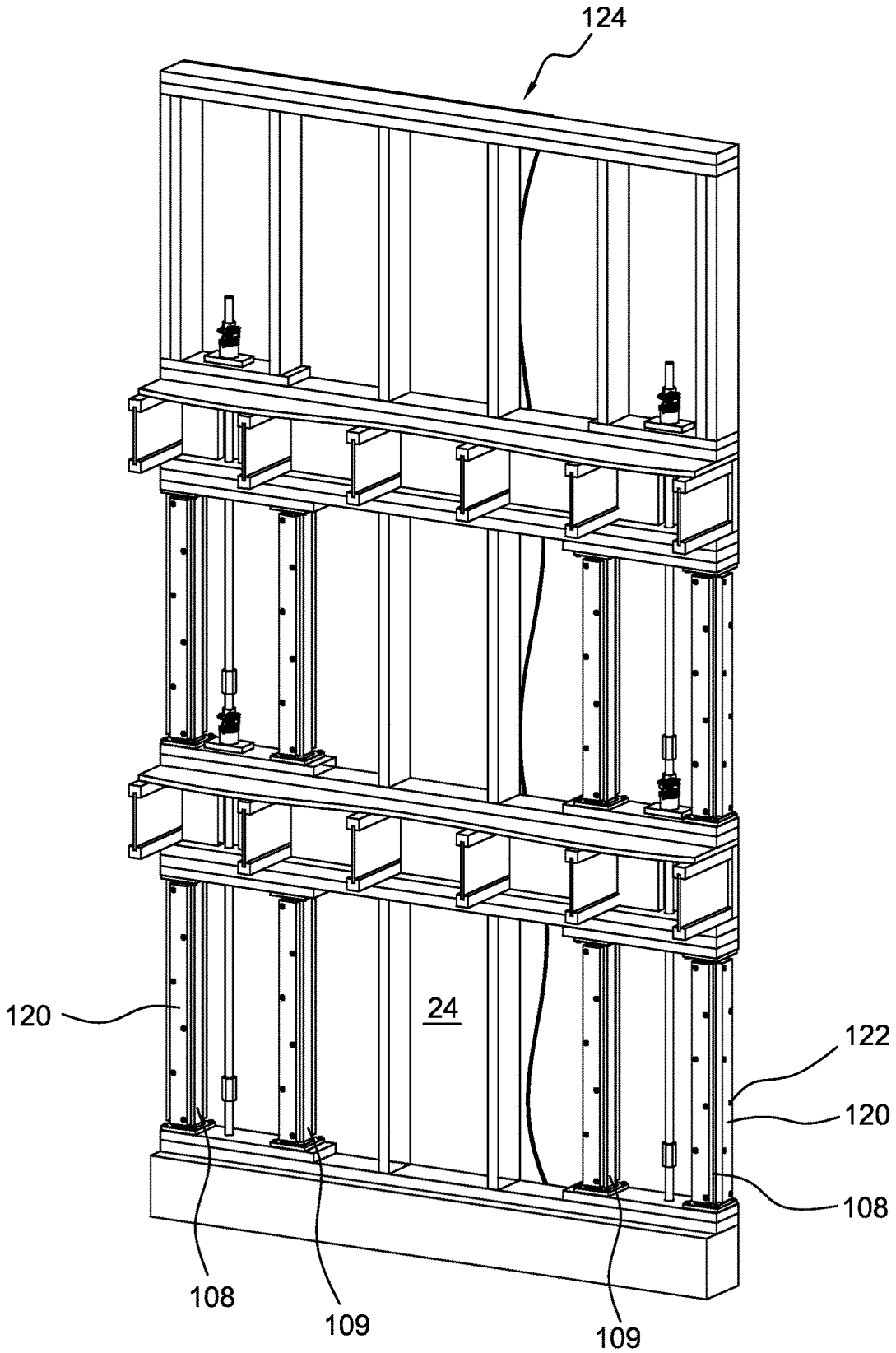
FIG. 16 is a perspective view of another embodiment of a reinforced shear wall.

Referring to FIG. 16, a wall 124 is similar to the wall 119 with modifications. The outer posts 108 are clad with wood members 120 on three sides and bolted to the posts 108 with bolts 122. The sheathing 24 is attached to the wood members 120. Forces are transferred from the sheathing 24 to the wood members 120 and to the posts 108 and 109 via the bolts.

Figure 17:
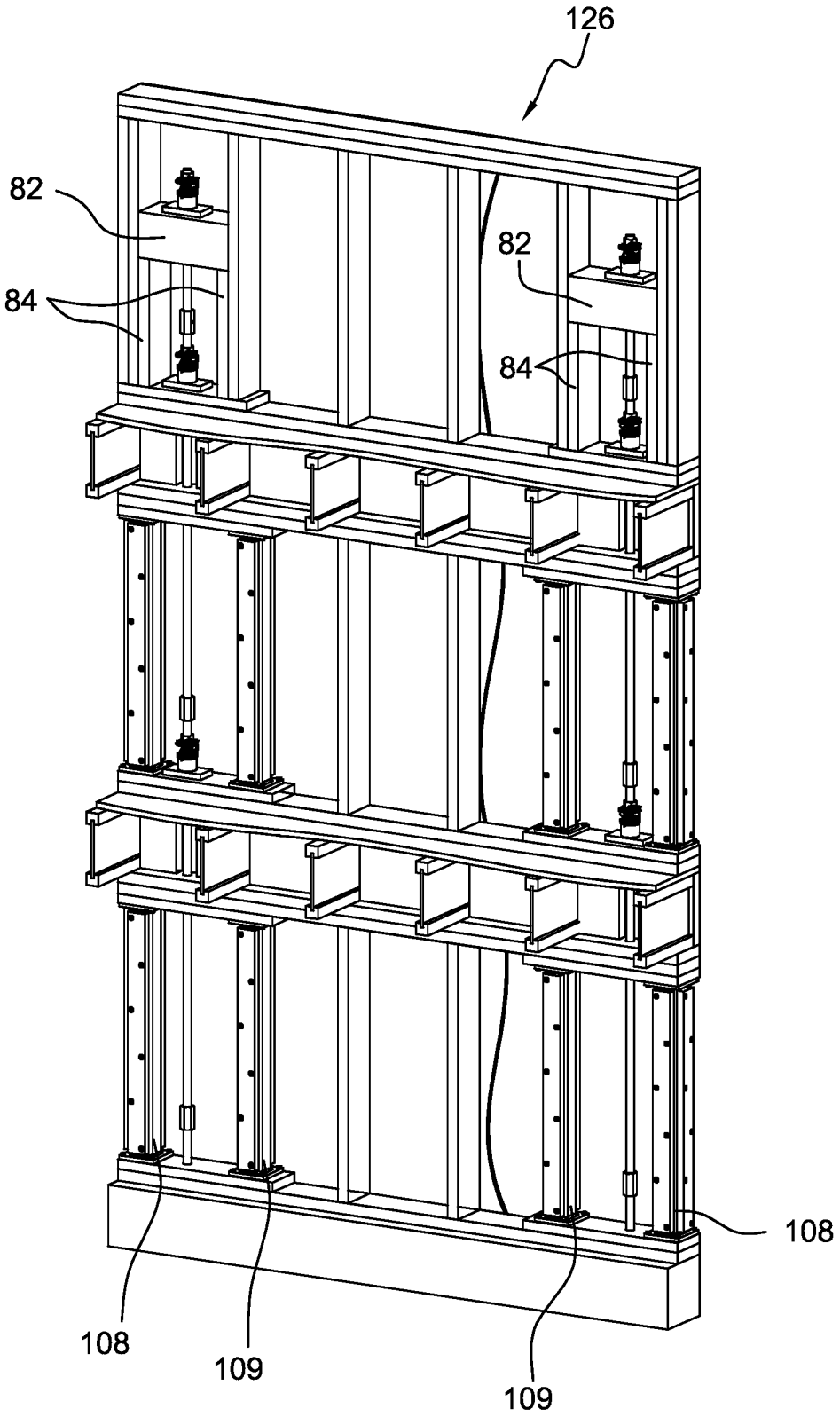
FIG. 17 is a perspective view of another embodiment of a reinforced shear wall.

Referring to FIG. 17, a wall 126 is similar to the wall 124 with modifications. Bridge members 82 are added with jack studs 84.

Figure 18A:
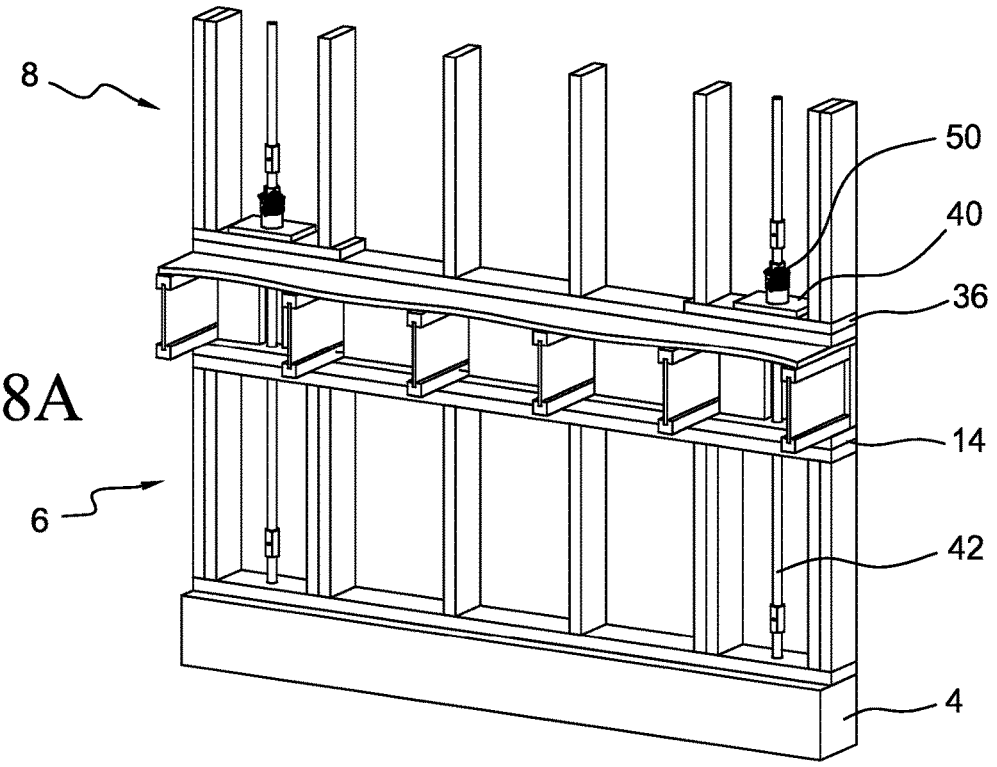
FIGS. 18A and 18B are perspective partial views of a reinforced shear wall.

Referring to FIG. 18A, the bottom floor wall 6 does not use the members 36 as in the wall 2 shown in FIG. 1, for example. The members 36 are used in the intermediate floor wall 8 as in the wall 49 shown in FIG. 2. The rest of the wall may take on the embodiment of any of the walls disclosed herein.

Figure 18B:
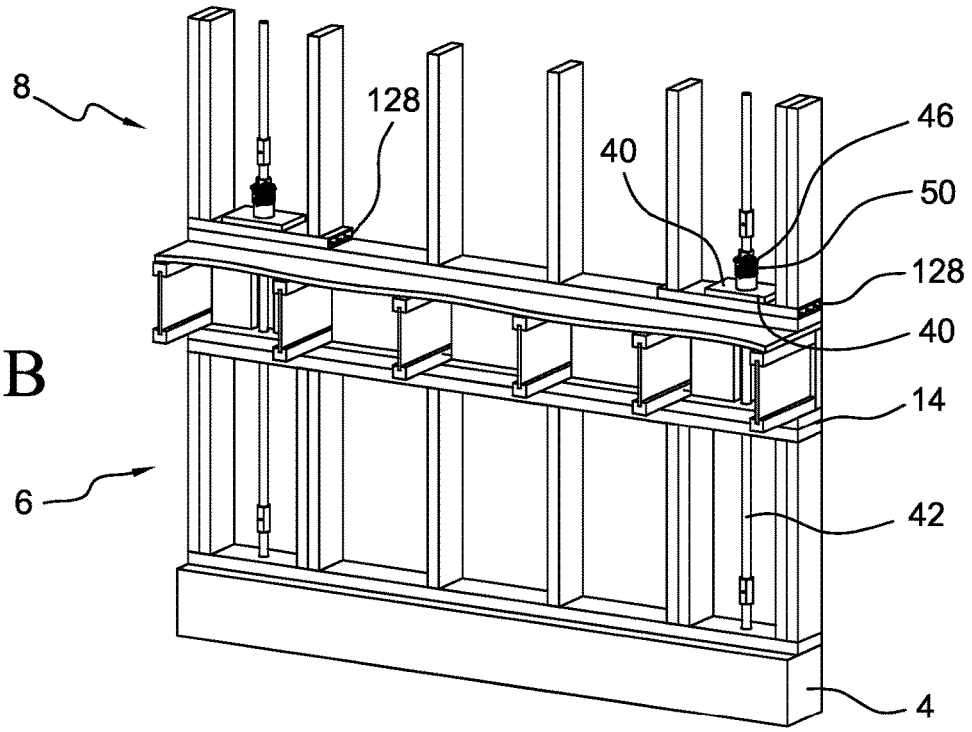

Referring to FIG. 18B, the members 36 shown in FIG. 18A are replaced with hollow metal plates 128, as disclosed in U.S. Pat. No. 9,097,000, incorporated herein by reference. Expandable fasteners 50 with nuts 46 tighten the tie-rod 42 against the bearing plates 40. The hollow metal plate 128 may be used wherever the members 36 are used. The rest of the wall may take on the embodiment of any of the walls disclosed herein.

Figure 19A:
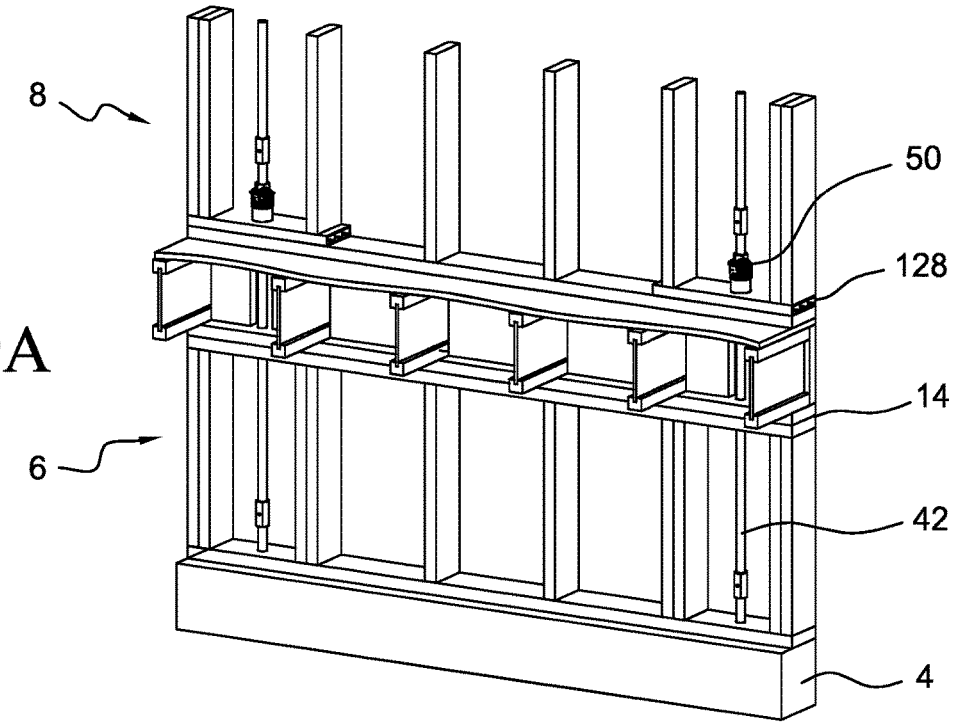
FIGS. 19A and 19B are perspective partial views of a reinforced shear wall.

Referring to FIG. 19A, the bearing plates 40 shown in FIG. 18B may be dispensed with since the hollow metal plates 128 provide their own bearing plate function. Expandable fasteners 50 with nuts 46 tighten the tie-rod 42 against the solid metal plates 130. The rest of the wall may take on the embodiment of any of the walls disclosed herein.

Figure 19B:
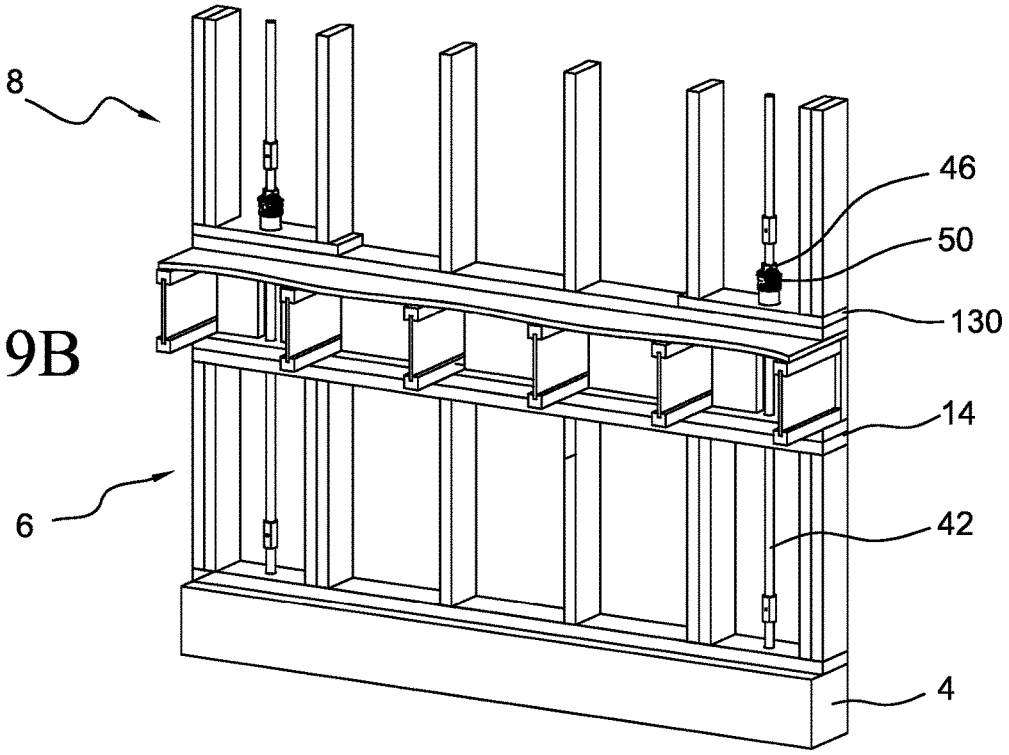

Referring to FIG. 19B, the members 36 in any of the walls disclosed above may be replaced with solid metal plates 130. The bearing plates 40 are not used since the solid metal plates 130 provide the bearing plate function. Expandable fasteners 50 with nuts 46 tighten the tie-rod 42 against the solid metal plates 130. The rest of the wall may take on the embodiment of any of the walls disclosed herein.

Figure 20A:
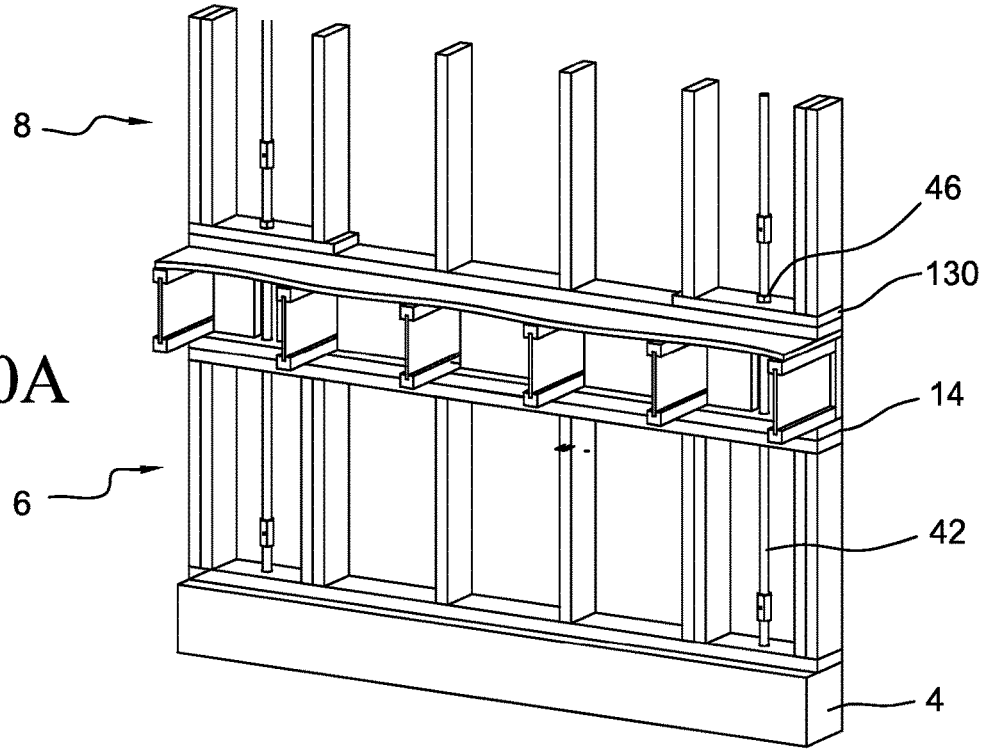
FIG. 20A is a perspective partial view of another embodiment of a reinforced shear wall.

Referring to FIG. 20A, nuts 46 are used to tighten the tie-rod 42 against the solid metal plates 130 without the use of the expandable fasteners 50 as shown in FIG. 19B.

Figure 20B:
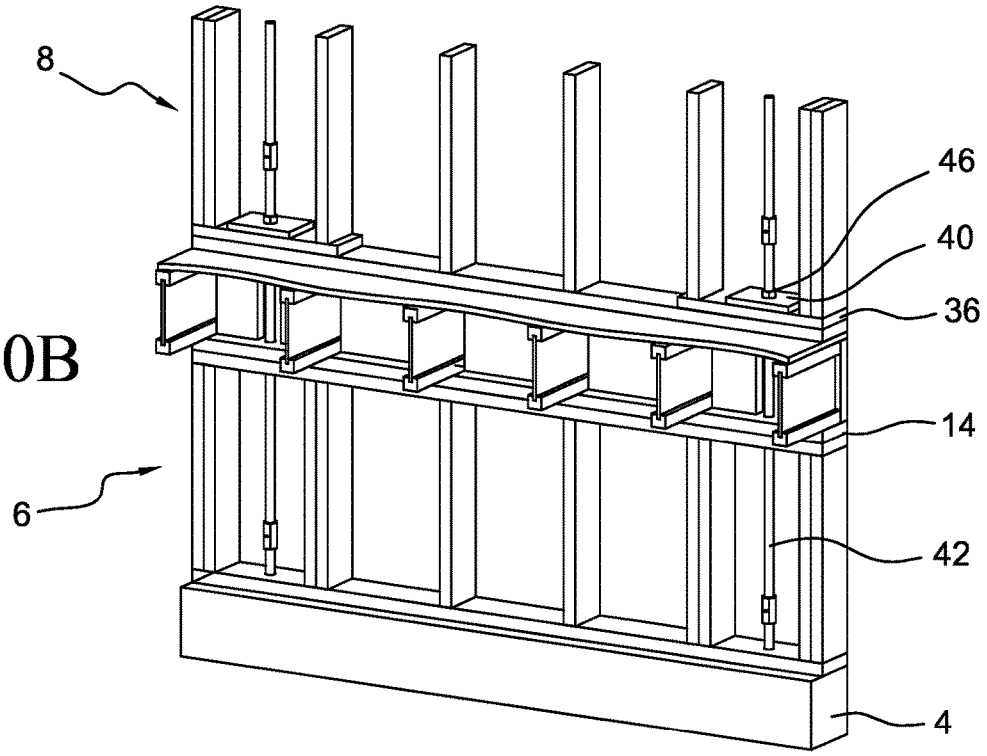
FIG. 20B is a perspective partial view of another embodiment of a reinforced shear wall.

Referring to FIG. 20B, nuts 46 are used to tighten the tie-rod 42 against the members 36 instead of the expandable fasteners 50 as shown in FIG. 18A.

Figure 21A:
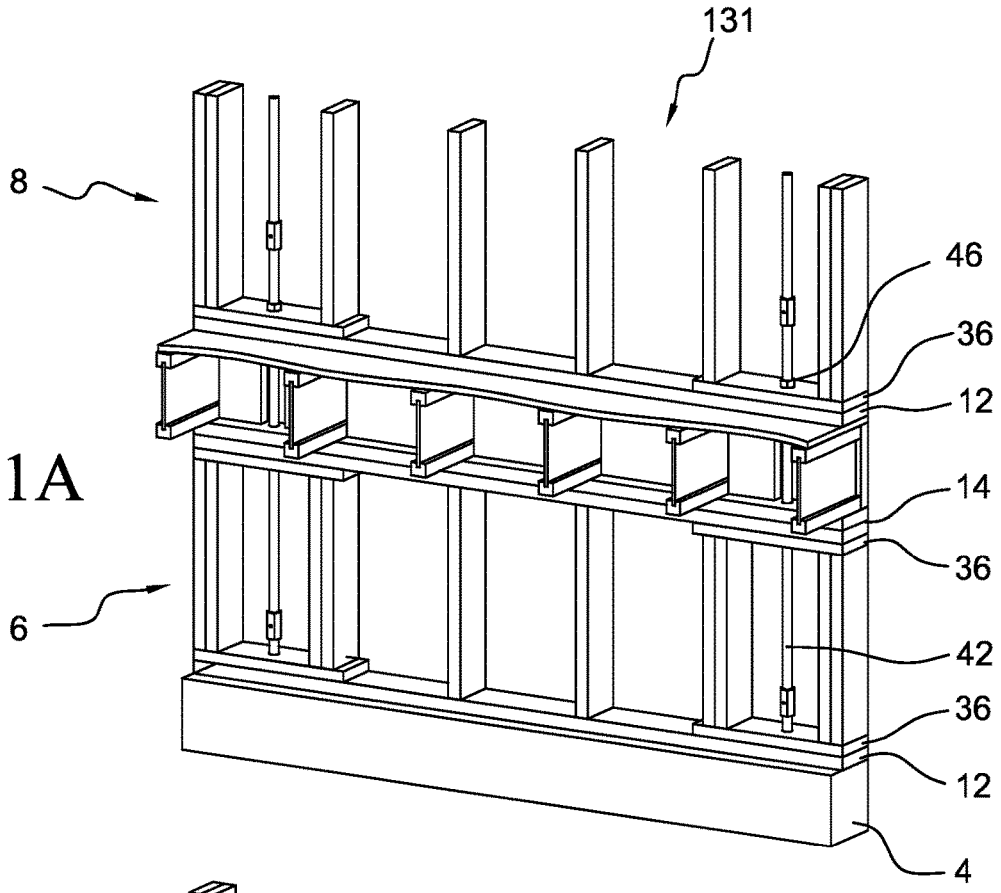
FIGS. 21A-21C are perspective partial views of other embodiments of a reinforced shear wall.

Referring to FIG. 21A, a reinforced shear wall 131 for compression loads only is disclosed. The members 36 are positioned in the bottom floor wall 6 and intermediate or upper floor wall 8 as in the wall 2 shown in FIG. 1. Nails, screws, glue, etc. may be used to attach the members 36 to the bottom plates 12 or the top plates 14. The nuts 46 may also be used.

Figure 21B:
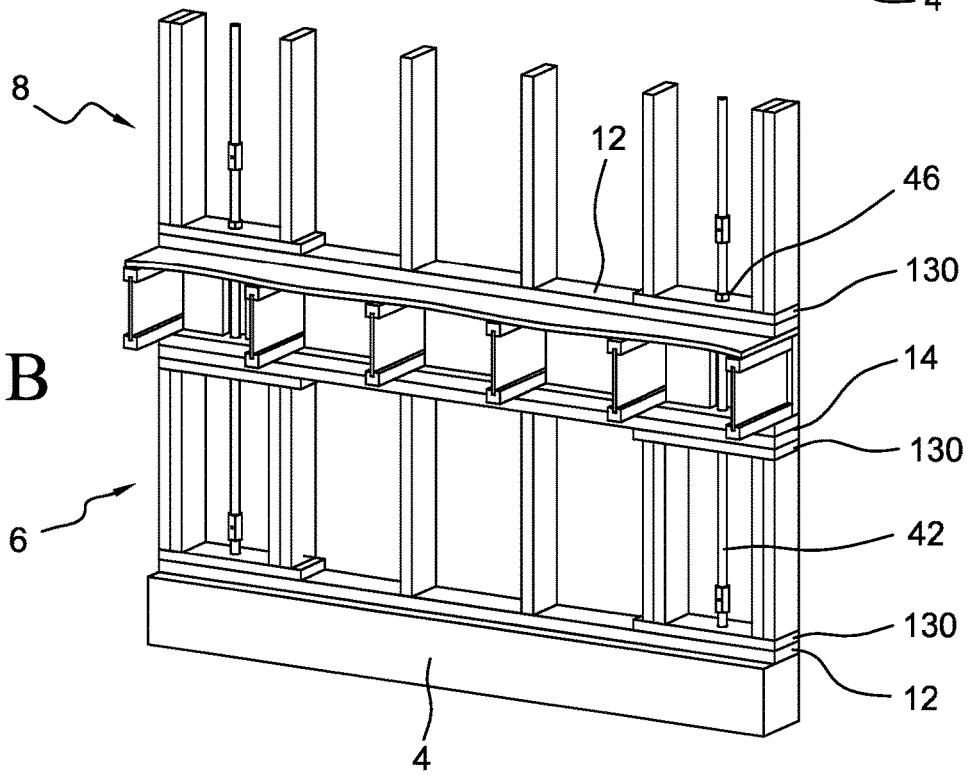

Referring to FIG. 21B, the wall 131 is modified wherein the members 36 are replaced with the solid metal plates 130, which are attached to the tie-rods 42 with the nuts 46 without the use of the bearing plates 40, since the solid metal plate 130 double as the bearing plates. The solid metal plates 130 are used for compression and tension loads.

Figure 21C:
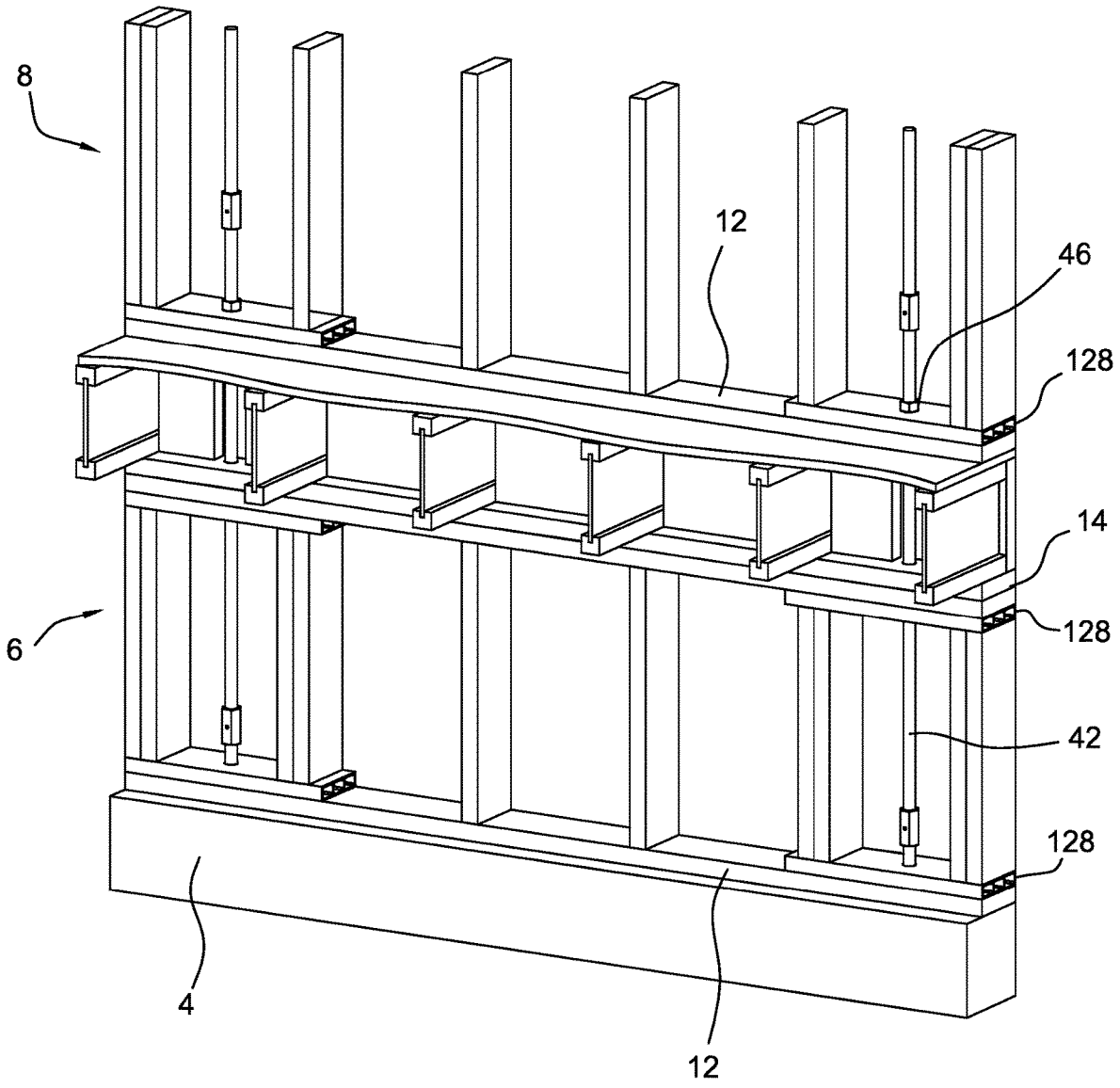

Referring to FIG. 21C, the wall 131 of FIG. 21A is modified to replace the members 36 with the hollow metal plates 128, which may be attached to the bottom plates 12 with the nuts 46. Screws (not shown) may also be used to secure the hollow metal plates 128 to the bottom plates 12 or to the top plates 14. Without the bearing plates 40, the hollow metal plates 128 are used for compression loads only.

When the member 36, the hollow metal plate 128 or the solid metal plate 130 are used full length across the shear wall, from one end of the wall to the other end, the bottom plate 12 or one of the members of the double top plate 14 may be dispensed with.

Figure 22B:
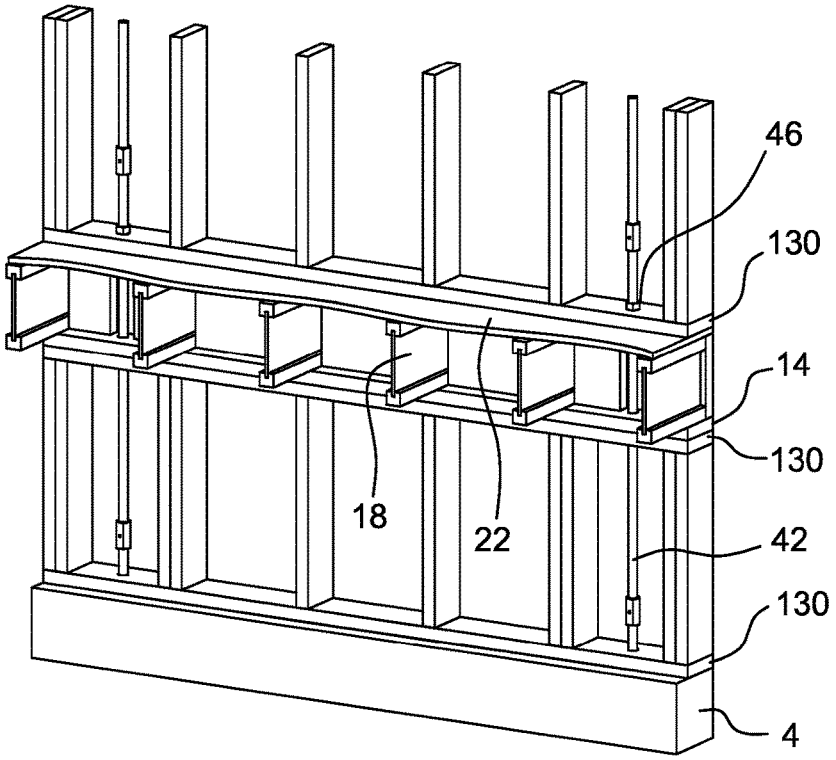
FIGS. 22A-22F are perspective partial views of other embodiments of a reinforced shear wall.
Figure 22A:
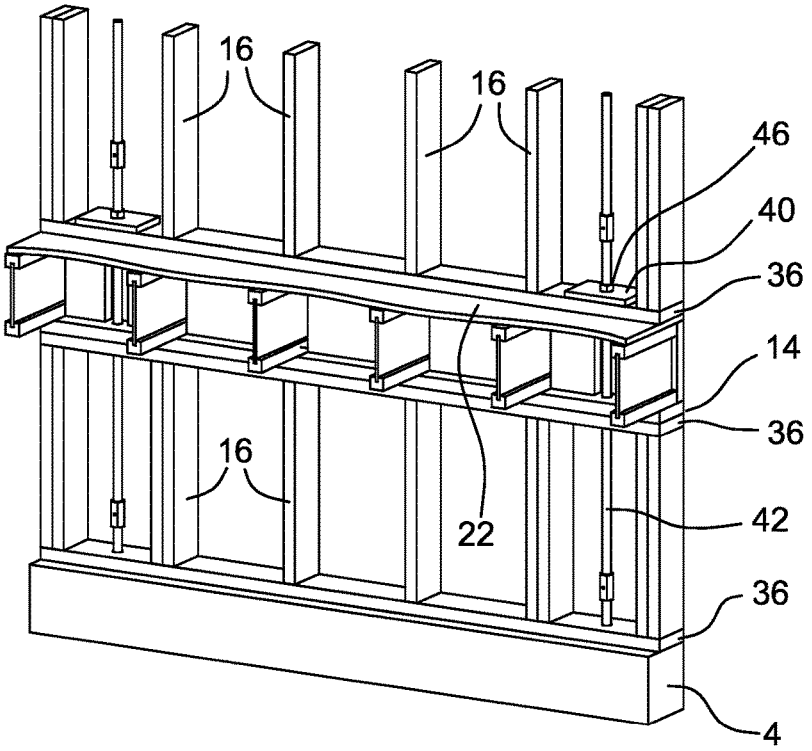

Referring to FIG. 22A, the members 36 extend from one end of the wall to the other end. The typical bottom plate 12 is not used. The members 36 function as the bottom plate and replace one member of the double top plate 14. Due to high compression strength of the members 36 as compared to the bottom plates of sawn lumber, the loads carried by the studs 16 are safely transmitted by the members 36 to the foundation 4. The nuts 46 and the bearing plates 40 transfer the tension loads to the tie-rods 42 down to the foundation. The compression loads from the studs 16 are safely transferred to the subfloor 22 via the members 36 and down to the other studs below and the foundation 4.

Referring to FIG. 22B, the members 36 shown in FIG. 22A are replaced with the solid metal plates 130, extend from one end of the wall to the other end. The typical bottom plates 12 are not used. The solid metal plates 130 function as the bottom plate and replace one member of the double top plate 14. Due to the high compression strength of the solid metal plates 130 as compared to bottom plates of sawn lumber, the loads carried by the studs 16 are safely transmitted by the solid metal plates 130 to the plywood subfloor 22. The nuts 46 transfer the tension loads to the tie-rods 42 down to the foundation. The bearing plates 40 shown in the other embodiments are not used since the solid metal plates 130 also function as the bearing plates. The compression loads from the studs 16 are safely transferred to the subfloor 22 via the solid metal plates 130 and down to the other studs below and the foundation 4.

Figure 22C:
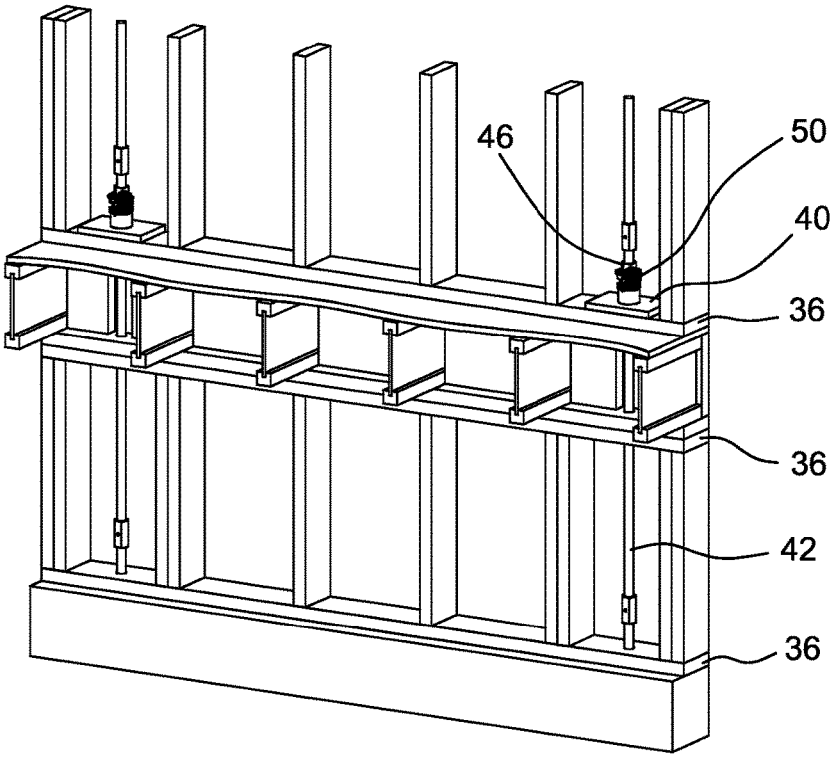

Referring to FIG. 22C, expandable fasteners 50 are used between the nuts 46 and the bearing plates 40 of FIG. 22A.

Figure 22D:
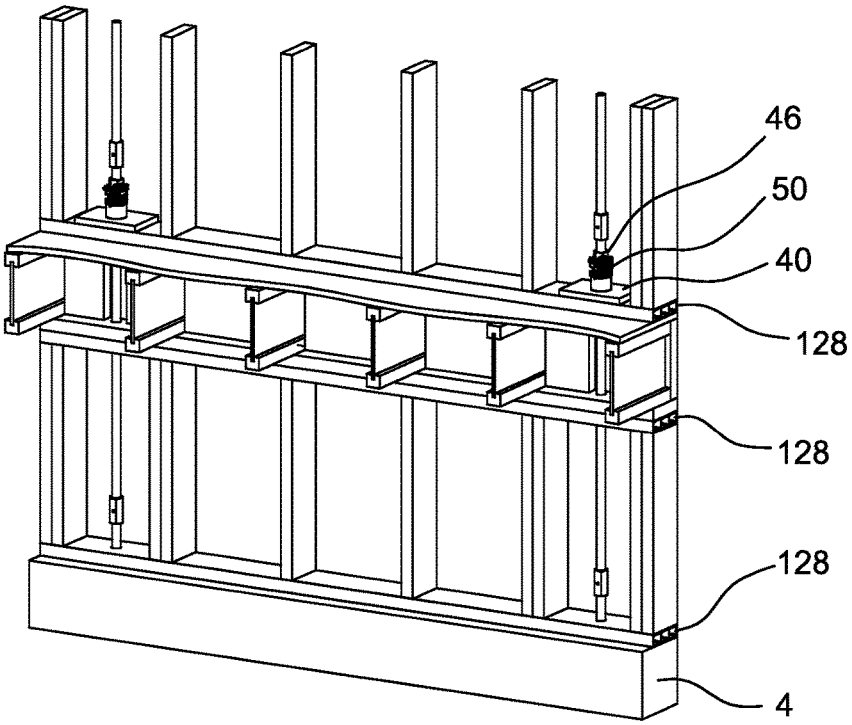

Referring to FIG. 22D, the members 36 shown in FIG. 22C are replaced with the hollow metal plates 128 that extend from one end of the wall to the other end. The hollow metal plates 128 provide the same function as the members 36.

Figure 22E:
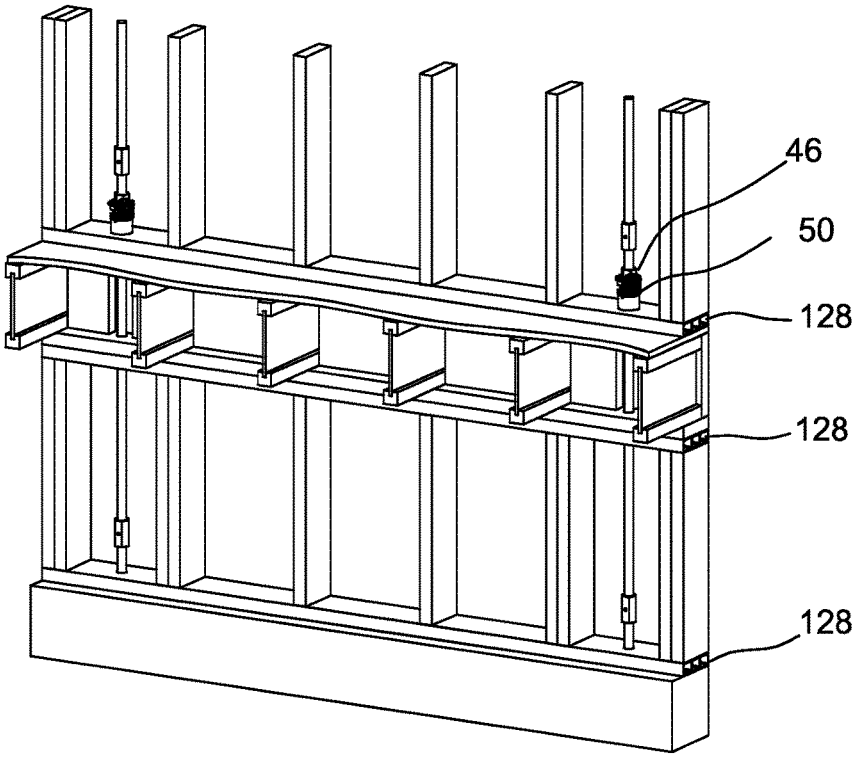

Referring to FIG. 22E, the expandable fasteners 50 are used directly with the hollow metal plates 128 without using the bearing plates 40 shown in FIG. 22D. The bottom edge of the expandable fasteners 50 provides sufficient contact area with the hollow metal plates 128.

Figure 22F:
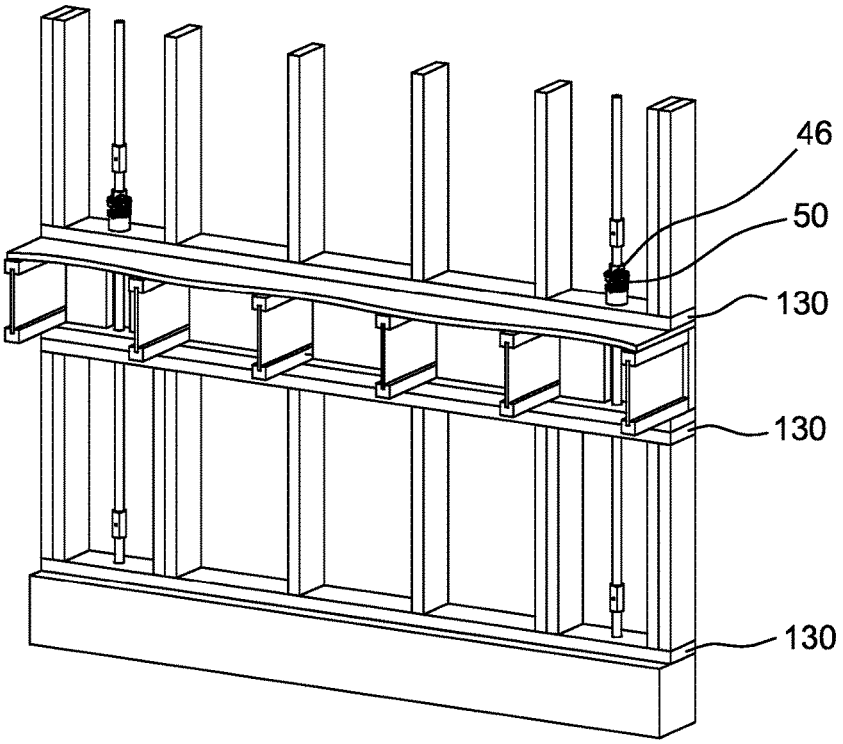

Referring to FIG. 22F, the expandable fasteners 50 are used directly with the solid metal plates 130 without using the bearing plates 40 shown in FIG. 22D. The bottom edge of the expandable fasteners 50 provides sufficient contact area with the solid metal plates 130.

It should be understood that although the top plates 14 shown in FIGS. 22A-22F are double (two pieces) top plates, the top plates 14 may also be a single piece top plate, consisting only of the member 36, the solid metal plate 130 or the hollow metal plate 128. See FIG. 25 for a single top plate in a wall.

Figure 23:
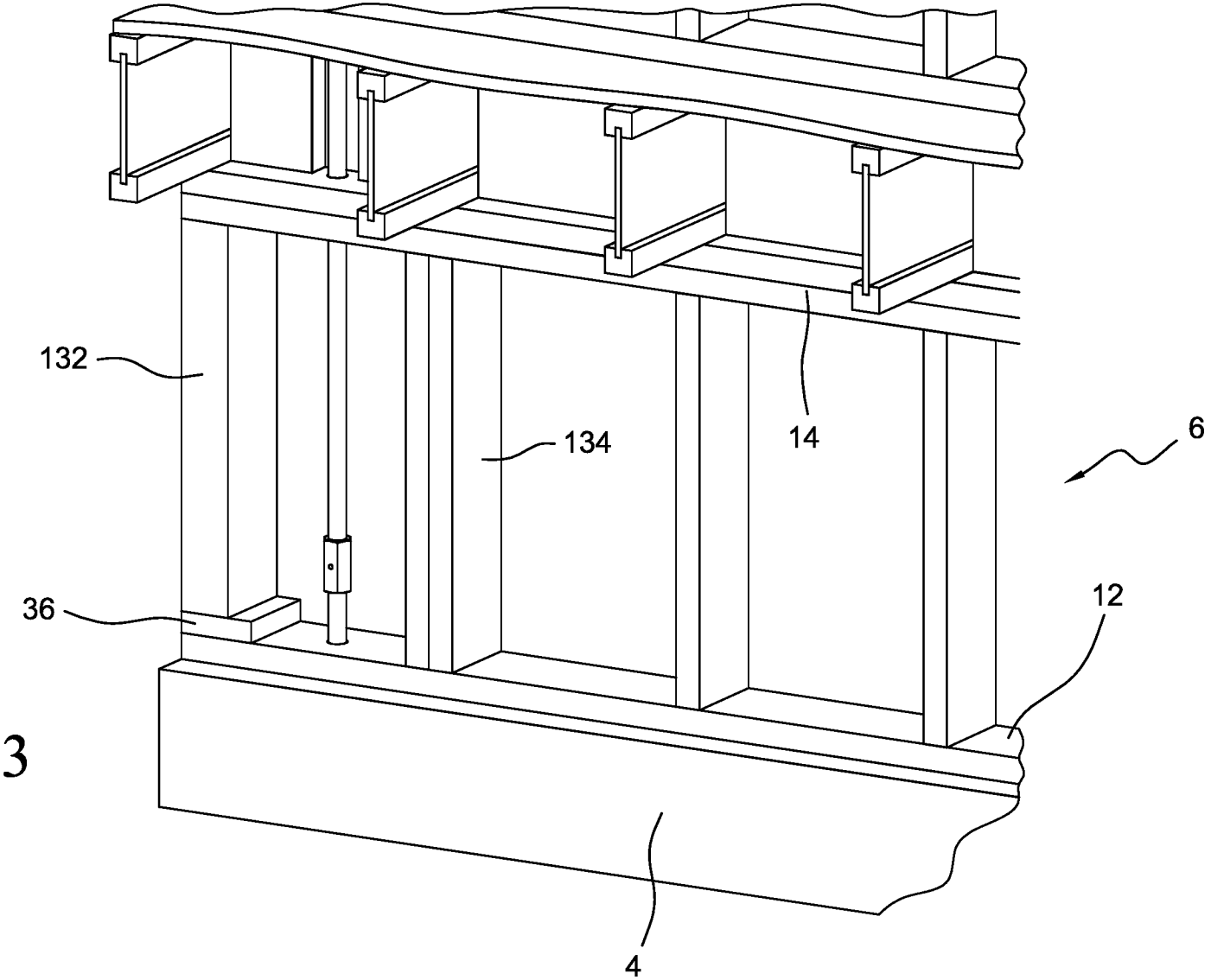
FIG. 23 is a perspective partial view of another embodiment of a reinforced shear wall.

Referring to FIG. 23, a solid wood post 132 is used for the double outer studs 30 in a bottom floor wall 6. A short member 36 may be placed only underneath the wood post 132 to distribute the load onto the bottom plate 12. The double studs 134 bear directly on the bottom plate 12, utilizing the combined contact area of the bottom ends of the double studs 134 to transfer load to the bottom plate 12.

Figure 24:
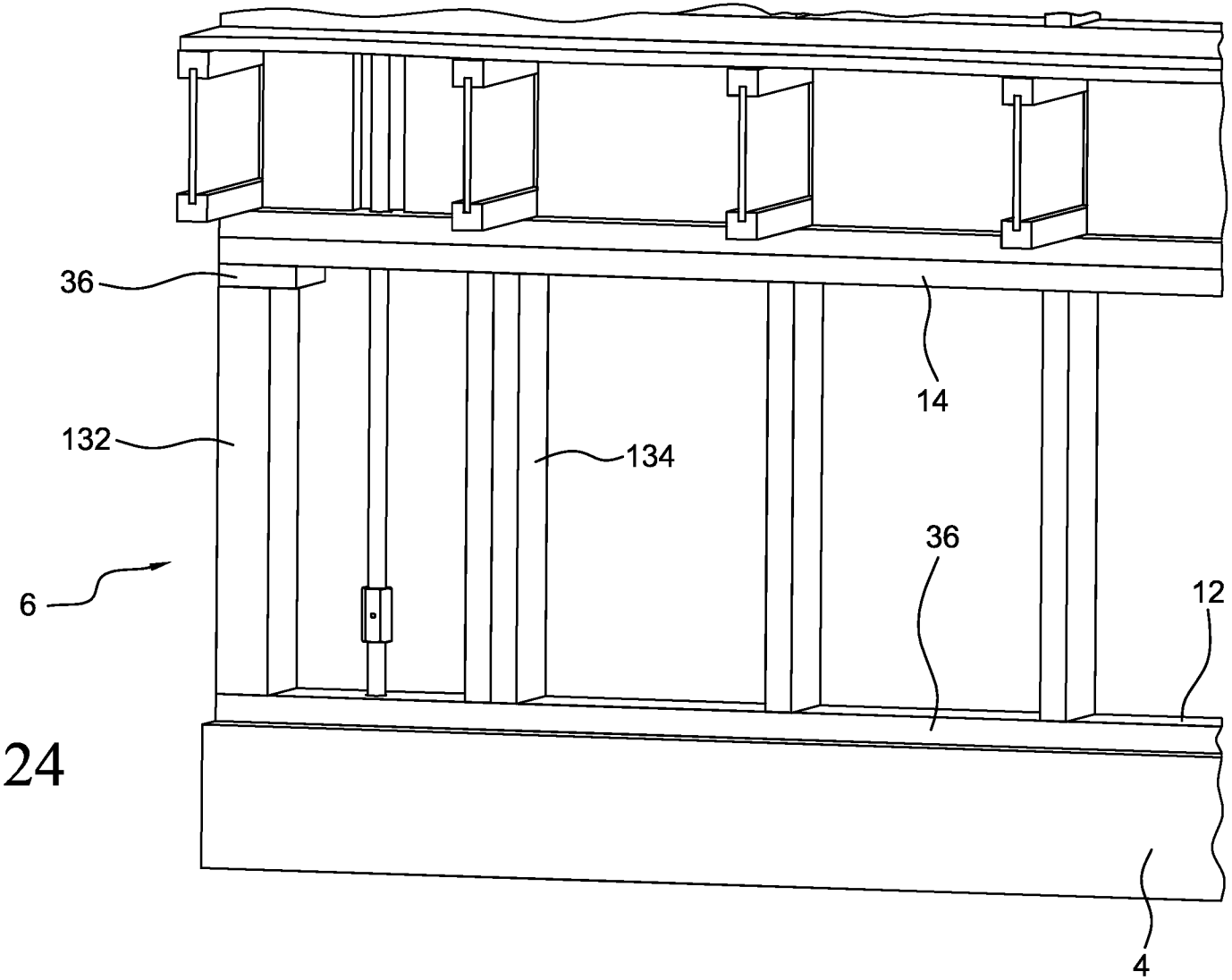
FIG. 24 is a perspective partial view of another embodiment of a reinforced shear wall.

Referring to FIG. 24, the bottom plate 12 is replaced with the member 36 that extends from one end of the wall to the other end, as shown in FIG. 22C. Short members 36 are placed between the top end of the wood post 132 and the top plate 14 to safely distribute the load onto the top plate 14.

Figure 25:
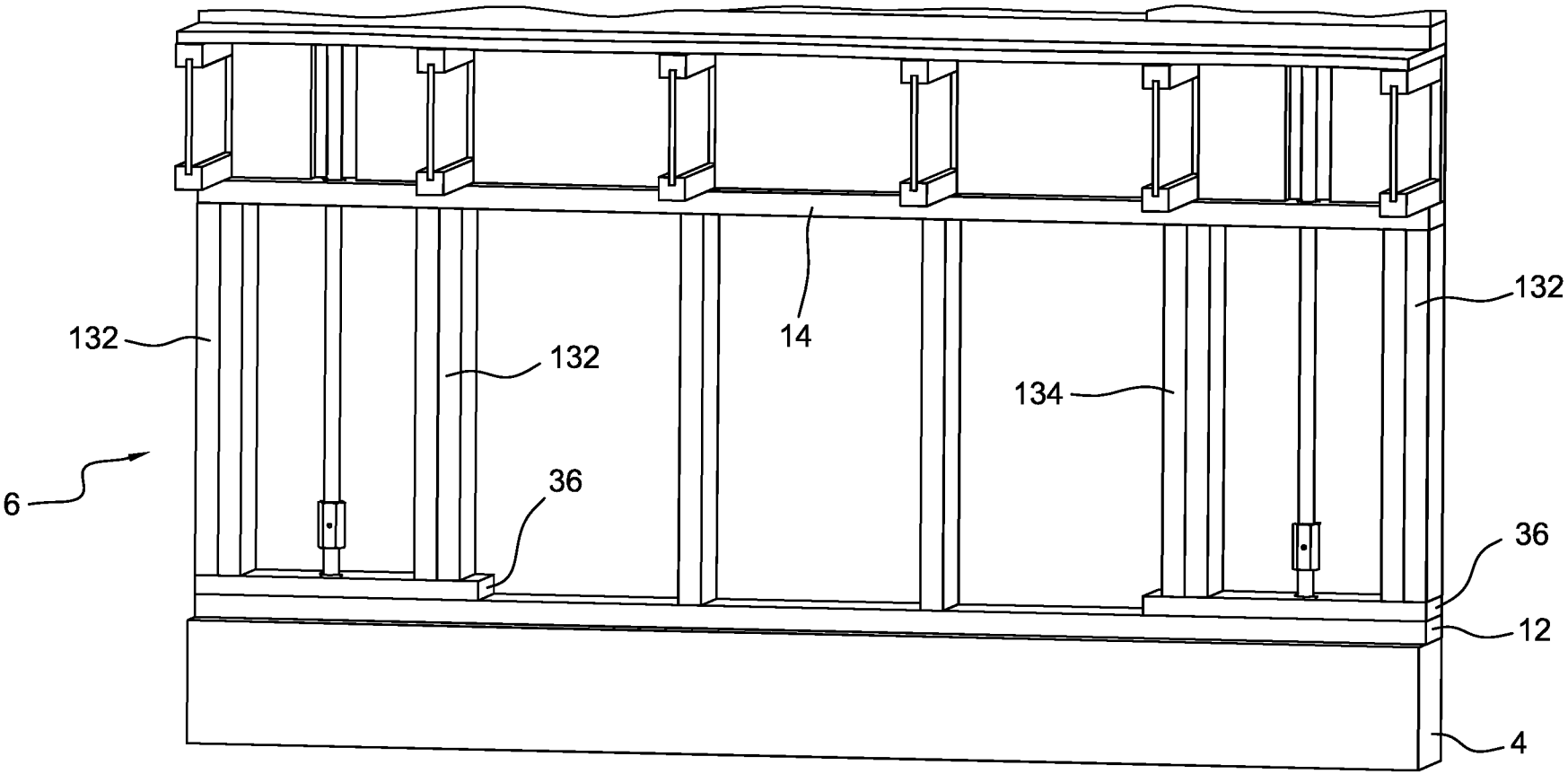
FIG. 25 is a perspective partial view of another embodiment of a reinforced shear wall.

Referring to FIG. 25, the top plate 14 is reduced to a single member. The members 36 extend below the studs 32 and 134.

Figure 26:
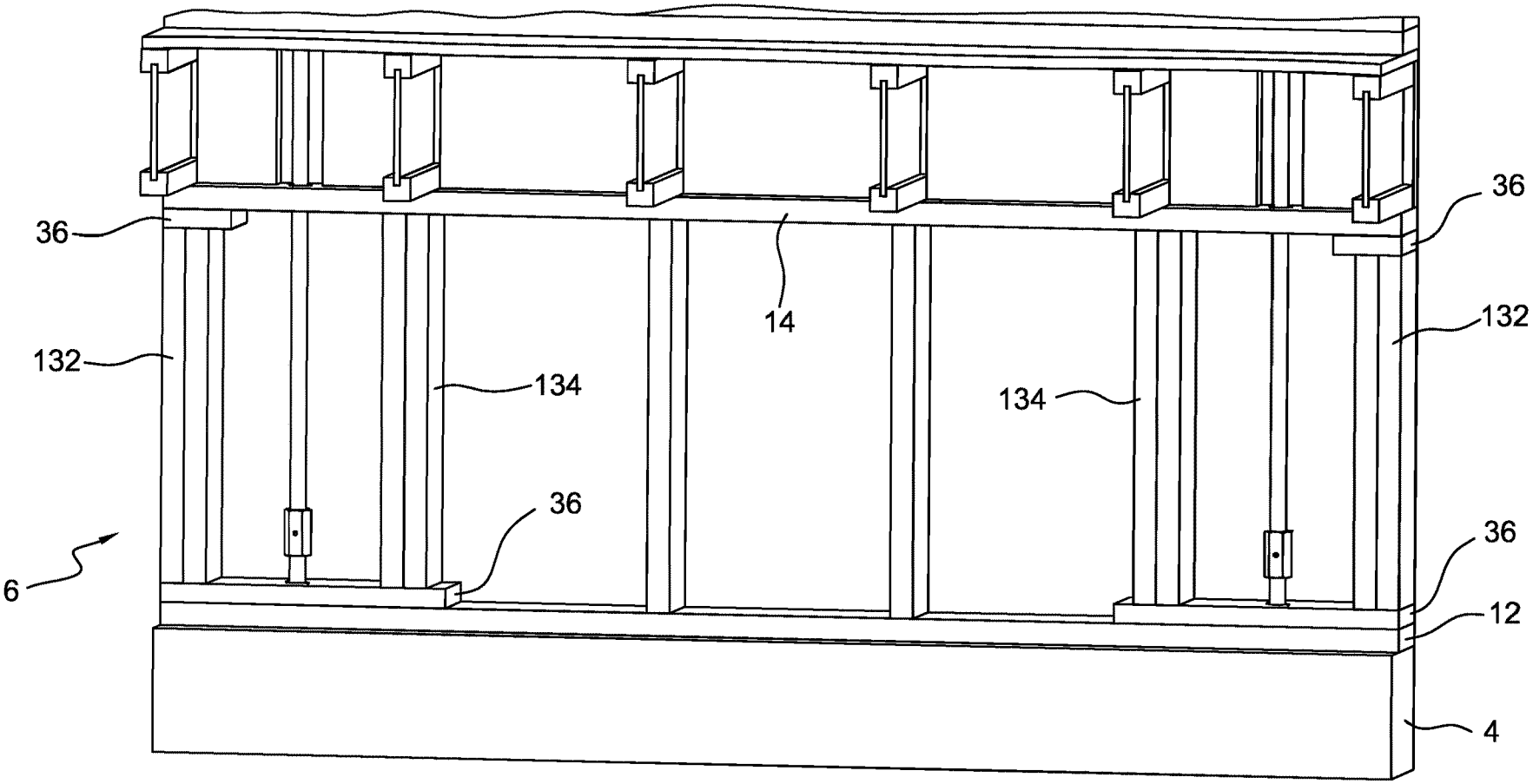
FIG. 26 is a perspective partial view of another embodiment of a reinforced shear wall.

Referring to FIG. 26, the wall of FIG. 25 is modified to add short members 36 between the single member top plate 14 and the top ends of the outer studs 132.

Figure 27:
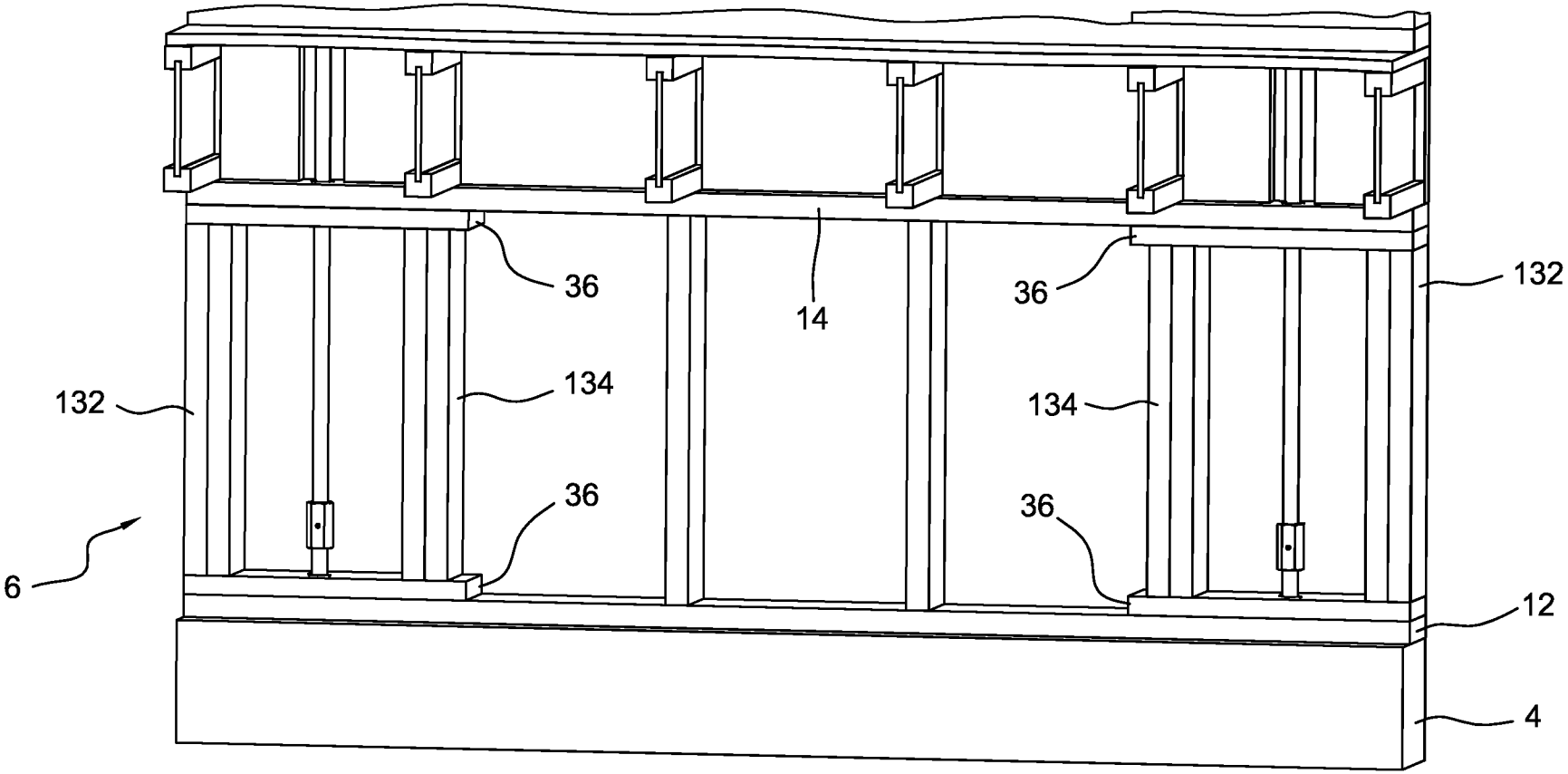
FIG. 27 is a perspective partial view of another embodiment of a reinforced shear wall.

Referring to FIG. 27, the wall of FIG. 26 is modified to extend the members 36 from the top ends of the outer studs 132 and inner double studs 134 below the single member top plate 14.

It should be understood that the arrangements shown in FIGS. 23-27 shown for the bottom floor walls are also applicable to the upper floor walls, depending on the loads expected.

Figure 28A:
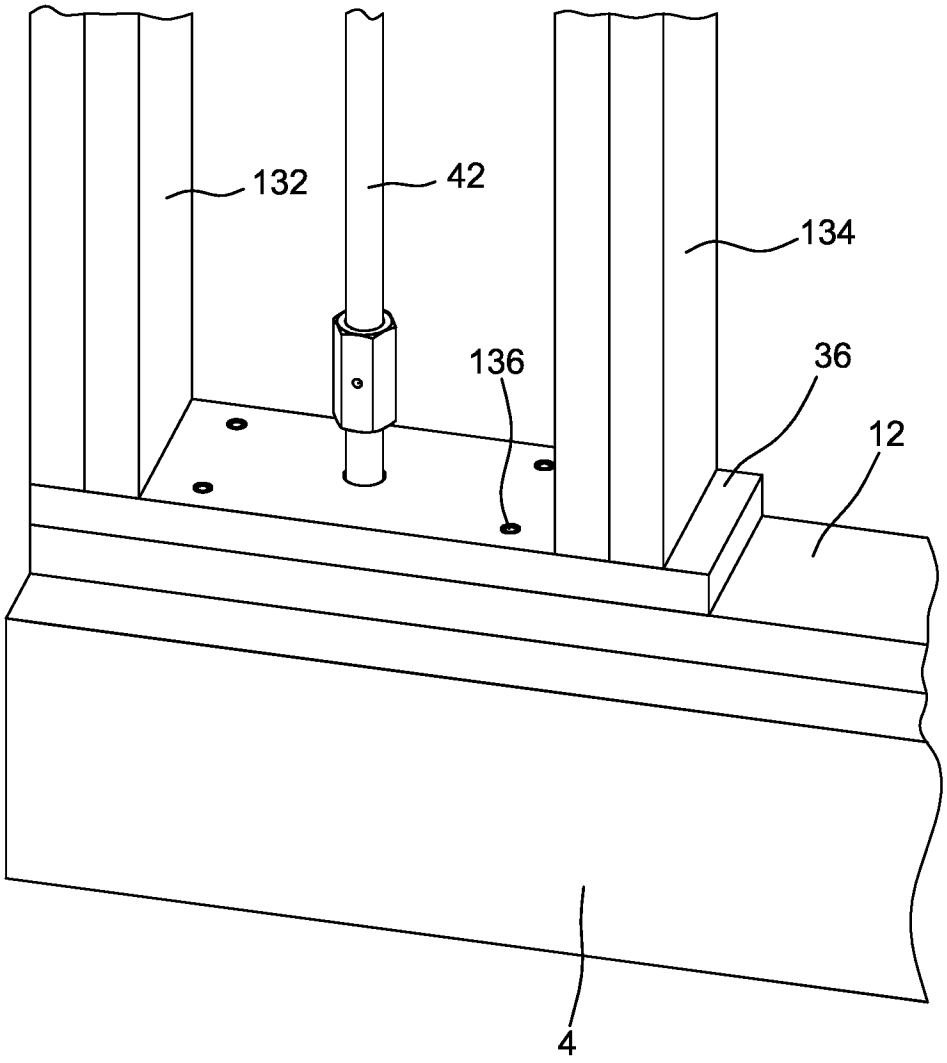
FIG. 28A-28C are perspective views of a portion of the shear wall showing various ways of attaching the intermediary member to the wall structure.
Figure 28B:
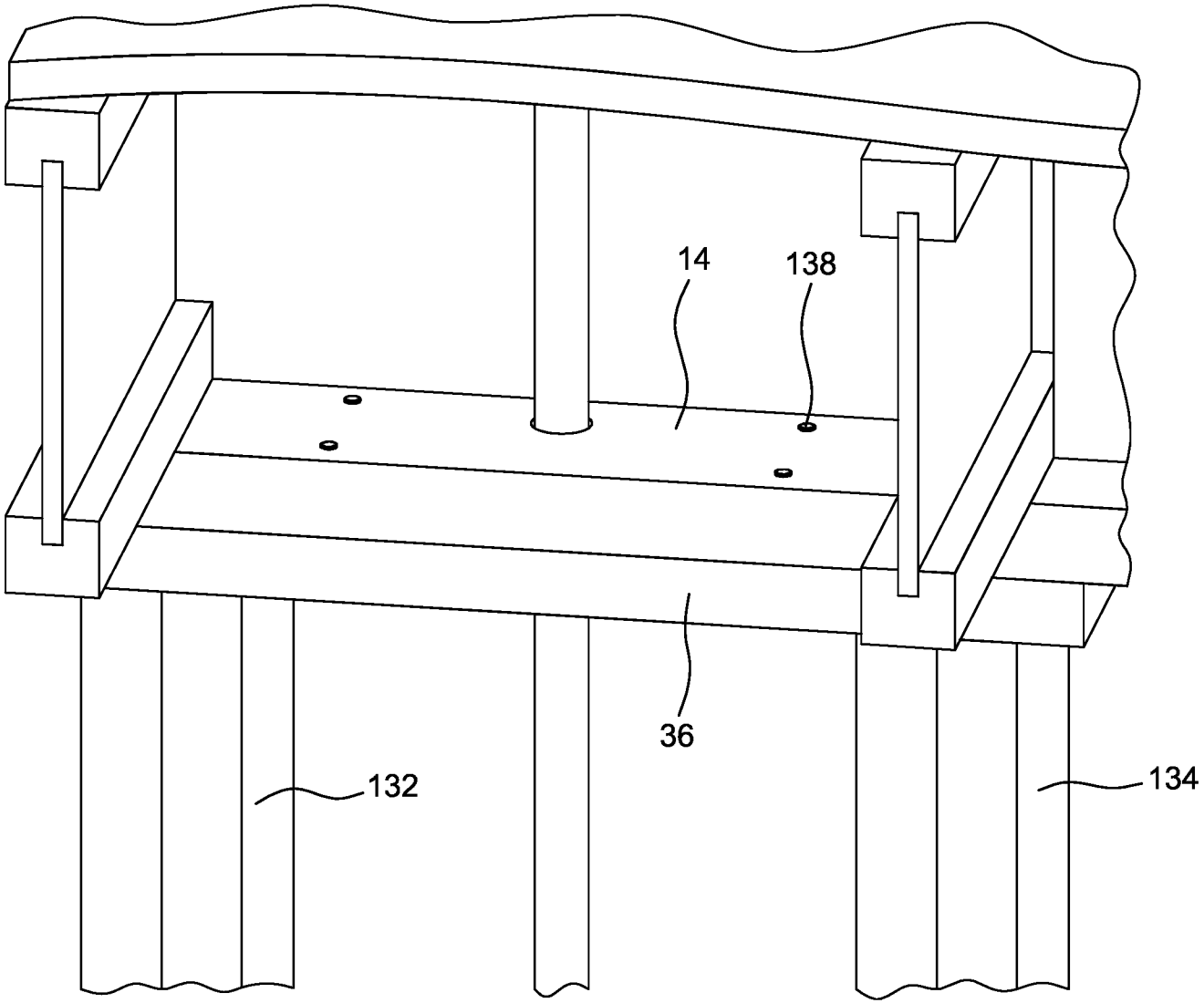
Figure 28C:
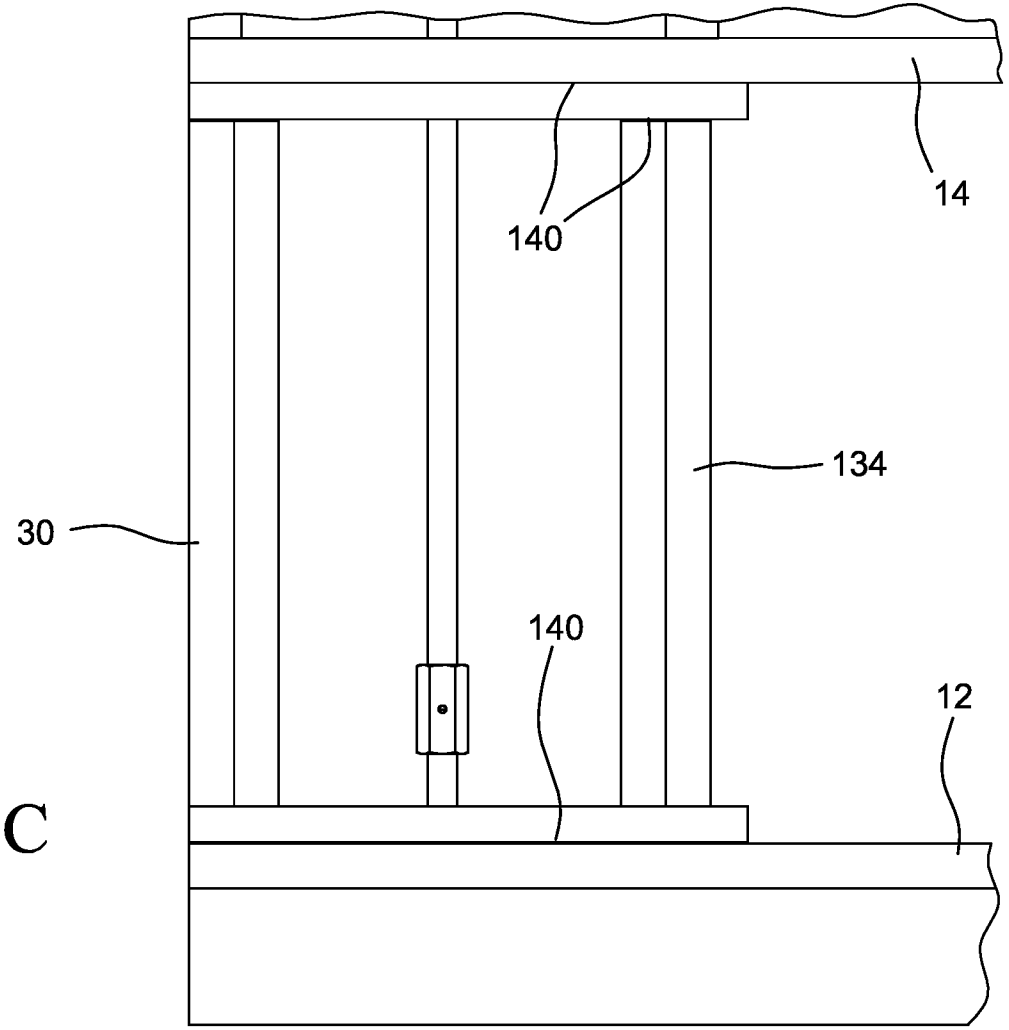

Referring to FIGS. 28A-28C, the members 36 may be attached to the bottom plate 12 or the top plate 14 with screws 136 or nails 138 or glue 140. The ends of the studs 132 and 134 may also be screwed, nailed or glued to the members 36.

Figure 29:
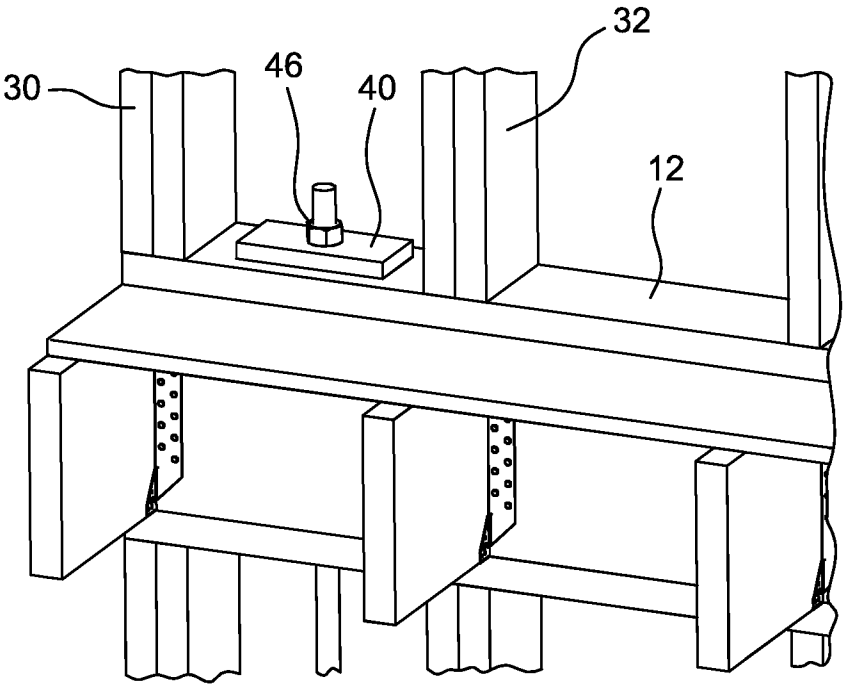
FIG. 29 is a perspective view of a portion of a reinforced wall.
Figure 32A:
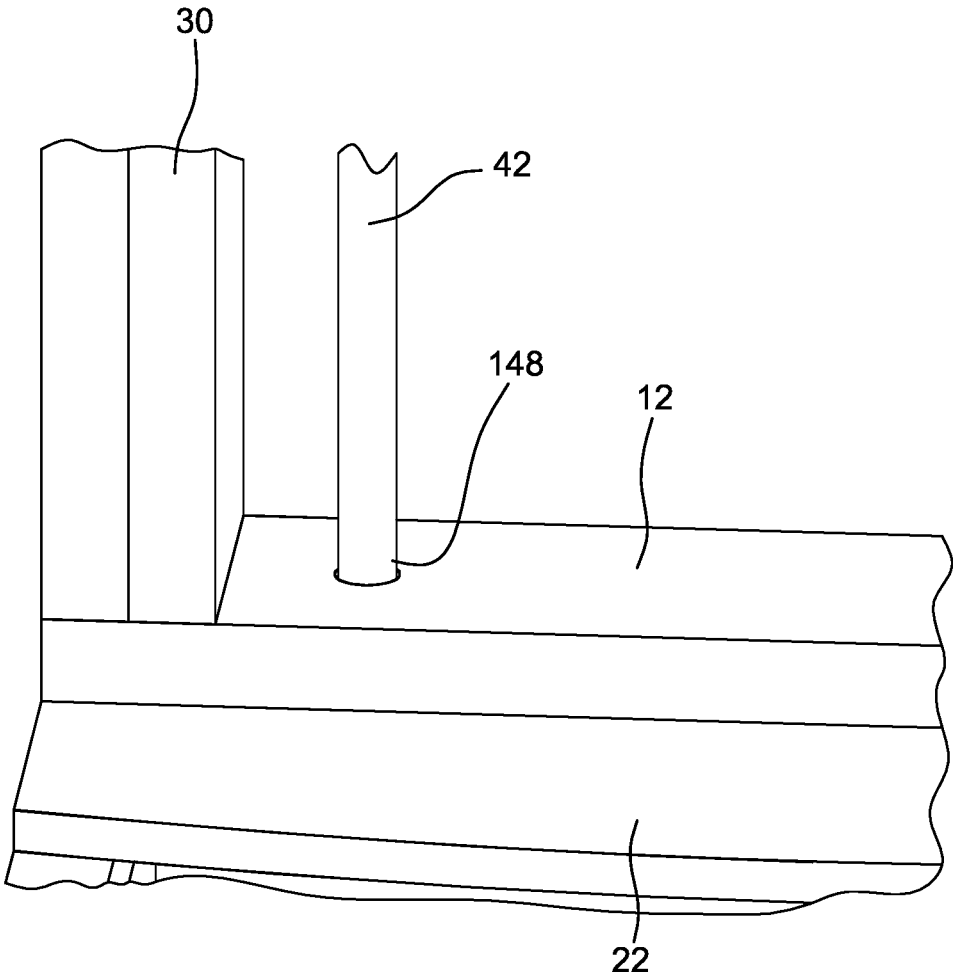

Referring to FIG. 29, the bearing plate 40 transfers load to the bottom plate 12 over the area of the bearing plate 40. Accordingly, the bearing plate 40 must be properly sized to spread the load on the sawn lumber bottom plate 12 so as not to exceed the load limit of the lumber. For example, the perpendicular to grain load capacity of Douglas-Fir lumber is about 625 psi. Thus, the load exerted by the bearing plate 40 on the bottom plate should not exceed the area of the bearing plate 40 times the load capacity of the lumber. A higher load will require a larger bearing plate. The studs 30 and 32 are doubled up so that the bottom ends present a larger area than a single stud on the bottom plate 12. With the larger bottom areas, the loads on the studs 30 and 32 are spread over a larger area over the bottom plate 12, thereby reducing the force per square area.

Figure 30:
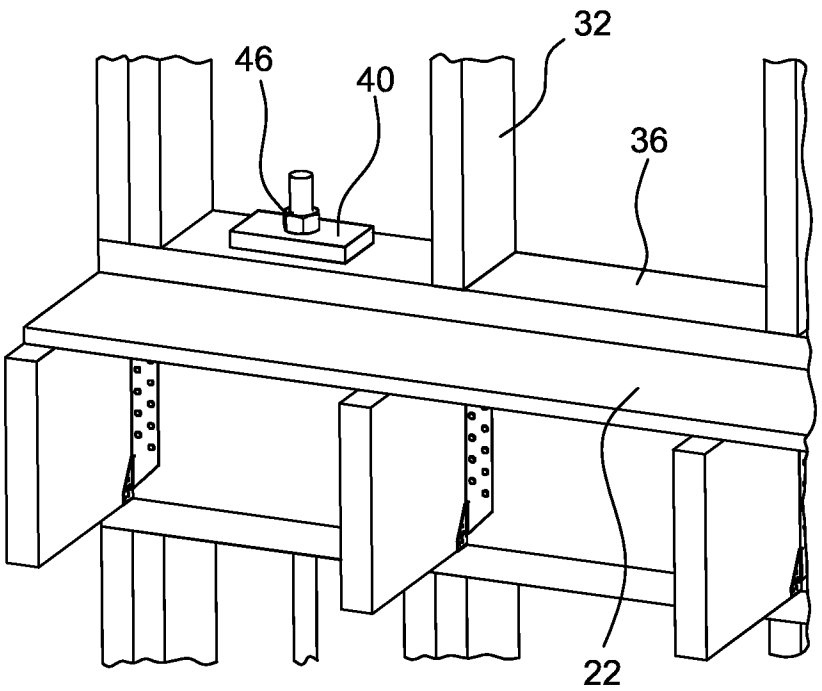
FIG. 30 is a perspective view of a portion of a reinforced wall.

Referring to FIG. 30, with the use of the member 36, the size of the bearing plate 40 and the amount of lumber is advantageously reduced. The double studs 32 shown in FIG. 29 is advantageously reduced to a single stud since the member 36 has a higher compression load than the sawn lumber bottom plate 12 so that the member 36 can handle the load over the smaller area of the bottom end of the single stud 32. Also, the load is spread out on the plywood subfloor 22 over a larger area than the area of the bottom end of the stud. For example, the loading area on the subfloor 22 can be three times or more of the area of the bottom end of the stud 32, depending on the dimensions of the member 36. The size of the bearing plate 40 is also advantageously reduced as compared to FIG. 29 since the member 36 has a higher compression load capacity than the sawn lumber bottom plate 12 so that for the same load a smaller bearing plate is needed. The load on the bearing plate is also transferred onto a larger area on the plywood subfloor 22 than the actual area of the bearing plate 40, thereby spreading out the load and lowering the load per unit area.

Referring to FIGS. 31A-31C, the use of the member 36 advantageously allows the use of a previously sized bearing plate 40 even when an opening 142 is oversized. Without the use of the member 36, the contact area 144 is reduced due to the oversized opening 142. The reduced contact area 144 would have required a larger size bearing plate 40 to transfer the load of the bearing plate 12 without overloading the perpendicular to grain load capacity of the bottom plate 12. With the use of the member 36, the contact area of the bearing plate 40 is advantageously increased to the projected area 146 defined by the 45° planes 62 intersecting the top surface of the bottom plate 12.

Referring to FIGS. 32A-32D, the member 36 advantageously allows the use of a smaller bearing plate 40 when the opening 148 for tie-rod 42 is too close to the studs 30 such that a standard size bearing plate for the design load will not fit in the reduced space. By interposing the member 36 between a smaller sized bearing plate 40 and the bottom plate 12, the contact area of the bearing plate 40 is advantageously projected onto a larger area 152 on the bottom plate 12. Even with the member 36 having a slotted opening 150, the area 152 is still larger than the contact area of the bearing plate 40. The 45° planes 62 project the contact area of the bearing plate 40 onto the area 152. With the larger area 152, the load on the bearing plate is spread out over the larger area 152, thus reducing the load per unit area on the bottom plate 12 that the bottom plate can safely handle.

Referring to FIGS. 33A and 33B, a bridge member 154 is supported by jack studs 156. The bridge member 154 is a standard nominal 2×8 sawn lumber, Douglas-Fir with compression strength of 625 psi perpendicular to grain. The maximum capacity at the contact area 158 of the bridge member 154 with the jack stud 156 is about 5156 lbs. The jack stud 156 has a contact area of 8.25 sq. in. for a nominal 2×6 stud. The parallel to grain load capacity of the jack stud is about 1300 psi.

Referring to FIGS. 34A and 34B, the capacity of the bridge contact with the jack stud is advantageously increased with the interposition of the member 36 with compression strength of 890 psi. The load capacity of the contact area 158 is about 7343 lbs. Assuming a thickness of 1.5 in. and width of 5.5 in. (nominal 2×6 lumber) for the member 36, the projected area 160 of the contact area 158 onto the bridge member 154 will be about 16.5 sq. in. Thus, the load capacity of 7343 lbs. translates to 445 psi, which is within the load capacity of the bridge member 154. By placing the member 36 between the bridge member 154 and the jack stud 156, the load capacity of the assembly is advantageously increased from 5156 lbs. in FIG. 33A to 7343 lbs. while staying with the load capacity of the bridge member 154.

Referring to FIGS. 35A and 35B, the member 36 may be a 0.25" thick material with a compression strength of 22000 psi. The load capacity at the projected area 160 becomes 6016 lbs., which is more than the original 5156 lbs. capacity without the member 36. The projected area 160 is 9.625 sq. in., which means the distributed load capacity is about 625 psi, which is the load capacity of the bridge member 154.

Referring to FIGS. 36A and 36B, using the same member 36 with the compression strength of 22000 psi but with a thickness of 1", the load capacity at the projected area 160 becomes 8594 lbs. The projected area 160 is 13.75 sq. in., which means the distributed load capacity is about 625 psi, which is the load capacity of the bridge member 154.

Figures 37A, 37B:
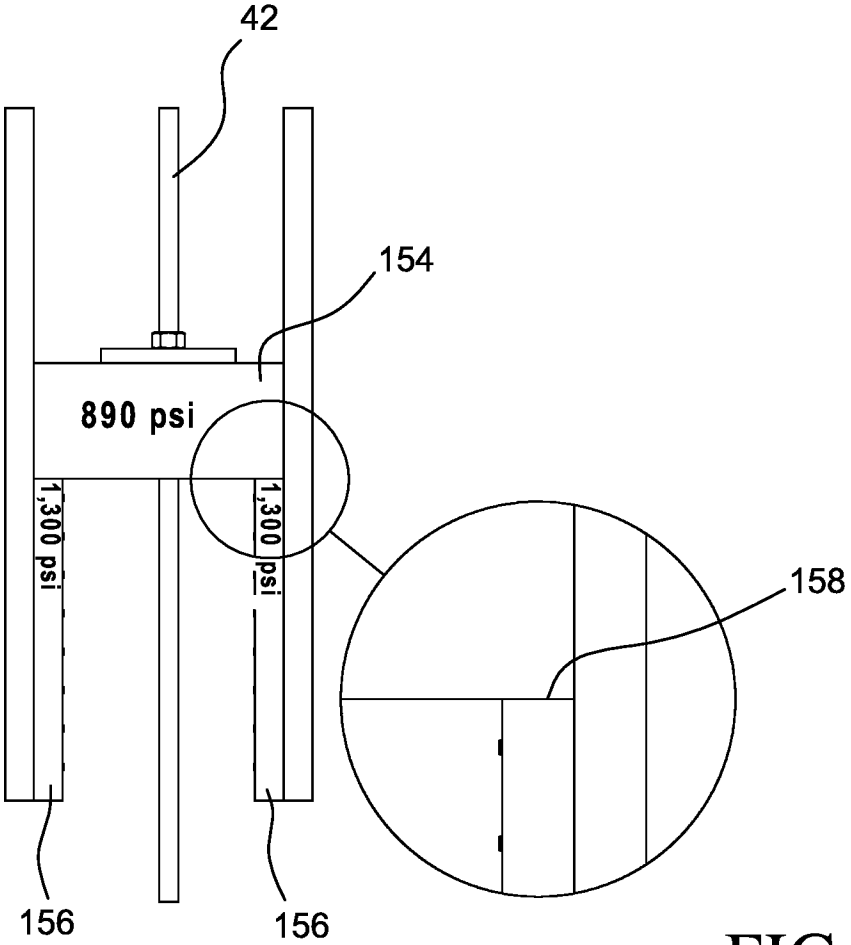
FIGS. 37A-37B illustrate the loading at a bridge member having a higher compression strength than the supporting studs.

Referring to FIGS. 37A and 37B, the bridge member 154 may be made of the same material as the member 36, such as engineered lumber with a compression strength of 890 psi. In this arrangement, the capacity of the contact area 158 is about 7373 lbs., still higher than the load capacity of the arrangement of FIG. 33A.

Figure 38:
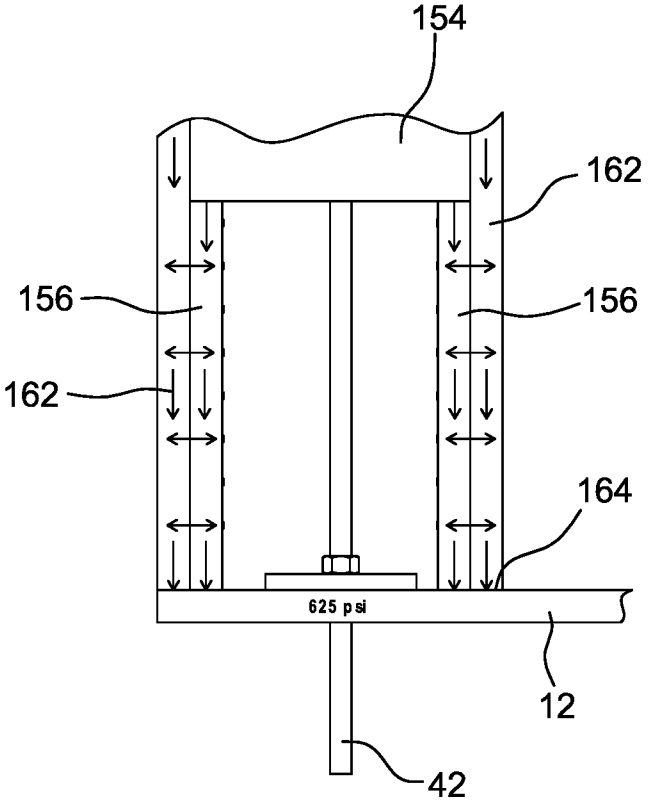
FIG. 38 illustrates the sharing of load between studs attached to each other with nails, screws, pins, etc.

Referring to FIG. 38, the bridge member 154 is supported by the jack studs nailed or screwed to full height studs 162. The tie-rod 42 is attached to the bridge member 154 via the bearing plate 40 and the nut 46 or the expandable fastener 50 (see, for example, FIGS. 5 and 39A). Loads on the studs 156 and 162 are shared between the studs via the nails or screws that join them together and transferred to the bottom plate 12. The bottom ends of the studs have a contact area 164 of 16.5 sq. in. (for a nominal 2×6 stud). The bottom plate 12 is rated at 625 psi perpendicular to grain loading for a Douglas-Fir lumber. The total load that the bottom plate can handle over the contact area 164 without crushing calculates to 10313 lbs. However, each of the studs 156 and 162 is rated at 1300 psi, or 21450 lbs. over the contact area 164. This means that the studs 156 and 162 are underutilized for their rated capacity.

Figure 39:
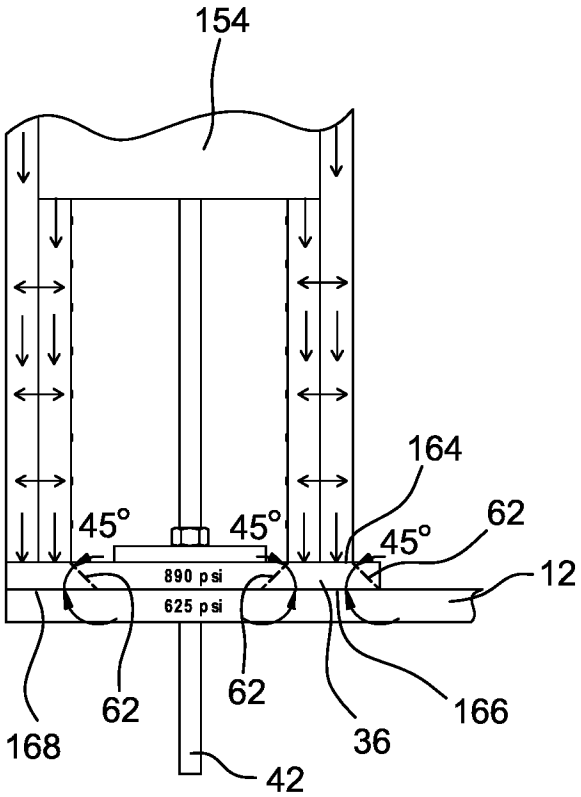
FIG. 39 illustrates the use of an intermediary member in accordance with the present invention to transfer and spread the loads from the studs to the bottom plate where the studs are attached to each other with nails, screws, etc.

Referring to FIG. 39, the member 36 with a higher compression strength than the bottom plate 12 is used to increase the load that the bottom plate 12 can absorb. Due to the 45° projection of the force from the contact area 164 onto the projected areas 166 and 168, the maximum load of 14685 lbs. that the member 36 can handle is projected onto the larger areas 166 (33 sq. in.) and 168 (24.75 sq. in.), bringing the total load to 445 psi and 593 psi, both within the 625 psi capacity of the bottom plate 12.

Figure 40:
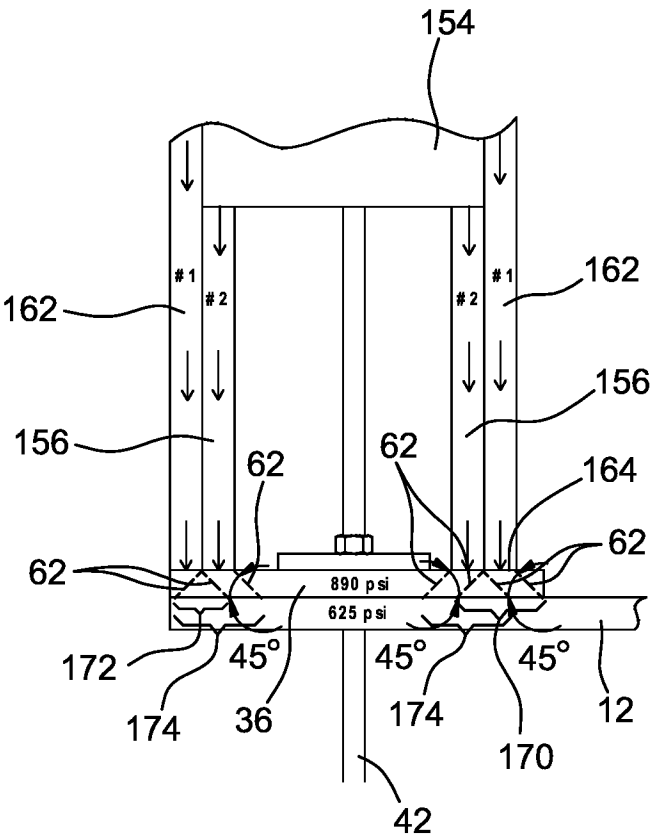
FIG. 40 illustrates the use of an intermediary member in accordance with the present invention to transfer and spread the loads from the studs to the bottom plate where the studs are not attached to each other.

Referring to FIG. 40, the studs 156 and 162 are not attached to each other so that the loads on each are not shared. The contact area 164 of each stud is projected onto the bottom plate 12 along the 45° planes. For the studs 162, one will project the load onto an area of project an area 170 of 24.75 sq. in. and the other into an area 172 of 16.5 sq. in. Each of the studs 162 can carry a load of 7343 lbs. without overloading the capacity of the member 36 at 625 psi. The 7343 lbs. load translates to 297 psi and 445 psi for the areas 170 and 172, respectively. These values are within the load capacity of the bottom plate 12, which is rated at 625 psi. Similarly for the studs 156, each will project its maximum load of 7343 lbs. onto the projected areas 170, which calculates to 16.5 sq. in., thereby spreading the load onto the bottom plate 12 at 297 psi.

Figure 41:
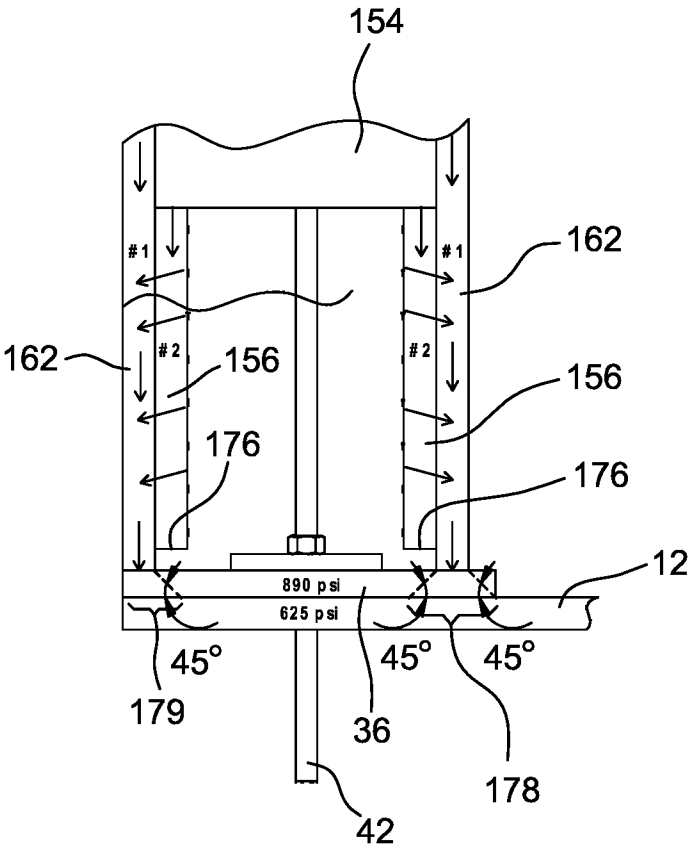
FIGS. 41-42 illustrate the use of an intermediary member in accordance with the present invention to transfer and spread the loads from the studs to the bottom plate where only one of the attached studs are supported by the intermediary member.

Referring to FIG. 41, the bottom ends 176 of the jack studs 156 are spaced apart from the member 36. The studs 156 and 162 are attached to each other by nails, screws or similar hardware so that the loads on the jack studs 156 are transferred to the studs 162. The maximum load from each of the studs 162 on the member 36 is 7343 lbs. which is transferred onto the bottom plate over an area 178 of 24.75 sq. in or an area 179 of 16.5 sq. in. The load on the member 36 at 7343 lbs. is thus distributed over the area 178 at 297 psi and over the area 179 at 445 psi, which are within the load capacity of the bottom plate 12. If higher loads are expected, the member 36 may be chosen with a higher compression strength, for example, 1200 psi wherein the total load of 9900 lbs. will be distributed over the area 178 at 400 psi or the area 179 at 600 psi.

Figure 42:
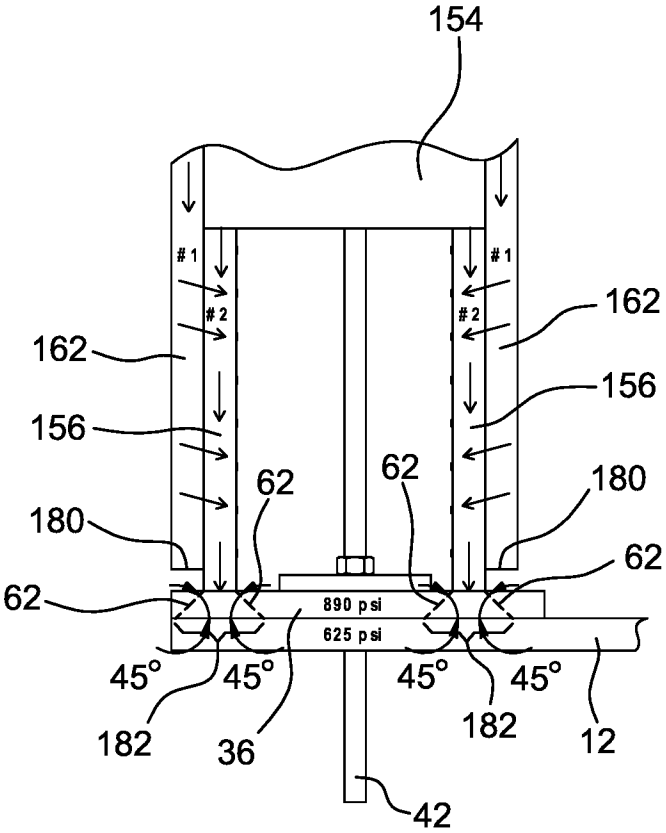

Referring to FIG. 42, the bottom ends 180 of the studs 162 are spaced apart from the member 36. The studs 156 and 162 are attached to each other by nails, screws or similar hardware so that the loads on the studs 162 are transferred to the jack studs 156. The maximum load from each of the studs 156 on the member 36 is 7343 lbs. which is transferred onto the bottom plate over an area 182 of 24.75 sq. in. The load on the member 36 at 7343 lbs. is thus distributed over the area 182 at 297 psi, which is within the load capacity of the bottom plate 12.

Figure 43:
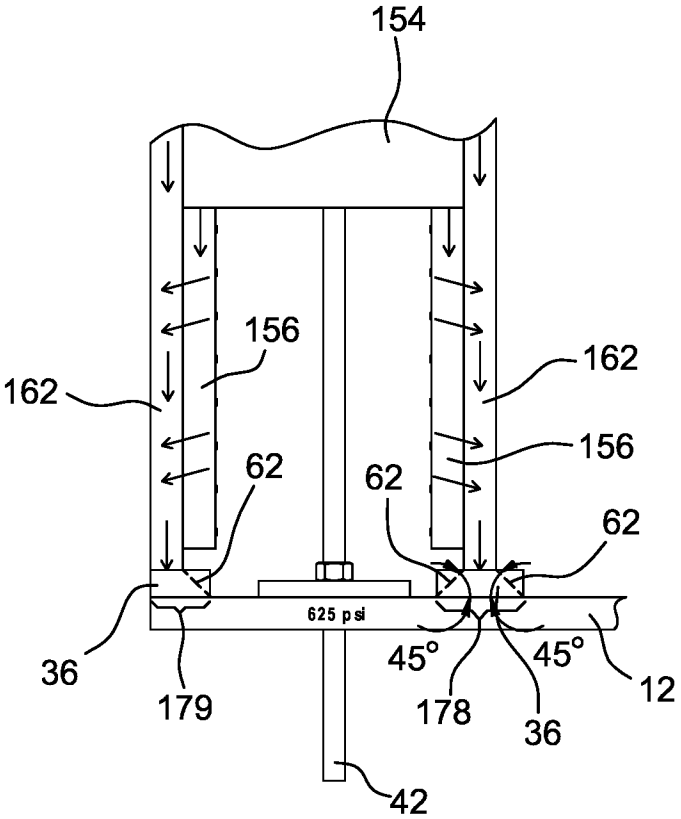
FIG. 43 illustrate the use of an intermediary member in accordance with the present invention to transfer and spread the loads from the studs to the bottom plate where only one of the attached studs are supported by an individual intermediary member that does not extend across the stud bay.

Referring to FIG. 43, the members 36 are sized only to cover at least the projected areas 178 and 179.

Figure 44:
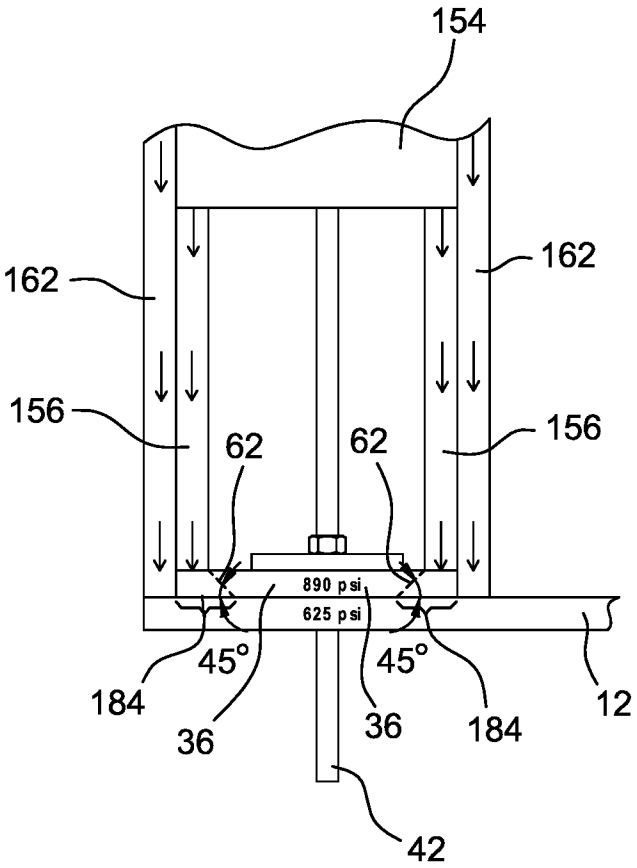
FIG. 44 illustrate the use of an intermediary member in accordance with the present invention to transfer and spread the loads from the studs to the bottom plate where only one of the attached studs are supported by the intermediary member.
Figures 45A, 45B, 45C, 45D:
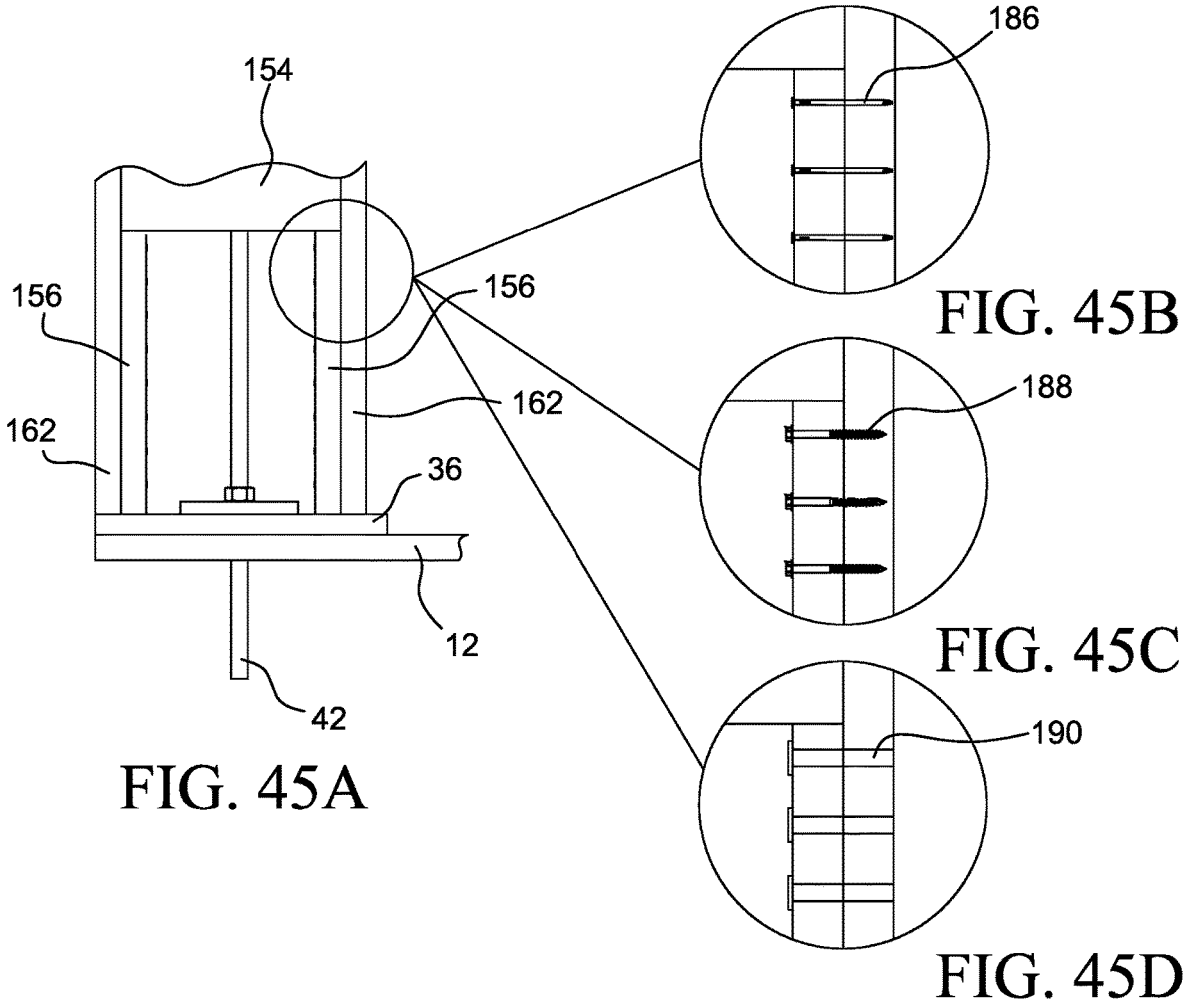
FIGS. 45A-45D illustrate the use of nails, screws or pins to attach two studs together in a bridge structure.

Referring to FIG. 44, the member 36 supports the jack studs 156 but not the studs 162. The studs 156 and 162 are not attached to each other so that there is no sharing of load between the studs. The studs 162 are supported by the bottom plate 12. The loads on the jack studs 156 are transferred to the projected areas 184 at 16.5 sq. in. The maximum load of 7343 lbs. from each of the jack studs 156 is transferred to the respective projected areas 184 at 445 psi, which is within the load capacity of the bottom plate 12 at 625 psi. The loads on the studs 162 with a contact area of 8.25 sq. in. (for a nominal 2×6 stud) should not exceed 5156 lbs., which is the load limit of the bottom plate 12 at 625 psi.

Referring to FIGS. 45A-45D, the studs 156 and 162 may be attached to each other using nails 186, screws 188 or pins 190.

Referring to FIGS. 46A and 46B, the present invention as disclosed herein may also be applied to a shear wall 192 using U-shaped metal studs 194 instead of wood studs. The tension load on the bearing plate 40 is transferred over an area larger than the area of the bearing plate, thereby spreading the load over a larger area on the bottom plate 196. In this manner, the bottom plate 196 and the subfloor 22 are better able to absorb the load.

Figure 47:
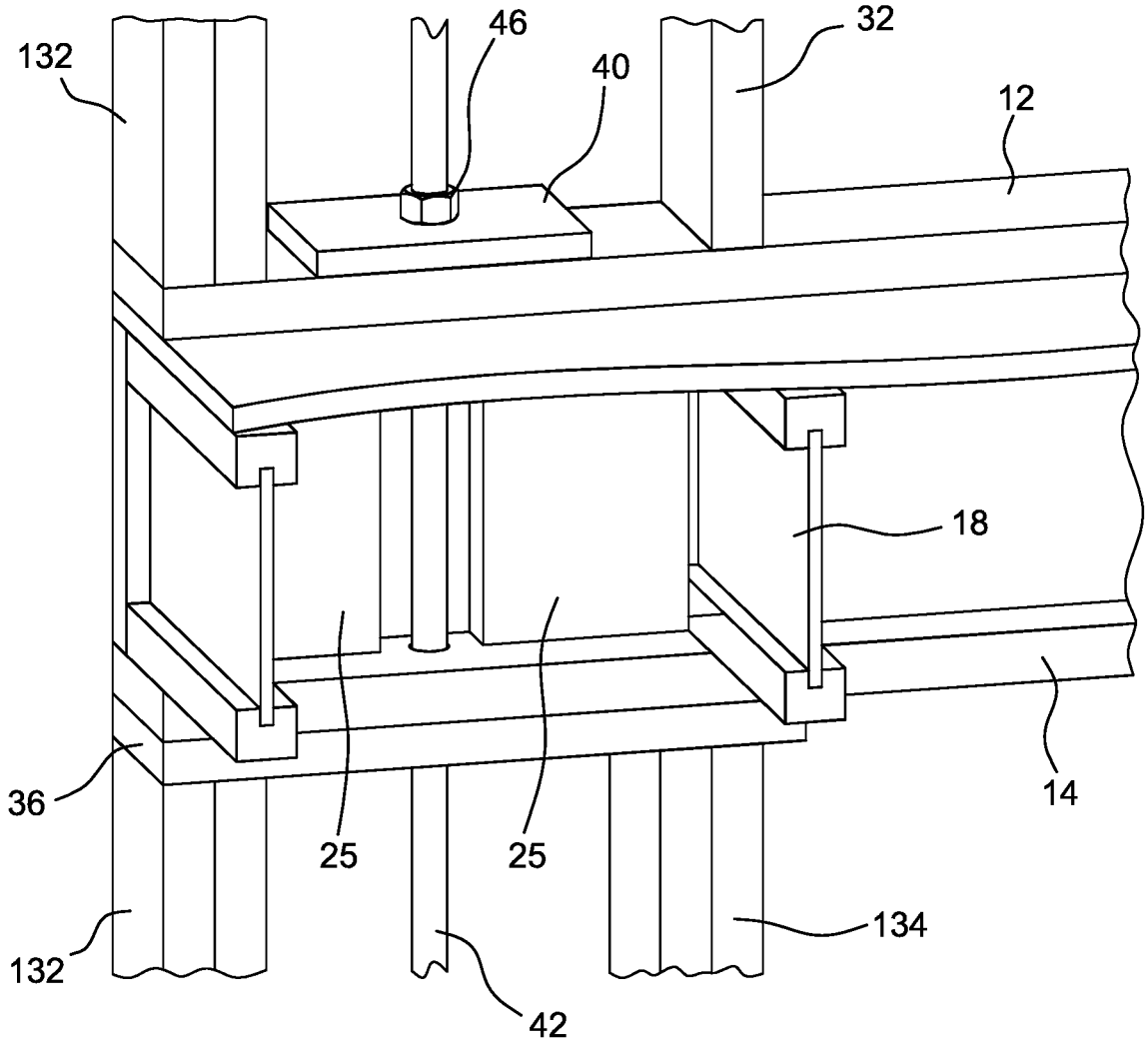
FIGS. 47-58 are perspective views of sections of reinforced walls using the present invention.

Referring to FIG. 47, the member 36 is disposed above the top ends of the post 132 and the studs 134 and below the single top The bearing plate 40 is sized to provide the appropriate plate 14. contact area with the bottom plate 12 so that the load per unit area from the bearing plate 40 can be supported by the bottom plate 12 compression load capacity. Blocking 25 help transfer the load from the bearing plate 40 to the single top plate 14 and to the post 132 and the studs 134.

Figure 48:
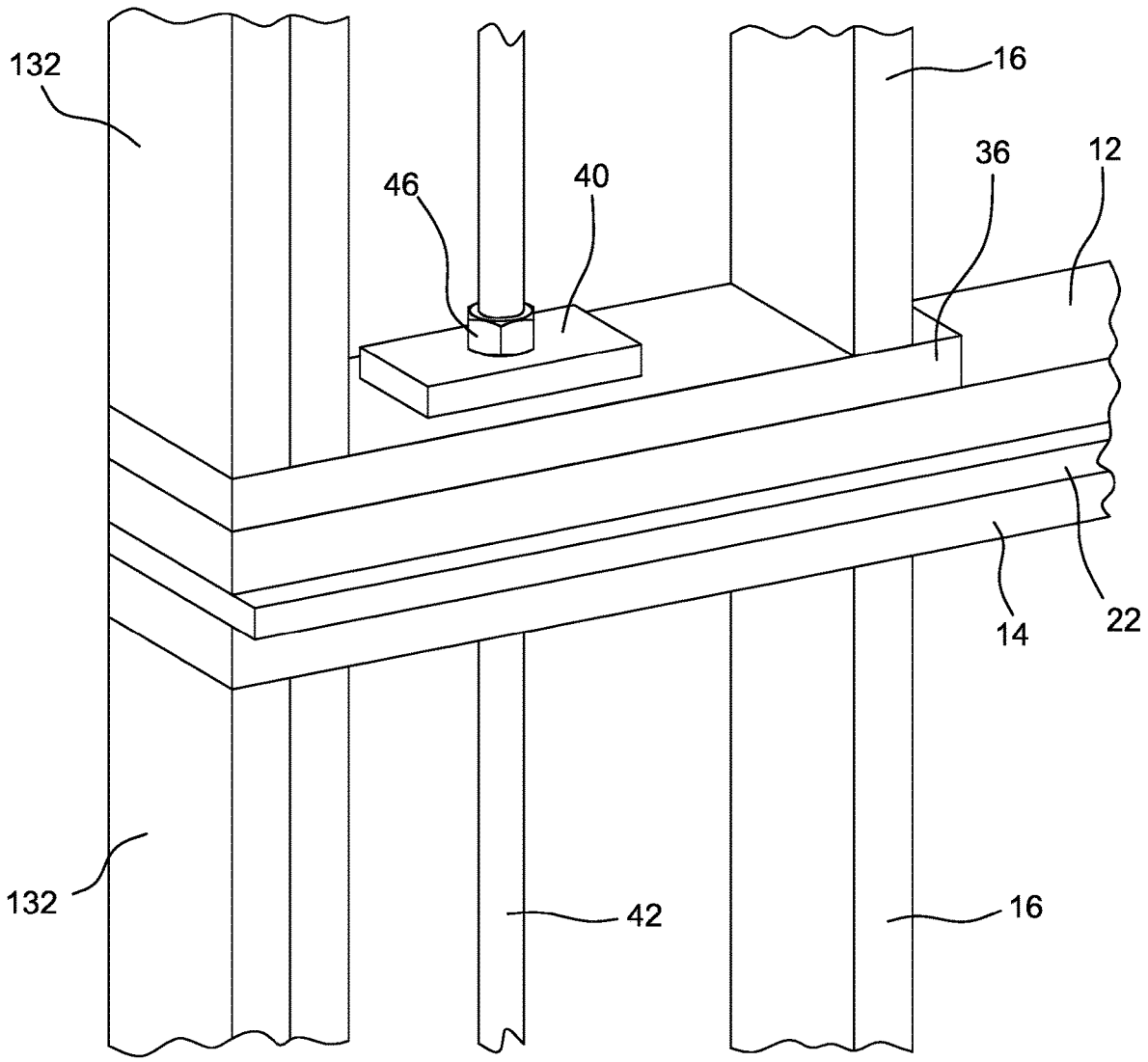

Referring to FIG. 48, a portion of a shear wall is shown. The member 36 supports the bottom ends of the post 132 and the stud 16. The member is attached to the bottom plate 12. The subfloor 22 is supported on the single top plate 14. The bearing plate 40 is shown smaller than the bearing 40 in FIG. 47 due to the use of the member 36, which transfers the load from the bearing plate 40 onto a larger area on the bottom plate 12.

Figure 49:
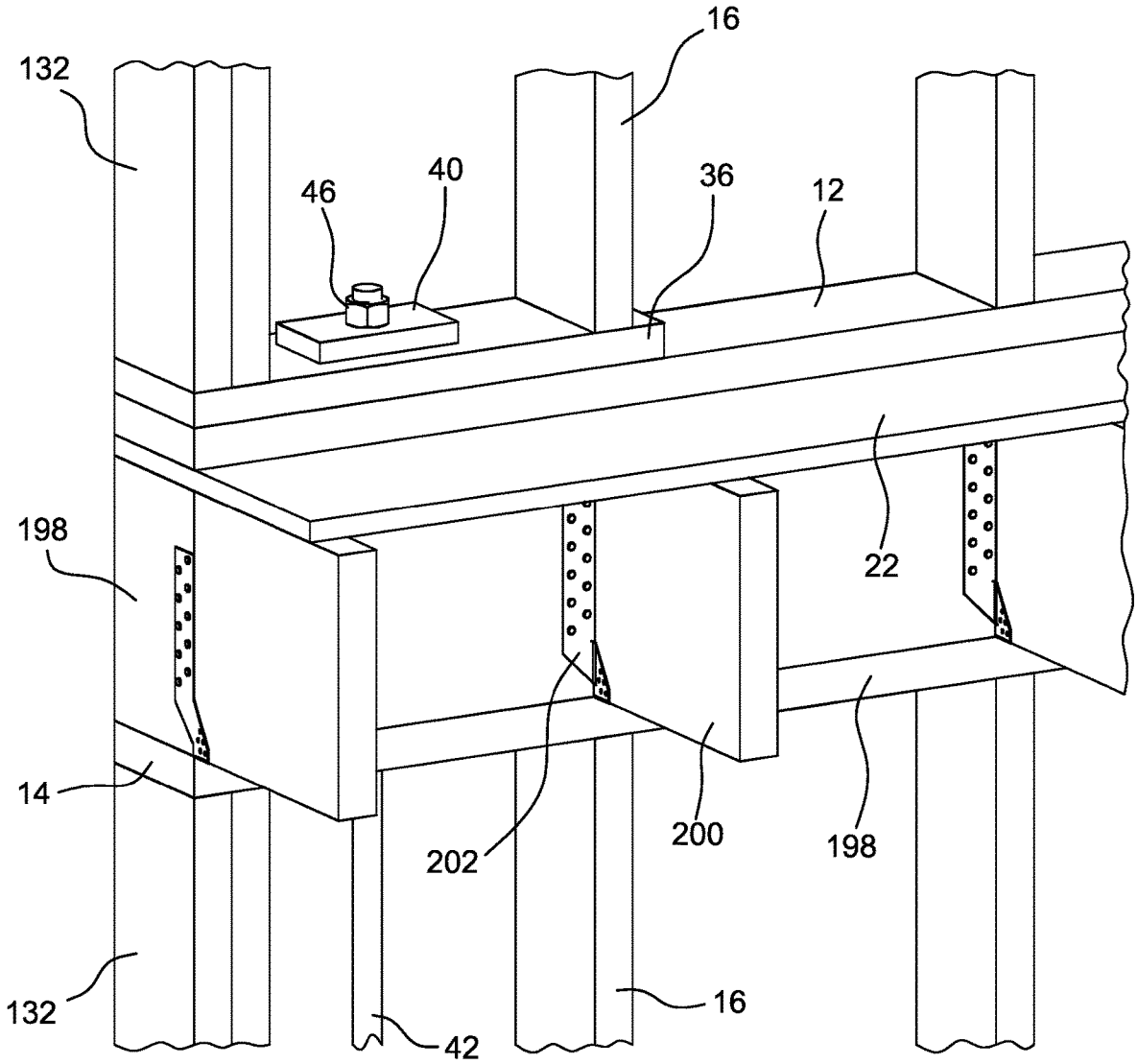

Referring to FIG. 49, the single top plate 14 supports a solid wood beam 198. Floor joists 200 are attached to the wood beam 198 with brackets 202. Subfloor 22 is attached to the floor joists 200. The member 36 is attached to the bottom plate 12 and supports the wood post 132 and the stud 16. Load from the bearing plate 40 is transferred to the bottom plate 12 via the member 36, which spreads the contact area of the bearing plate 40 onto a larger area on the bottom plate 12.

Figure 50:
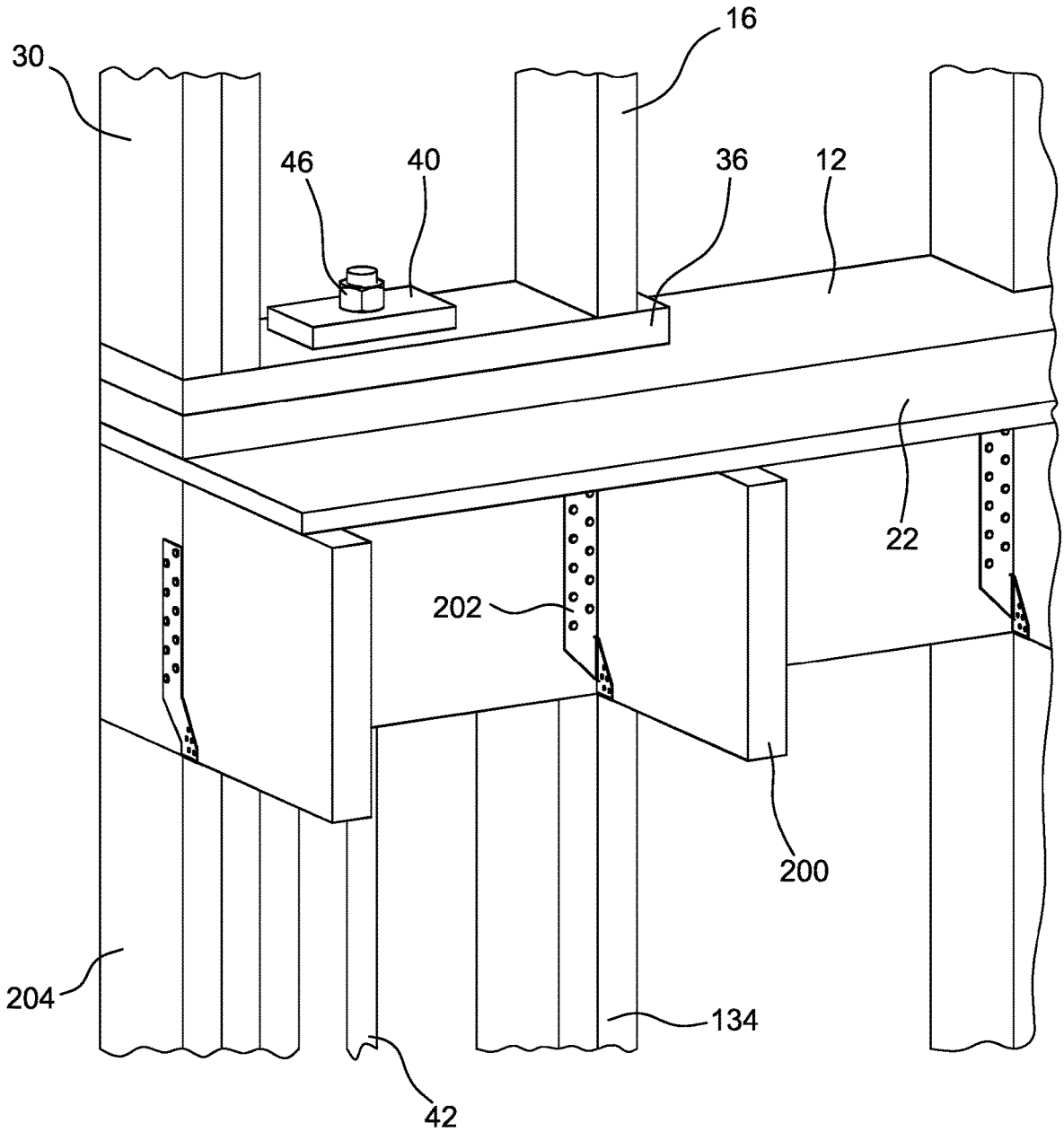

Referring to FIG. 50, a section of a shear wall similar to that of FIG. 49 is shown. Triple studs 204 and double studs 134 support the solid wood beam 198 without using the single top plate 14 shown in FIG. 49.

Figure 51:
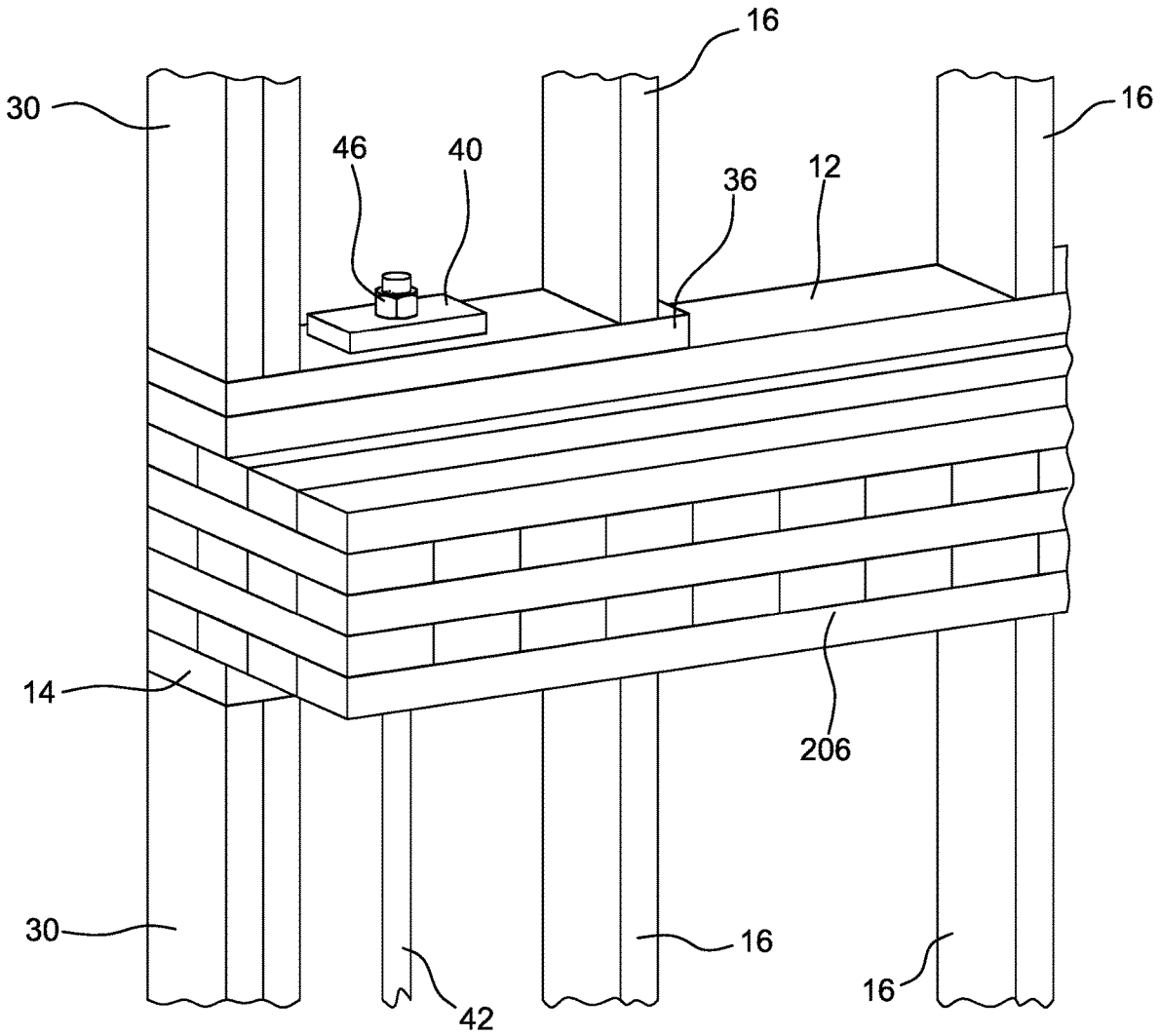

Referring to FIG. 51, a floor panel 206 made from cross-laminated timber (CLT) panel is supported by the single top plate 14 and the studs 30 and 16. The member 36 supports the studs 30 and 16 and transfers the load from the bearing plate 40 onto the bottom plate 12. The CLT panel is a known product available in the market today. The CLT panel is a large-scale, prefabricated, solid engineered wood panel consisting of several layers of kiln-dried lumber boards stacked in alternating directions, bonded with structural adhesives, and pressed to form a solid, straight, rectangular panel. See, for example, https://www.apawood.org/cross-laminated-timber, hereby incorporated by reference.

Figure 52:
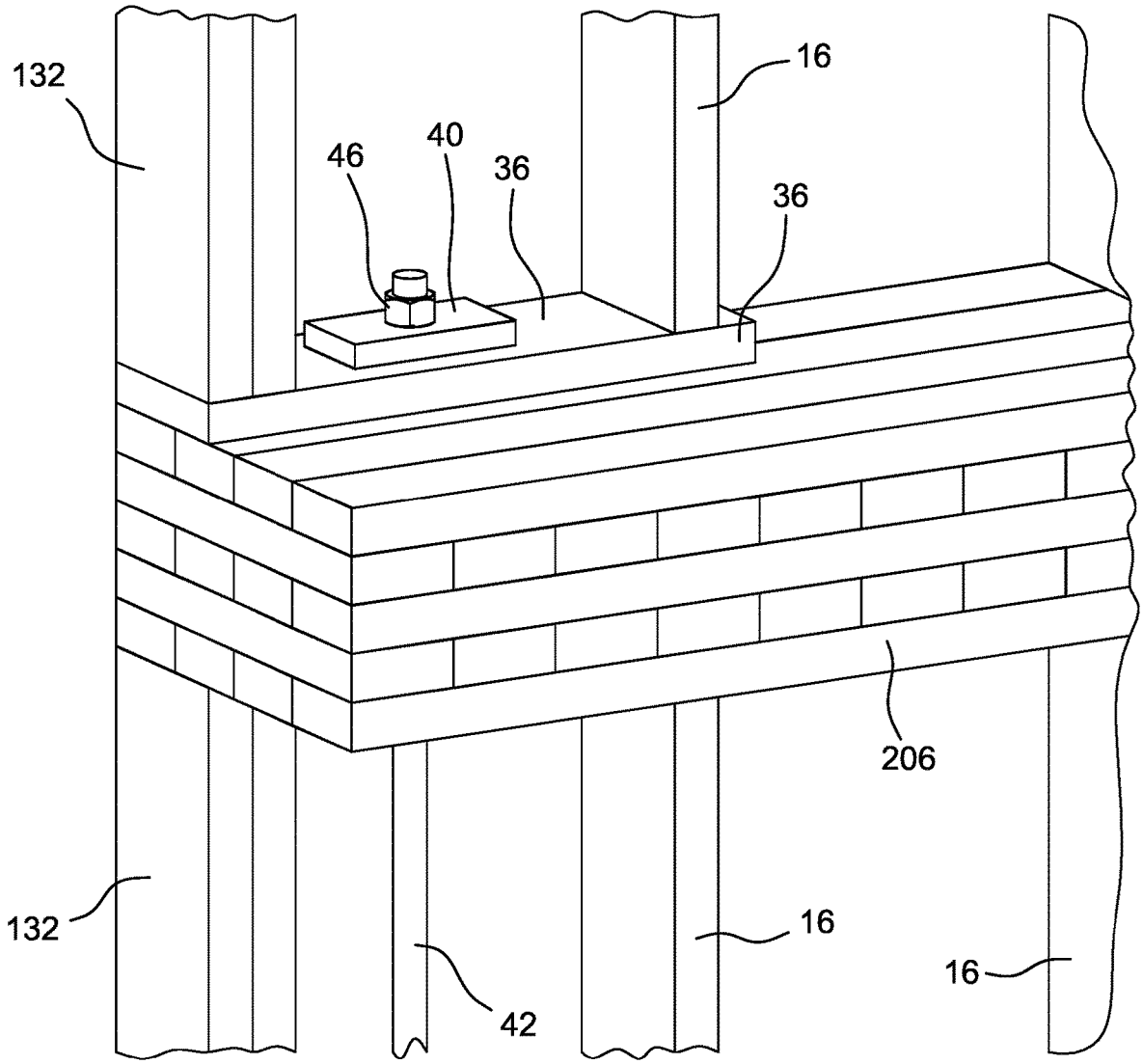

Referring to FIG. 52, the CLT floor 206 is supported directed by the post 132 and the studs 16. The member 36 is disposed on the floor 206, which has a lower compression strength than the member 36. The posts 132 and the stud 16 are supported by the member 36. Load from the bearing plate 40 is transferred to the floor panel 206 through the member 36, which spreads the load onto a larger area on the CLT panel 206 than the area of bearing plate 40.

Figure 53A:
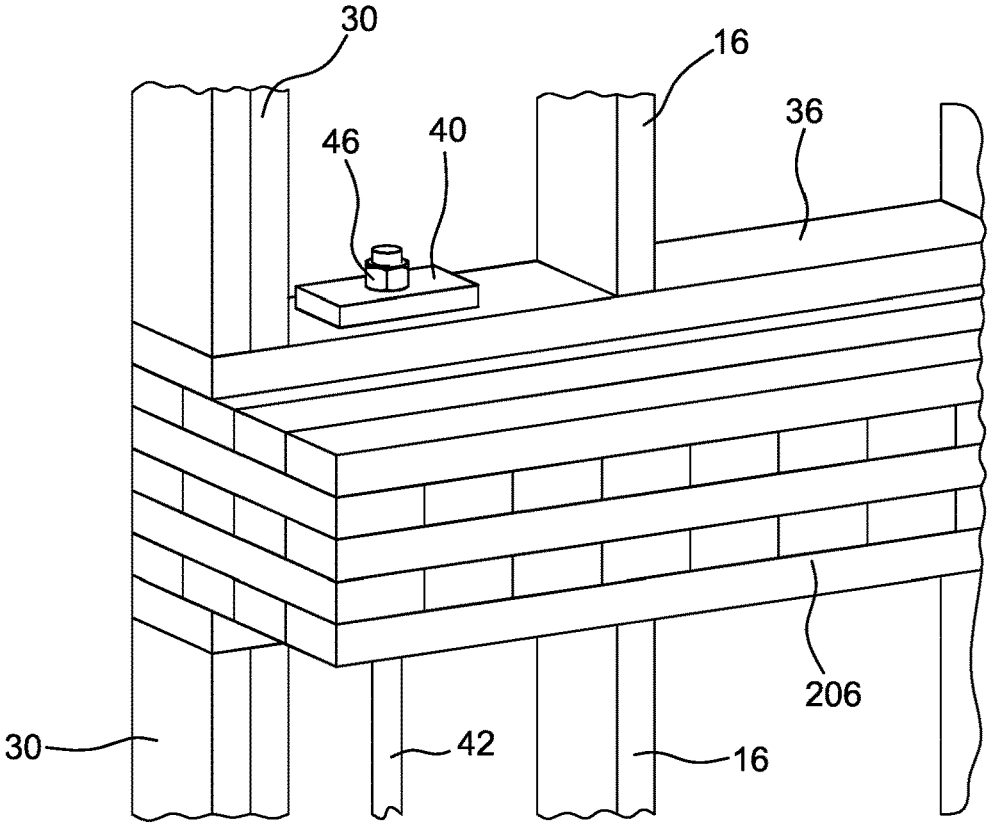
Figure 53B:
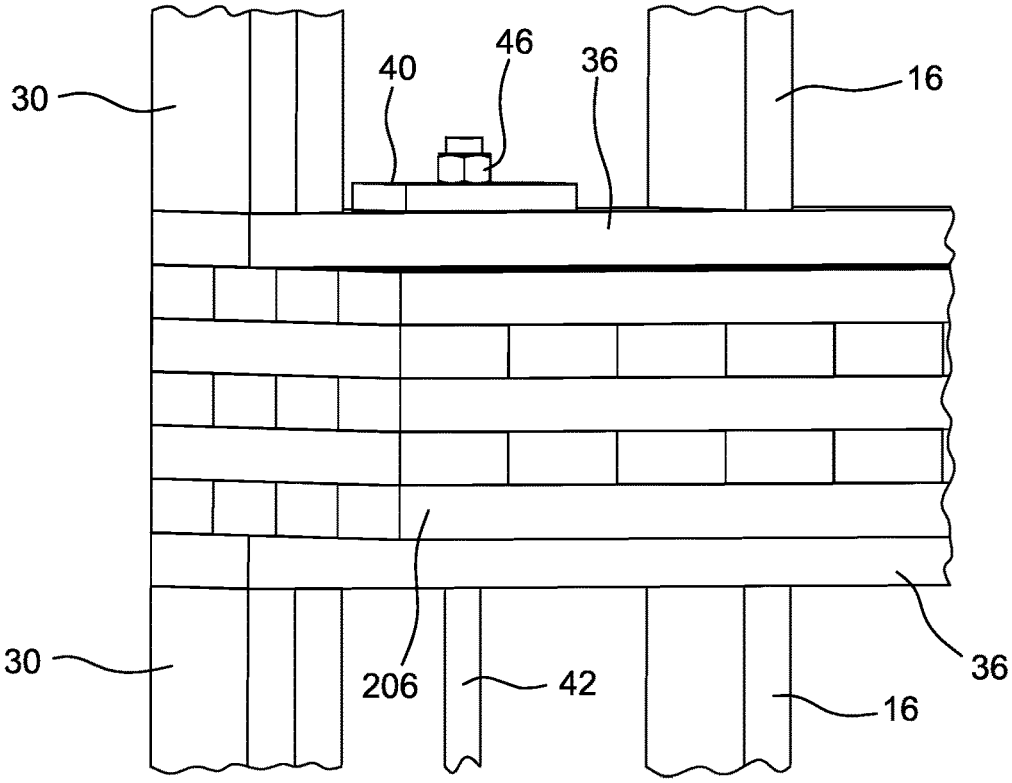

Referring to FIG. 53, the members 36 above and below the CLT panel 206 extend from one end of the wall to the other end. The member 36 on top of the CLT panel 206 also provides the function of a top plate 14. The member 36 below the CLT panel 206 also provides the function of a single top plate 14.

Figure 54A:
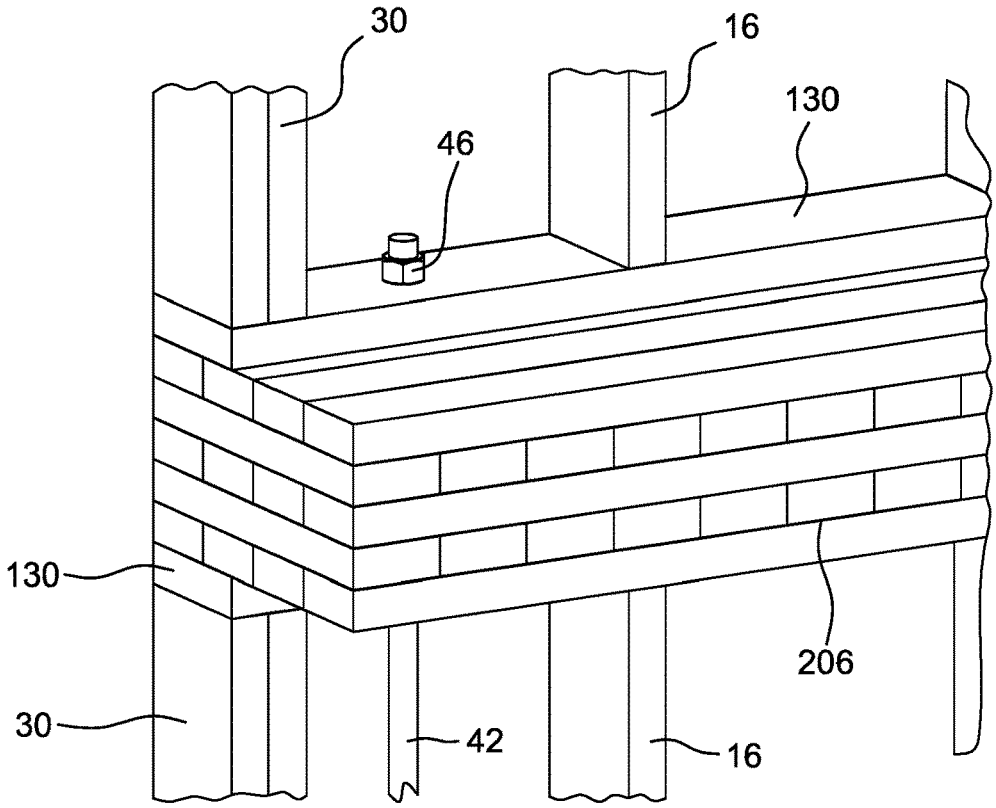
Figure 54B:
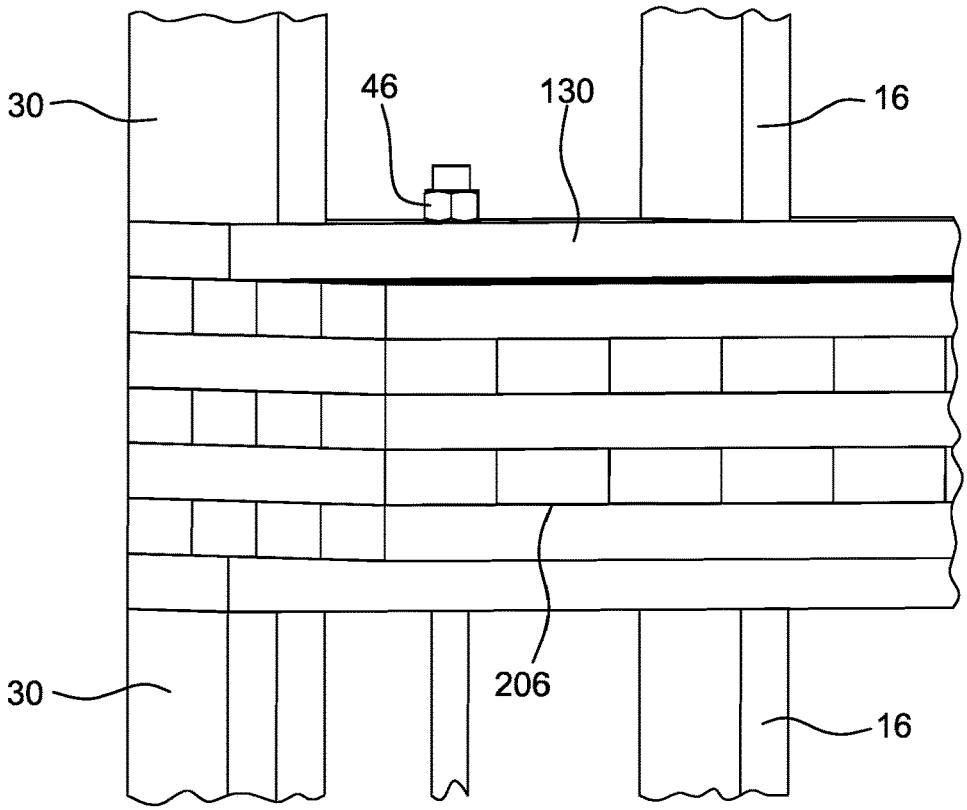

Referring to FIGS. 54A and 54B, the members 36 of FIGS. 53A-54B are replaced with the solid metal plates 130. The bearing plate 40 is not used since the solid metal plate 130 provides its own bearing plate function.

Figure 55A:
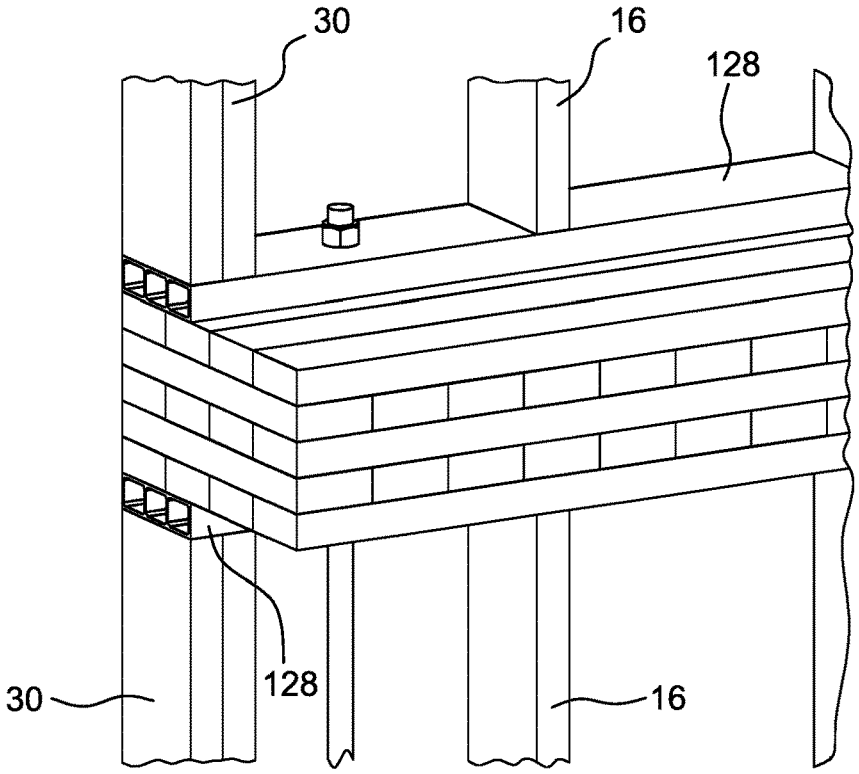
Figure 55B:
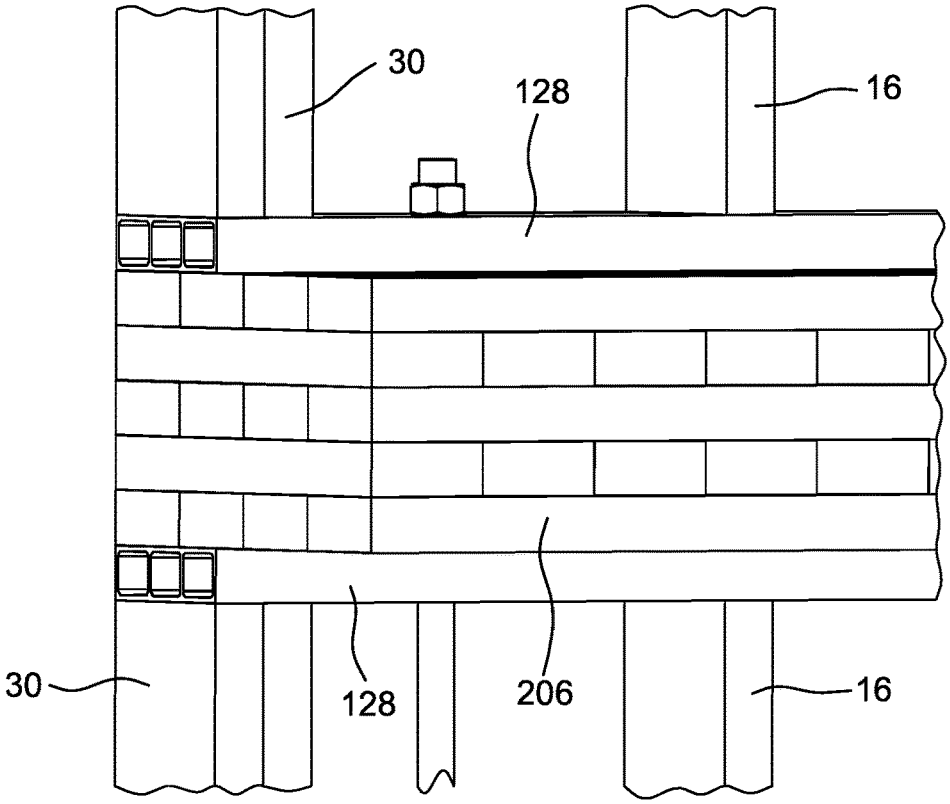

Referring to FIGS. 55A and 55B, the members 36 of FIGS. 53A-54B are replaced with the hollow metal plates 128. The bearing plate 40 is not used since the hollow metal plate 128 provides its own bearing plate function.

Figure 56:
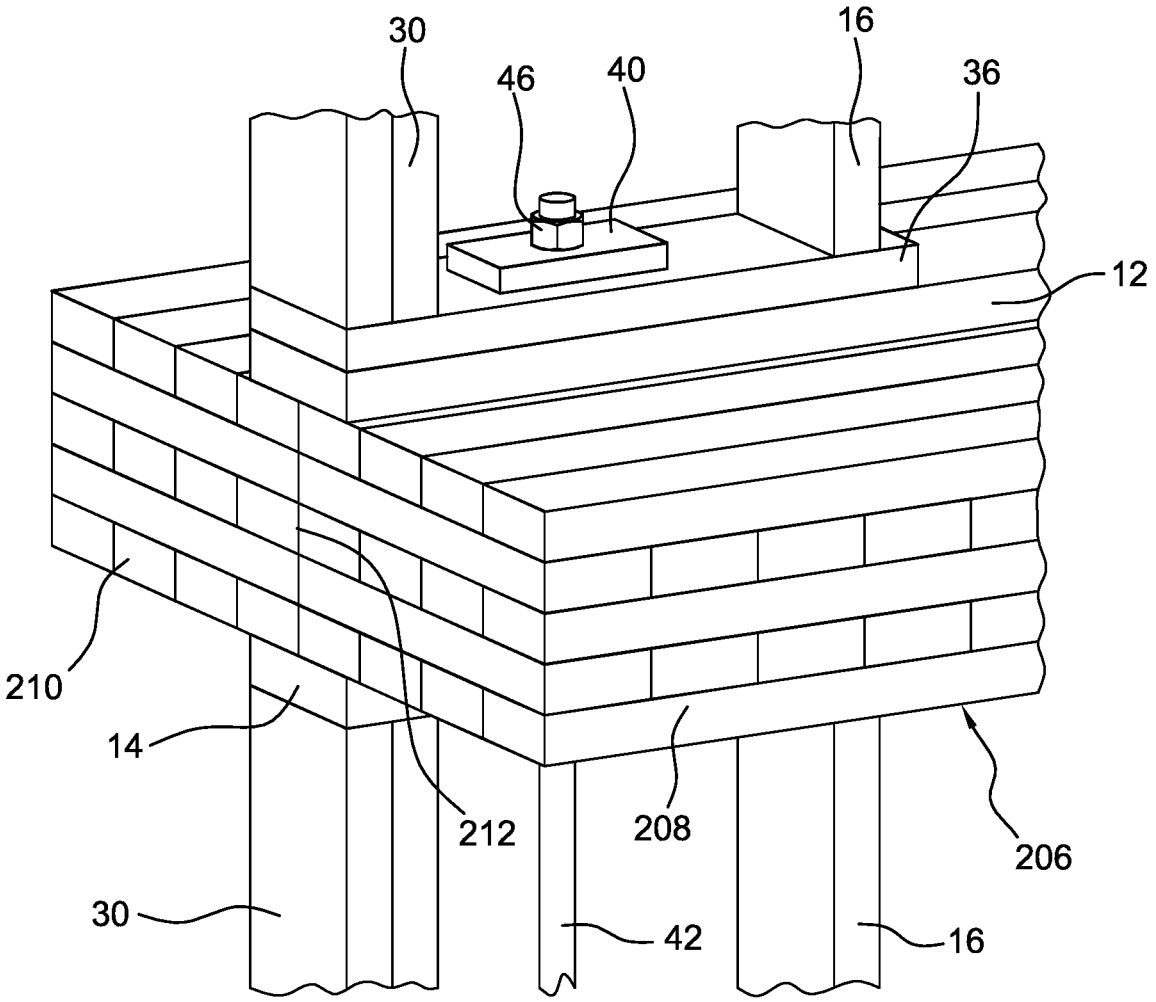
Figure 57A:
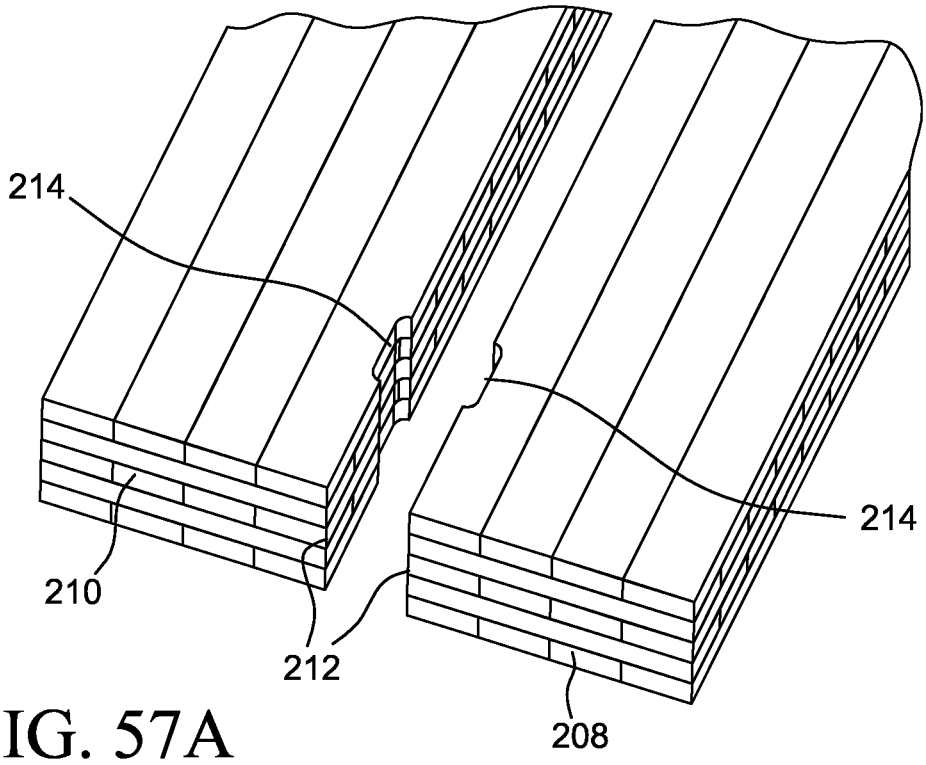
Figure 57B:
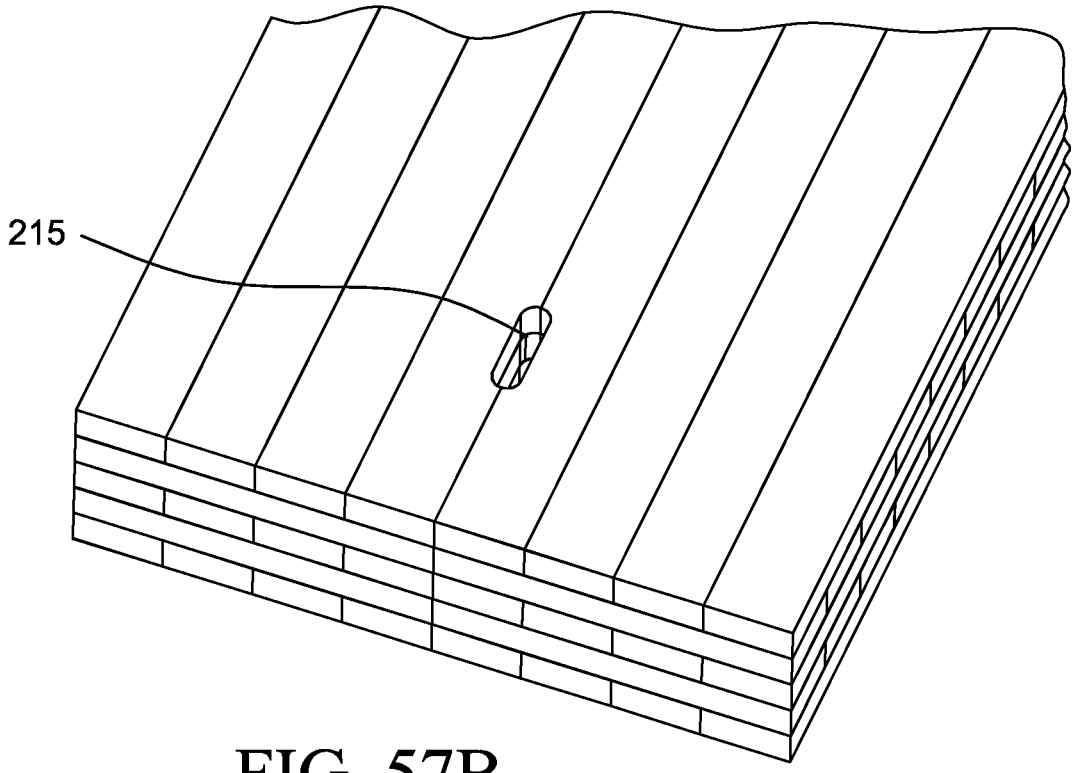

Referring to FIGS. 56 and 57A-57B, a wall section similar to the wall section of FIG. 51 is shown, except that the floor panel 206 is in two sections 208 and 210 joined along a seam 212. The seam 212 is disposed over the single top plate 14 and below the bottom plate 12. The wall bridges the seam 212. Each of the sections 208 and 210 includes a half-slot 214 to allow the tie-rod 42 to pass through a slotted opening 215 when the sections 208 and 210 are joined together.

Figure 58:
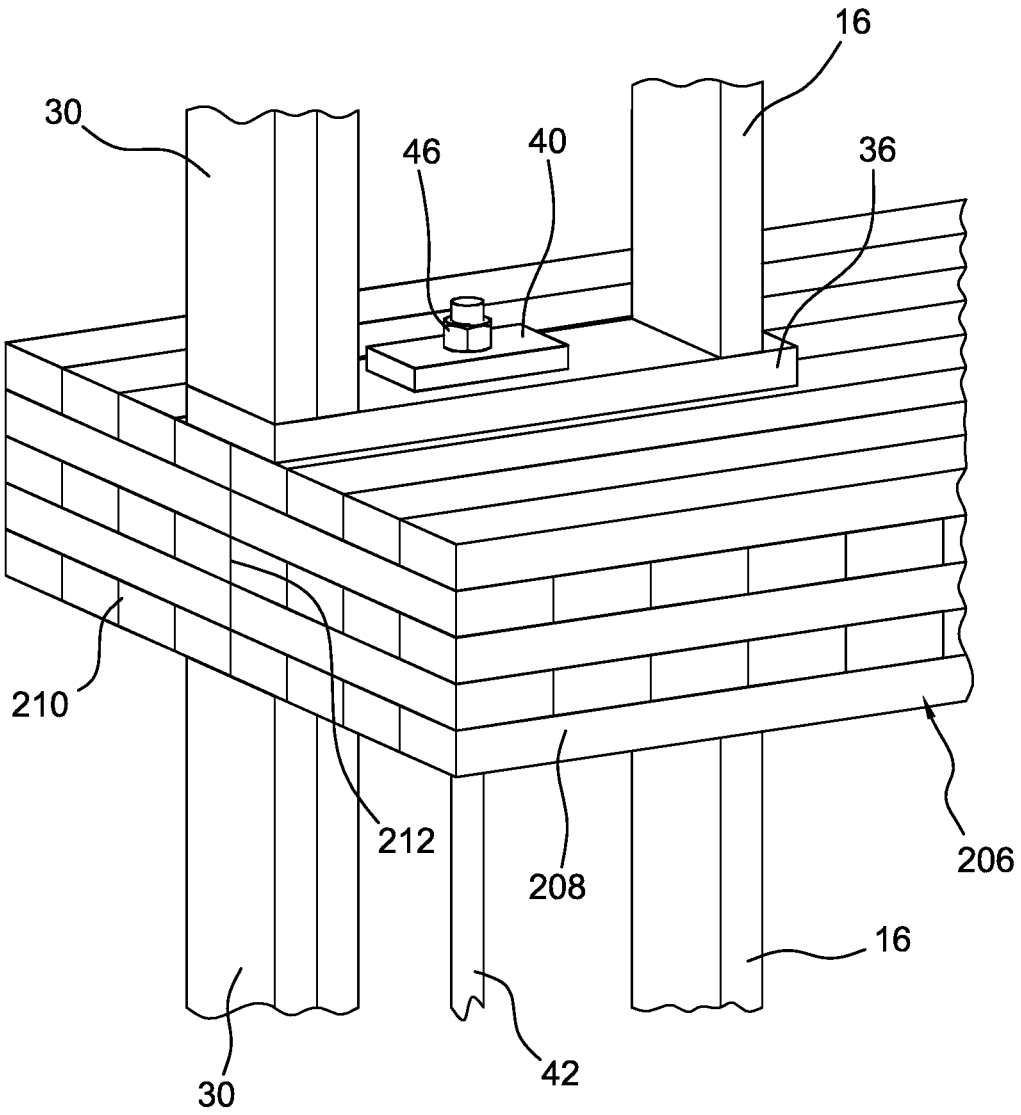

Referring to FIG. 58, a wall section similar to the wall section of FIG. 56 is shown, except that the bottom plate 12 and the single top plate 14 are not used. The member 36 bridges the seam 212.

While this invention has been described as having preferred design, it is understood that it is capable of further modification, uses and/or adaptations following in general the principle of the invention and including such departures from the present disclosure as come within known or customary practice in the art to which the invention pertains, and as may be applied to the essential features set forth, and fall within the scope of the invention or the limits of the appended claims.

I claim:

1. A reinforced stud-framed wall, comprising:

a) a tie rod anchored to a foundation;

b) a bottom plate disposed directly on a subfloor;

c) the bottom plate has a compression strength greater than a compression strength of the subfloor; and d) a plurality of vertical studs supported on the bottom plate;

e) the tie rod extending through the bottom plate; and f) the bottom plate is operably attached to the subfloor.

2. The reinforced stud-framed wall as in claim 1, and further comprising:

a) a bearing plate disposed on the bottom plate and a fastener on the bearing plate, the bearing plate having a contact area on the bottom plate; and b) the bearing plate transferring a load onto the subfloor over an area larger than the contact area.

3. The reinforced stud-framed wall as in claim 2, wherein the fastener includes an axially expandable fastener.

4. The reinforced stud-framed wall as in claim 2, wherein:

a) the bottom plate includes an engineered lumber; and b) the fastener includes an axially expandable fastener.

5. The reinforced stud-framed wall as in claim 2, wherein the fastener includes a nut.

6. The reinforced stud-framed wall as in claim 1, wherein the bottom plate includes hollow metal.

7. The reinforced stud-framed wall as in claim 1, wherein the bottom plate includes solid metal.

8. The reinforced stud-framed wall as in claim 1, wherein the bottom plate includes an engineered lumber.

9. A reinforced stud-framed wall, comprising:

a) a bottom plate having a compression strength;

b) a solid non-metallic member supported on the bottom plate over a first contact area;

c) the member having a compression strength greater than the compression strength of the bottom plate;

d) a bearing plate disposed on top of the member, the bearing plate having a second contact area on the member;

e) a tie rod extending through the member and the bearing plate;

f) a fastener for securing the bearing plate on the member and the tie rod; and g) the bearing plate transferring a load onto the bottom plate through the member over a projected area on the first contact area that is larger than the second contact area.

10. The reinforced stud-framed wall as in claim 9, wherein the fastener includes a nut.

11. The reinforced stud-framed wall as in claim 9, wherein the fastener includes an expandable fastener.

12. The reinforced stud-framed wall as in claim 9, wherein the member has sufficient thickness such that the second contact area encompasses the first contact area.

13. The reinforced stud-framed wall as in claim 9, wherein the compression strength of the member is lower than the compression strength of the bearing plate and higher than the compression strength of the bottom plate.

14. A method for transferring a load onto a wood part of a stud-framed wall, comprising:

a) interposing a solid non-metallic member between the load and the wood part, the member making a contact area on the wood part; and b) providing the member with a compression strength greater than a compression strength of the wood part such that the load is transferred onto the wood part over a projected area on the contact area that is larger than an area of application of the load on the member.

15. The method as in claim 14, and further comprising the step of providing wood, engineered lumber, or plastic for the member.

16. The method as in claim 14, wherein the load is applied through a bearing plate disposed on the member.

17. The method as in claim 14, wherein the load is applied through a bottom end or a top end of a stud.

18. A reinforced stud-framed wall, comprising:

a) horizontal wood part having a first compression strength;

b) a solid non-metallic member bearing onto the horizontal wood part from a load applied on a first area on the member, the member having a contact area on the wood part, the member having a second compression strength greater than the first compression strength; and c) the member transferring the load to the wood part over a projected area on the contact area that is larger than the first area.

19. The reinforced stud-framed wall as in claim 18, wherein the member includes wood or engineered lumber.

20. The reinforced stud-framed wall as in claim 18, wherein the horizontal wood part includes a bottom plate of the wall, or a subfloor.

21. The reinforced stud-framed wall as in claim 18, wherein:

a) the horizontal wood part includes a top plate of the wall; and b) the member bears onto an underside of the top plate.

22. The reinforced stud-framed wall as in claim 18, wherein:

a) a bottom end of a vertical stud bears on the member; and b) the first area comprises an area of the bottom end.

23. The reinforced stud-framed wall as in claim 18, wherein:

a) a bearing plate bears on the member; and b) the first area comprises an area of the bearing plate in contact with the member.

24. The reinforced stud-framed wall as in claim 18, wherein:

a) the horizontal wood part includes a top plate of the wall;

b) the member bears onto an underside of the top plate;

c) a top end of a vertical stud bears on an underside of the member; and d) the first area comprises an area of the top end.

25. The reinforced stud-framed wall as in claim 18, wherein:

a) the horizontal wood part includes a bridge member;

b) the member bears onto an underside of the bridge member;

c) a top end of a vertical stud bears on the member underneath; and d) the first area comprises an area of the top end.

26. The reinforced stud-framed wall as in claim 18, wherein the horizontal wood part includes a cross-laminated timber panel.

27. A reinforced stud-framed wall, comprising:

a) a bottom plate disposed on a wood part, the bottom plate being made of sheet metal having U-shaped cross-section with a bottom wall and sidewalls;

b) a member supported on the bottom wall over a first contact area;

c) a bearing plate disposed on top of the member, the bearing plate having a second contact area on the member;

d) a tie rod extending through the member and the bearing plate;

e) a fastener for securing the bearing plate on the member and the tie rod; and f) the bearing plate transferring a load onto the bottom wall through the member over a projected area on the first contact area that is larger than the second contact area.

28. The reinforced stud-framed wall as in claim 27, wherein the member has a compression strength greater than the compression strength of the wood part.

29. A reinforced stud-framed wall, comprising:

a) a bottom plate having a compression strength;

b) a stud bay in an end portion of the stud-framed wall, the stud bay including an outer stud and an inner stud spaced apart from the outer stud, the outer stud and the inner stud being supported on the bottom plate;

c) a member supported on the bottom plate over a first contact area within the stud bay, the member having a compression strength greater than the compression strength of the bottom plate; and d) a first stud adjacent to the outer stud, the first stud including a first bottom end supported on the member over a second contact area, the first stud transferring a first load onto the bottom plate through the member over a projected area on the first contact area that is larger than the second contact area.

30. A reinforced stud-framed wall as in claim 29, and further comprising a second stud adjacent to the inner stud, the second stud including a second bottom end supported on the member over a third contact area, the second stud transferring a second load onto the bottom plate through the member over a projected area on the first contact area that is larger than the third contact area.

31. A reinforced stud-framed wall as in claim 30, wherein the second stud is operably attached to the inner stud with nails or screws.

32. A reinforced stud-framed wall as in claim 29, wherein the first stud is operably attached to the outer stud with nails or screws.

33. The reinforced stud-framed wall as in claim 29, wherein the member includes is hollow metal.

34. The reinforced stud-framed wall as in claim 29, wherein the member includes is solid metal.

35. The reinforced stud-framed wall as in claim 29, wherein the member includes is engineered lumber.

36. The reinforced stud-framed wall as in claim 29, wherein the member includes is plastic.

37. A reinforced stud-framed wall, comprising:

a) first and second vertical studs disposed a distance apart;

b) a horizontal wood part disposed between the first and second studs, the wood part including a length equal to the distance;

c) a member disposed on the wood part, the member having the length of the wood part, the member having a compression strength greater than a compression strength of the wood part;

d) a tie-rod extending through the wood part and the member; and e) a fastener securing the member to the tie-rod.

38. A reinforced stud-framed wall, comprising:

a) first and second vertical studs disposed a distance apart;

b) a horizontal wood part disposed between the first and second studs, the wood part including a length equal to the distance;

c) a member disposed underneath the wood part, the member having the length of the wood part, the member having a compression strength greater than a compression strength of the wood part;

d) a tie-rod extending through the wood part and the member; and e) a fastener securing the wood part to the tie-rod.

39. A reinforced stud-framed wall, comprising:

a) a bridge member having a first compression strength;

b) a planar member bearing onto the bridge member from a load from an end of a vertical wall member bearing onto a first area on the planar member, the planar member having a contact area on the bridge member, the planar member having a second compression strength greater than the first compression strength; and c) the planar member transferring the load to the bridge member over a projected area on the contact area that is larger than the first area.

40. The reinforced stud-frame wall as in claim 39, wherein:

a) the planar member is below the bridge member; and b) the vertical wall member is below the planar member.

41. The reinforced stud-frame wall as in claim 39, wherein the planar member is metal.

42. A reinforced stud-framed wall, comprising:

a) a bridge member having a first compression strength;

b) a planar member disposed on the bridge member, the planar member having a contact area on the bridge member, the planar member having a second compression strength greater than the first compression strength; and c) support studs disposed below the bridge member, the support studs including top end portions disposed directly vertically below the contact area.

43. A method for transferring a load from a vertical wall member onto a bridge member in a stud-framed wall, comprising:

a) placing a planar member between the vertical wall member and the bridge member, the planar member making a contact area on the bridge member; and b) providing the planar member with a compression strength greater than a compression strength of the bridge member such that the load from the vertical wall member is transferred onto the bridge member over a projected area on the contact area that is larger than an area of application of the load on the member.

* * * * *